US009481539B2

(12) United States Patent
Kadota

(10) Patent No.: US 9,481,539 B2
(45) Date of Patent: Nov. 1, 2016

(54) PAPER SHEET HANDLING DEVICE

(71) Applicant: Oki Electric Industry Co., Ltd., Tokyo (JP)

(72) Inventor: Kenji Kadota, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/650,919

(22) PCT Filed: Nov. 18, 2013

(86) PCT No.: PCT/JP2013/081046
§ 371 (c)(1),
(2) Date: Jun. 10, 2015

(87) PCT Pub. No.: WO2014/097795
PCT Pub. Date: Jun. 26, 2014

(65) Prior Publication Data

US 2015/0307306 A1 Oct. 29, 2015

(30) Foreign Application Priority Data

Dec. 20, 2012 (JP) ..... 2012-278449

(51) Int. Cl.
*B65H 29/58* (2006.01)
*G07D 11/00* (2006.01)
(Continued)

(52) U.S. Cl.
CPC ..... *B65H 29/58* (2013.01); *B65H 1/00* (2013.01); *B65H 1/266* (2013.01); *B65H 1/28* (2013.01); *B65H 3/0676* (2013.01); *B65H 5/06* (2013.01); *B65H 5/062* (2013.01); *B65H 5/26* (2013.01); *B65H 5/36* (2013.01); *B65H 29/22* (2013.01);
(Continued)

(58) Field of Classification Search
CPC ..... B65H 5/06; B65H 5/00; B65H 29/00; B65H 31/22; B65H 31/24; B65H 1/28; B65H 1/266; B65H 2402/32; B65H 2405/331; B65H 2405/324; B65H 2701/1912; B65H 2402/10; B65H 2402/441; B65H 29/58; B65H 29/60; B65H 29/52; G07D 11/0003; G07D 9/00; G07D 7/00; G07D 11/0021; G07D 13/00; G07D 2211/00
USPC ..... 271/298
See application file for complete search history.

(56) References Cited

U.S. PATENT DOCUMENTS 8,973,817 B1 * 3/2015 Daniel, III ..... G07F 19/202 194/205
2009/0212493 A1 8/2009 Sugahara et al.
(Continued)

FOREIGN PATENT DOCUMENTS

JP H09-208134 A 8/1997
JP 2009-205252 A 9/2009

*Primary Examiner* — David H Bollinger
(74) *Attorney, Agent, or Firm* — Rabin & Berdo, P.C.

(57) ABSTRACT

A paper sheet handling device that facilitates removal of paper sheets blocked on a conveying path. The device includes a safe casing internally provided with a paper sheet storage box; a processing unit capable of being pulled out from, or stowed in, a main device; a conveying section coupled to the processing unit, and that forms a conveying path; a handover section coupled to a top plate of the safe casing to hand over the sheets between the storage box and the conveying path; and a positioning section that positions for connecting the handover section and the conveying path together when the processing unit is being stowed in the main device.

10 Claims, 33 Drawing Sheets

(51) Int. Cl.

| | |
|---|---|
| ***B65H 1/26*** | (2006.01) |
| ***B65H 1/28*** | (2006.01) |
| ***B65H 5/06*** | (2006.01) |
| ***B65H 5/36*** | (2006.01) |
| ***B65H 1/00*** | (2006.01) |
| ***B65H 3/06*** | (2006.01) |
| ***B65H 5/26*** | (2006.01) |
| ***B65H 29/22*** | (2006.01) |
| ***B65H 31/24*** | (2006.01) |
| ***B65H 29/52*** | (2006.01) |
| ***B65H 29/60*** | (2006.01) |
| ***B65H 83/02*** | (2006.01) |

(52) U.S. Cl.

CPC ..... *B65H 29/52* (2013.01); *B65H 29/60* (2013.01); *B65H 31/24* (2013.01); *B65H 83/025* (2013.01); *G07D 11/00* (2013.01); *G07D 11/0003* (2013.01); *B65H 2402/10* (2013.01); *B65H 2402/31* (2013.01); *B65H 2402/32* (2013.01); *B65H 2402/441* (2013.01); *B65H 2403/5311* (2013.01); *B65H 2404/6112* (2013.01); *B65H 2405/313* (2013.01); *B65H 2405/324* (2013.01); *B65H 2405/325* (2013.01); *B65H 2405/331* (2013.01); *B65H 2601/11* (2013.01); *B65H 2701/1912* (2013.01)

(56) References Cited

U.S. PATENT DOCUMENTS

| | | | | |
|---|---|---|---|---|
| 2010/0007075 | A1* | 1/2010 | Ito | G07D 11/0084 271/3.04 |
| 2011/0068528 | A1* | 3/2011 | Kobayashi | B65H 5/34 270/58.07 |
| 2013/0307210 | A1* | 11/2013 | Takada | B65H 5/26 271/3.19 |
| 2014/0190787 | A1* | 7/2014 | Fujita | G07D 11/0012 194/206 |
| 2014/0332340 | A1* | 11/2014 | Adachi | B65H 31/24 194/206 |
| 2015/0210502 | A1* | 7/2015 | Ando | B65H 31/26 271/220 |

* cited by examiner

PAPER SHEET HANDLING DEVICE

TECHNICAL FIELD

The present invention relates to a paper sheet handling device, and is suitably applied, for example, to a banknote processing device that performs pay-in processing and pay-out processing of banknotes according to operation by a window counter cashier inside a branch of a financial institution, or operation by a customer visiting a branch of a financial institution.

BACKGROUND ART

Hitherto, automated teller machines have been disposed with a safe provided with plural banknote storage boxes, with an upper banknote mechanism including a banknote pay-in/pay-out port provided over the safe, capable of moving banknotes in the front-rear direction and taking out or storing the banknotes.

Automated teller machines are also provided with a conveying section within the upper banknote mechanism (also referred to below as an in-mechanism conveying section), and a conveying path (also referred to below as an in-mechanism banknote conveying path) is formed by the in-machine conveying section to convey the banknotes and to change the conveying direction of banknotes in the upper banknote mechanism as appropriate.

Automated teller machines are also provided with a conveying section within the safe (also referred to below as an in-safe conveying section), and a conveying path (also referred to below as an in-safe banknote conveying path) is formed by the in-safe conveying section to convey the banknotes and to change the conveying direction of banknotes in the safe as appropriate.

Moreover automated teller machines are also provided with a handover section, in a hole that pierces the ceiling plate of the safe, and the handover section forms a handover path for conveying banknotes such that the banknotes are passed over from the in-mechanism banknote conveying path to the in-safe banknote conveying path, or from the in-safe banknote conveying path to the in-mechanism banknote conveying path.

In automated teller machines, the lower end of the handover path is connected to the in-safe banknote conveying path within the safe, and the upper end of the handover path is detachably connected to the in-mechanism banknote conveying path as appropriate.

Namely, in an automated teller machine, the in-mechanism banknote conveying path is separated from the upper end of the handover path when the upper banknote mechanism is removed for maintenance or the like, however the in-mechanism banknote conveying path is connected to the upper end of the handover path when the upper banknote mechanism is stowed.

Thus in an automated teller machine, in the stowed state of the upper banknote mechanism, banknotes inserted through the pay-in/pay-out port are conveyed along the in-mechanism banknote conveying path in the upper banknote mechanism, then passed to the in-safe banknote conveying path in the safe via the handover path, and then conveyed along the in-safe banknote conveying path in the safe to the plural banknote storage boxes where the banknotes are then stored.

In an stowed state of an upper banknote mechanism in an automated teller machine, banknotes fed out from the plural banknote storage boxes are conveyed along the in-safe banknote conveying path in the safe, then passed to the in-mechanism banknote conveying path in the upper banknote mechanism via the handover path, and then conveyed along the in-mechanism banknote conveying path in the upper banknote mechanism to the pay-in/pay-out port where the banknotes are handed over to a customer (see, for example, page 4 to page 8, FIG. 3, and FIG. 5 to FIG. 13 of Japanese Patent Application Laid-Open (JP-A) No. 2009-205252).

SUMMARY OF INVENTION

Technical Problem

However, in automated teller machines of such a configuration, if, for example, banknotes in a comparatively poor state, such as creased or curled banknotes and the like are conveyed along the in-mechanism banknote conveying path and the in-safe banknote conveying path, sometimes these banknotes catch and become blocked in the in-mechanism banknote conveying path and the in-safe banknote conveying path at portions such as those where the conveying direction of the banknotes is to be changed, and what is referred to as a jam, occurs.

In automated teller machines, when a jam has occurred, the device needs to be stopped, and the banknotes (also referred to below as jammed banknotes) that have jammed (namely become blocked) need to be removed from the in-mechanism banknote conveying path and the in-safe banknote conveying path.

However, due to the in-mechanism banknote conveying section being provided in the upper banknote mechanism of an automated teller machine, when a jam occurs on the in-mechanism banknote conveying path, a removal operation is performed to remove the jammed banknotes from the in-mechanism banknote conveying path only after an operator has taken the upper banknote mechanism out from the machine.

Moreover, due to the in-safe conveying section being provided inside the safe in an automated teller machine, when a jam has occurred on the in-safe banknote conveying path, a removal operation is performed to remove the jammed banknotes from the in-safe banknote conveying path only after an operator has taken the in-safe conveying section out from the safe.

Thus when a jam occurs in an automated teller machine, there is the issue that an operator needs to change procedure in the jammed banknote removal operation according to the location where the jam occurred, complicating the jammed banknote removal operation.

In consideration of the above circumstances, the present invention addresses the provision of a paper sheet handling device achieving a simplification of blocked paper sheet removal operation from a conveying path.

Solution to Problem

In order to solve the above problem, the present invention includes: a safe casing that is internally provided with a paper sheet storage box; a processing unit that processes paper sheets and is provided so as to be capable of being pulled out from, or stowed in, a main device; a conveying section that is provided to the processing unit, and that forms a conveying path for conveying the paper sheets; a handover section that is provided to a top plate of the safe casing in order to hand over the paper sheets between the paper sheet storage box and the conveying path; and a positioning section that positions for connecting the handover section and the conveying path together when the processing unit is being stowed in the main device.

Thus in the present invention, when the processing unit is being stowed in the main device, the handover section and the conveying path are connected together to enable handover of the paper sheets without getting blocked, and even if the paper sheets become blocked during conveying, the location where the paper sheets become blocked can be limited to a conveying path of the processing unit. As a result, even if the paper sheets become blocked during conveying, the blocked paper sheets can be removed from the conveying path by pulling only the processing unit out from the main device.

Advantageous Effects of Invention

According to the present invention, due to providing the safe casing housing the paper sheet storage box, the processing unit that processes paper sheets and is provided so as to be capable of being pulled out from, or stowed in, the main device, the conveying section that is provided to the processing unit and that forms the conveying path for conveying the paper sheets, the handover section that is provided to the top plate of the safe casing in order to hand over the paper sheets between the paper sheet storage box and the conveying path, and the positioning section that positions for connecting the handover section and the conveying path together when the processing unit is being stowed in the main device, the handover section and the conveying path are connected together so as to enable handover of the paper sheets without getting blocked when the processing unit is stowed in the main device, and even if the paper sheets become blocked during conveying, the location where the paper sheets become blocked can be limited to a conveying path of the processing unit. As a result, even if the paper sheets become blocked during conveying, the blocked paper sheets can be removed from the conveying path by pulling only the processing unit out from the main device, thus enabling implementation of a paper sheet handling device with a simplified removal operation for blocked paper sheets on the conveying path.

DESCRIPTION OF EMBODIMENTS

Explanation next follows regarding best embodiments for implementing the present invention (also referred to below as exemplary embodiments), with reference to the drawings. Explanation is given in the following sequence.

Figure 1:
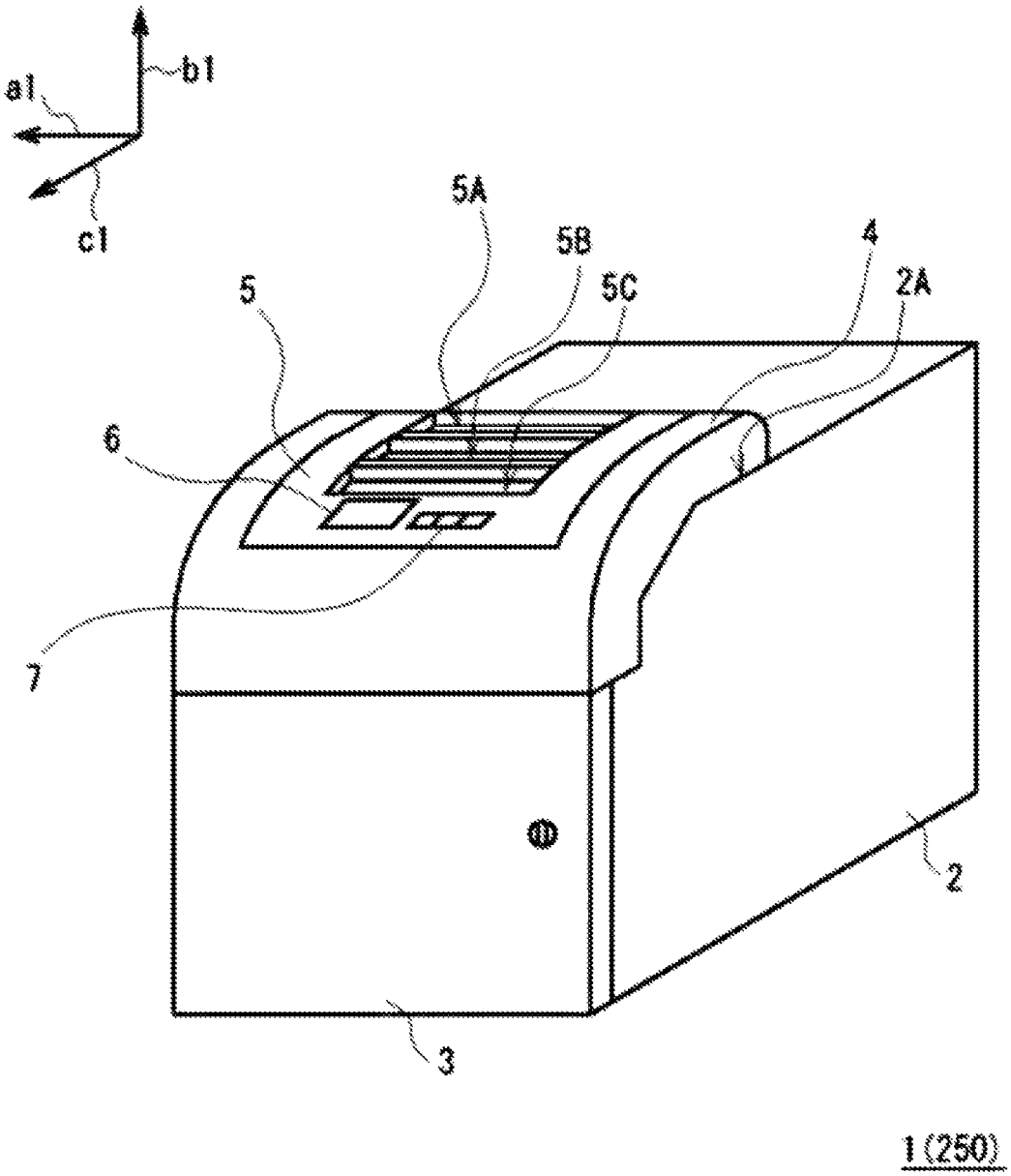
FIG. 1 is a schematic perspective view illustrating the external appearance of a banknote processing device according to a first exemplary embodiment.

(1) First Exemplary Embodiment (2) Second Exemplary Embodiment (3) Other Exemplary Embodiments (1) First Exemplary Embodiment (1-1) External Configuration of Banknote Processing Device FIG. 1 illustrates an overall external configuration of a banknote processing device 1 according to a first exemplary embodiment. The banknote processing device 1 is, for example, placed at a window counter in a branch of a financial institution, and is an operation terminal for a window counter cashier to operate for pay-in or payout of banknotes, or for a customer visiting a branch of a financial institution to operate for pay-in or payout of banknotes.

The banknote processing device 1 includes, for example, a substantially box shaped casing 2 having its length along the front-rear direction (also referred to below as the device casing).

The device casing 2 is formed with an opening 2A spanning from a front end to an upper front end portion of the device casing 2. The device casing 2 is provided with a rectangular shaped door (also referred to below as a device door) 3 capable of opening and closing about a hinge section (not illustrated in the drawings) provided towards the bottom of the front end (namely, a portion of the opening 2A can be opened and closed).

In the following explanation, a left direction of the banknote processing device 1 as viewed facing the front end of the device casing 2 (namely, facing the front face of the device door 3 in a closed state), illustrated by an arrow a1 in the drawings, is also referred to as the device left direction, and the opposite direction to the device left direction is also referred to as the device right direction.

In the following explanation, when there is no particular need to discriminate between the device left direction and the device right direction, these are referred to collectively as the device left-right direction.

In the following explanation, an upward direction of the banknote processing device 1 as viewed facing the front end of the device casing 2 (namely, facing the front face of the device door 3 in a closed state), illustrated by an arrow b1 in the drawings, is also referred to as the device upward direction, and the opposite direction to the device upward direction is also referred to as the device downward direction.

In the following explanation, when there is no particular need to discriminate between the device upward direction and the device downward direction, these are referred to collectively as the device up-down direction.

Moreover, in the following explanation, a nearside direction of the banknote processing device 1 as viewed facing the front end of the device casing 2 (namely, facing the front face of the device door 3 in a closed state), illustrated by an arrow c1 in the drawings, is also referred to as the device front direction, and the opposite direction to the device front direction is also referred to as the device rear direction.

In the following explanation, when there is no particular need to discriminate between the device front direction and the device rear direction, these are referred to collectively as the device front-rear direction.

The device casing 2 is provided with a substantially J-shaped unit cover 4, provided so as to project out to the upper side of an upper front end portion of the device casing 2, and portions of the opening 2A, other than a portion closed off by the device door 3, are closed off by the unit cover 4.

The unit cover 4 is formed with an upper face having a circular arc shape that gradually lowers from the rear toward the front, so as to smoothly connect to the vertical front face, and an operation panel 5 is provided on the upper face.

The operation panel 5 is formed with a front face that, for example, has a circular arc shape substantially equivalent to the shape of the upper face of the unit cover 4, and the operation panel 5 is provided to the unit cover 4 such that the front face of the operation panel 5 is in substantially the same plane as the upper face of the unit cover 4.

The front face of the operation panel 5 is formed, for example, with a single banknote insertion port 5A and two banknote pay-out ports 5B, 5C, in this sequence from the rear to the front, that are formed in substantially rectangular shapes, with their length directions along the left-right direction.

A display section 6, such as a liquid crystal display or an organic electro luminescence (EL) display, for displaying guidance images to guide banknote pay-in/pay-out procedures, is disposed on the front face of the operation panel 5 on the left at the front of the banknote pay-out port 5C that is positioned furthest to the front.

An operation section 7 including plural operation keys, for example press-operable keys, is also disposed on the front face of the operation panel 5 on the right at the front of the banknote pay-out port 5C that is positioned furthest to the front.

The thus configured banknote processing device 1 thereby displays a guidance image on the display section 6, and is capable of switching the guidance image displayed on the display section 6 as appropriate according to the operation of the operation section 7 by a cashier or customer.

The banknote processing device 1 guides the cashier or customer through banknote pay-in/pay-out procedures using guidance images that are appropriately switched and displayed on the display section 6.

During pay-in processing, the banknote processing device 1 thereby prompts the cashier or customer to insert banknotes for pay-in into the banknote insertion port 5A according to guidance for the pay-in procedure by guidance images, and performs pay-in processing on the banknotes that have been inserted into the banknote insertion port 5A.

During pay-out processing, the banknote processing device 1 prompts the cashier or customer to specify the amount to be paid out using the operation section 7 according to guidance for the pay-out procedure by the guidance images, and performs banknote pay-out processing according to the specified amount.

The banknote processing device 1 then prompts the cashier or customer to remove the paid-out banknotes from at least one of the two banknote pay-out ports 5B, 5C according to guidance for the pay-out procedure by the guidance images.

The banknote processing device 1 is thereby able to perform banknote pay-in or pay-out as requested by the cashier or customer according to the operations of the cashier or customer.

Although not illustrated, the banknote processing device 1 is also connected to other terminals and a host computer of the financial institution, so as to enable communication over a network.

The banknote processing device 1 is thereby configured to enable the exchange of various data, such as data relating to banknote pay-in/pay-out, with the other terminals and the host computer of the financial institution over the network, and to enable operation from the side of the other terminals and the host computer.

(1-2) Internal Configuration of Banknote Processing Device

Figure 2:
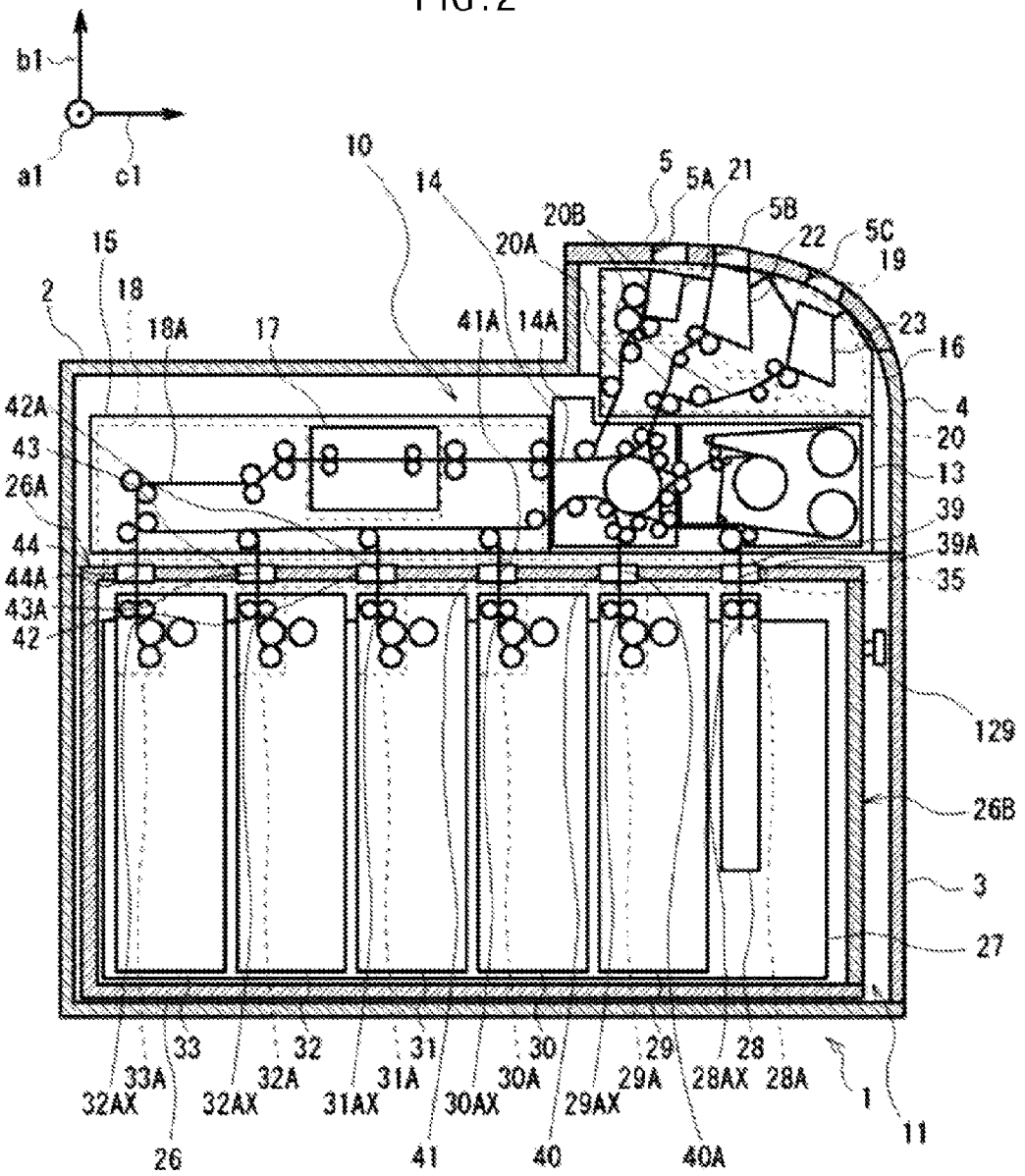
FIG. 2 is a schematic side view illustrating an internal configuration of a banknote processing device according to the first exemplary embodiment.

Explanation next follows regarding an internal configuration of the banknote processing device 1. As illustrated in FIG. 2, the device casing 2 of the banknote processing device 1 houses a controller (not illustrated in the drawings) that integrally controls the banknote processing device 1 overall.

The device casing 2 also houses upper and lower two tier processing units 10, 11 that process the banknotes for pay-in/pay-out according to control by the controller.

In the following explanation, the upper positioned processing unit 10 from out of the upper and lower two tier processing units 10, 11 is also referred to as the upper unit 10.

Moreover, in the following explanation, the lower positioned processing unit 11 from out of the upper and lower two tier processing units 10, 11 is also referred to as the lower unit 11.

The upper unit 10 includes a frame (also referred to below as an upper frame), described later. A temporary holding section 13, a conveying section (also referred to below as an switching conveying section) 14 that relays conveyed banknotes and appropriately switches the conveying destination of the banknotes, and a classification and conveying unit 15 are provided to the upper frame in this sequence from the front to the rear.

A pay-in/pay-out conveying unit 16 is provided to the upper frame above the temporary holding section 13 and the switching conveying section 14.

The upper unit 10 is thereby formed overall substantially L-shaped, such that the upper end of the pay-in/pay-out conveying unit 16 projects out further to the upper side than the upper end of the device casing 2.

In the upper unit 10, the unit cover 4 (namely, the unit cover 4 provided with the operation panel 5) is provided so as to cover from the upper end of the pay-in/pay-out conveying unit 16 to the front end of the temporary holding section 13.

The temporary holding section 13 temporarily holds banknotes introduced from the switching conveying section 14, and feeds temporarily held banknotes out to the switching conveying section 14.

More specifically, the temporary holding section 13 includes plural rollers, plural conveyor belts, a single rotation drum, a pair of, or plural pairs of tape reels, a motor, and the like.

The temporary holding section 13 temporarily holds banknotes introduced using the plural rollers and the plural conveyor belts, by winding the banknotes onto the rotation drum while gripping the banknotes between tapes fed out from the pair of, or plural pairs of tape reels.

The temporary holding section 13 extracts the banknotes from between the tapes by taking up the tapes on the pair of, or plural pairs of tape reels while rotating the rotation drum in the reverse direction, and feeds the banknotes out to the switching conveying section 14 using the plural rollers and the plural conveyor belts.

The classification and conveying unit 15 is configured from a classification section 17 and a conveying section 18 that have been integrated together. In the following explanation, the conveying section 18, integrated together with the classification section 17 to configure the classification and conveying unit 15 toward the rear of the upper frame, is also referred to as the rear-side conveying section 18.

The classification section 17 classifies banknotes by the denomination, the condition, and the like of the banknote, as they pass through inside, conveyed by the rear-side conveying section 18.

The rear-side conveying section 18 includes various conveying path configuring components, such as plural conveying rollers and plural conveyor belts, plural conveying guides, plural conveying direction switching blades, a motor, and the like.

The rear-side conveying section 18 is formed with a substantially angular C-shaped conveying path (also referred to below as a rear-side conveying path) 18A for conveying banknotes, using the conveying path configuring components, through the classification section 17 in the device front direction and the device rear direction.

In this example, the rear-side conveying path 18A includes a classification side section that conveys banknotes in the device front direction and the device rear direction so as to pass through the classification section 17, and a classification lower section that conveys banknotes in the device front direction and the device rear direction further to the lower side than the classification section 17.

The rear-side conveying path 18A includes a switch-back section connecting the classification side section and the classification lower section together at a position to the rear end side of the classification and conveying unit 15, and conveying banknotes so as to turn back on themselves.

The pay-in/pay-out conveying unit 16 is configured by a pay-in/pay-out section 19 and a conveying section 20 that have been integrated together. In the following explanation, the conveying section 20, integrated together with the pay-in/pay-out section 19 to serve as the pay-in/pay-out conveying unit 16 at a front upper end portion of the upper frame, is also referred to as the upper-side conveying section 20.

The pay-in/pay-out section 19 includes a single substantially box shaped banknote receiving section 21 provided so as to correspond to the single banknote insertion port 5A of the operation panel 5, and includes two substantially box shaped banknote delivery sections 22, 23 provided so as to correspond to the two banknote pay-out ports 5B, 5C of the operation panel 5.

The pay-in/pay-out section 19 includes plural rollers used for feeding out banknotes from the banknote receiving section 21, and plural rollers or the like used for introducing banknotes into the banknote delivery sections 22, 23.

The upper-side conveying section 20 includes various conveying path configuring components, such as plural conveying rollers and plural conveyor belts, plural conveying guides, plural conveying direction switching blades, a motor, and the like.

The upper-side conveying section 20 is formed with a conveying path (also referred to below as the upper-side feed-out conveying path) 20A for conveying the banknotes fed out banknotes from the banknote receiving section 21 using the conveying path configuring components.

The upper-side conveying section 20 is also formed with, for example, a substantially Y-shaped conveying path (also referred to below as the upper-side conveying path) 20B for conveying banknotes to be introduced into the two banknote delivery sections 22, 23 using the conveying path configuring components.

The switching conveying section 14 includes various conveying path configuring components, such as a single conveying roller with a comparatively large external diameter, plural conveying rollers with smaller external diameters, plural conveyor belts, plural conveying guides, plural conveying direction switching blades, a motor, and the like.

The switching conveying section 14 is formed with a switching conveying path 14A that conveys banknotes while appropriately switching the conveying destination of the banknotes using the conveying path configuring components. The switching conveying path 14A is connected to the temporary holding section 13, the rear-side conveying path 18A, the upper-side feed-out conveying path 20A, and the upper-side take-in conveying path 20B.

In reality the switching conveying section 14 includes plural conveying rollers with small external diameters at the periphery of a single conveying roller of large external diameter, plural conveying guides, plural conveying direction switching blades, and the like, disposed so as to form the substantially U-shaped switching conveying path 14A.

The switching conveying path 14A accordingly includes an upper section that conveys banknotes in the device front direction and the device rear direction at the pay-in/pay-out conveying unit 16 side, and a lower section that conveys banknotes in the device front direction and the device rear direction further to the lower side than the upper section.

The switching conveying path 14A includes a circular arc section that connects the upper section and the lower section together and is shaped in a circular arc so as to protrude toward the front side.

One end (namely, the rear end of the upper section) and the other end (namely, the rear end of the lower section) of the switching conveying path 14A are connected to one end and the other end of the rear-side conveying path 18A, so as to form an overall loop shaped conveying path, together with the rear-side conveying path 18A.

The switching conveying path 14A also includes a connection branch portion that branches off from a specific position on the circular arc section for connection to the temporary holding section 13, and another end of the connection branch portion is connected to the temporary holding section 13.

The switching conveying path 14A also includes a connection branch portion that branches off from a specific position on the upper section for connection to the upper-side feed-out conveying path 20A, and another end of the connection branch portion is connected to another end of the upper-side feed-out conveying path 20A.

The switching conveying path 14A also includes a connection branch portion that branches off from the vicinity of the boundary between the upper section for connection to the upper-side take-in conveying path 20B and the circular arc section, and another end of the connection branch portion is connected to another end of the upper-side take-in conveying path 20B.

The switching conveying section 14, the rear-side conveying section 18, and the upper-side conveying section 20 each drive the conveying rollers and conveyor belts, the conveying direction switching blades, and the like with their respective drive motors, so as to appropriately switch the conveying direction of the banknotes.

The lower unit 11 includes a safe casing 26 formed substantially box shaped so as to combine together plural comparatively thick metal plates. The safe casing 26 is fixed to a lower end portion inside the device casing 2, so as to correspond to the device door 3.

A substantially box shaped storage box loading case 27 with an open upper end portion is stowed inside the safe casing 26. The storage box loading case 27 includes, for example, plural partitioning plates of specific height installed in sequence at specific even intervals from the front side to the rear side on the bottom face (not illustrated in the drawings).

The bottom face of the storage box loading case 27 is accordingly sequentially partitioned into plural storage box loading locations from the front to the rear by the plural partitioning plates.

A banknote storage box 28 that stores abnormal banknotes, such as damaged banknotes or folded banknotes, is detachably loaded at the front most storage box loading location (namely, one location) of the storage box loading case 27.

Banknote storage boxes 29 to 33 that store plural banknotes for pay-in/pay-out by respective denomination (namely, each stores only one specific denomination of banknote) are detachably loaded at, for example, plural storage box loading locations (for example 5 locations) of the storage box loading case 27 other than the front most storage box loading location.

Namely, the storage box loading case 27 utilizes plural storage box loading locations to detachably load the plural banknote storage boxes 28 to 33 so as to be lined up in sequence from the front to the rear.

In the following explanation, the above abnormal banknotes, such as damaged banknotes or folded banknotes, are sometimes referred to as reject banknotes as appropriate to discriminate them from banknotes for pay-in/pay-out.

In the following explanation, in particular the single banknote storage box 28 that stores the reject banknotes is also referred to as the reject box 28 in order to discriminate it from the banknote storage boxes 29 to 33 that store the banknotes for pay-in/pay-out.

A conveying section (referred to below as a reject box conveying section) 28A, which includes various conveying path configuring components, such as plural conveying rollers and plural convey guides that have been integrated together, is provided in an upper end portion of the reject box 28.

The reject box conveying section 28A is formed with a conveying path (also referred to below as a take-in conveying path) 28AX that conveys the reject banknotes so as to introduce the reject banknotes into the reject box 28 using the conveying path configuring components.

Plural conveying sections (referred to below as storage box conveying sections) 29A to 33A, which each include various conveying path configuring components, such as plural conveying rollers and plural convey guides, and a motor that have been integrated together, are respectively provided in an upper end portion of the respective plural banknote storage boxes 29 to 33.

The storage box conveying sections 29A to 33A are formed with conveying paths (also referred to below as take-in/feed-out conveying paths) 29AX to 33AX that convey so as to introduce banknotes into banknote storage boxes 29 to 33, or so as to feed out banknotes from inside the banknote storage boxes 29 to 33, using the conveying path configuring components.

The reject box 28 and the plural banknote storage boxes 29 to 33 are provided inside the safe casing 26, however there are no conveying sections provided therein for conveying the reject banknotes and the pay-in/pay-out banknotes for collection from, or delivery to, the reject box 28 and the plural banknote storage boxes 29 to 33.

Thus in the upper unit 10, the switching conveying section 14 and the rear-side conveying section 18 are provided as conveying sections for conveying the reject banknotes and the pay-in/pay-out banknotes for collection from, or delivery to, the reject box 28 and the plural banknote storage boxes 29 to 33.

Namely, at the circular arc section, the switching conveying path 14A includes the connection branch portion branching off from a position corresponding to the storage box conveying section 29A of the banknote storage box 29 for connecting to the take-in/feed-out conveying path 29AX of the banknote storage box 29.

The switching conveying section 14 also includes the connection branch portion branching off from a specific position on the circular arc section and formed up to a position corresponding to the reject storage box conveying section 28A of the reject box 28 for connecting to the take-in conveying path 28AX of the reject box 28.

The rear-side conveying path 18A includes plural connection branch portions on the classification lower section branching off from positions corresponding to storage box conveying sections 30A to 33A of the plural banknote storage boxes 30 to 33 for connection to the take-in/feed-out conveying paths 30AX to 33AX of the plural banknote storage boxes 30 to 33.

A coupling section 35 is provided to the top plate (also referred to below as the safe top plate) 26A of the safe casing 26 for coupling the switching conveying section 14 and the rear-side conveying section 18 to the reject box conveying section 28A and the plural storage box conveying sections 29A to 33A.

Figure 3:
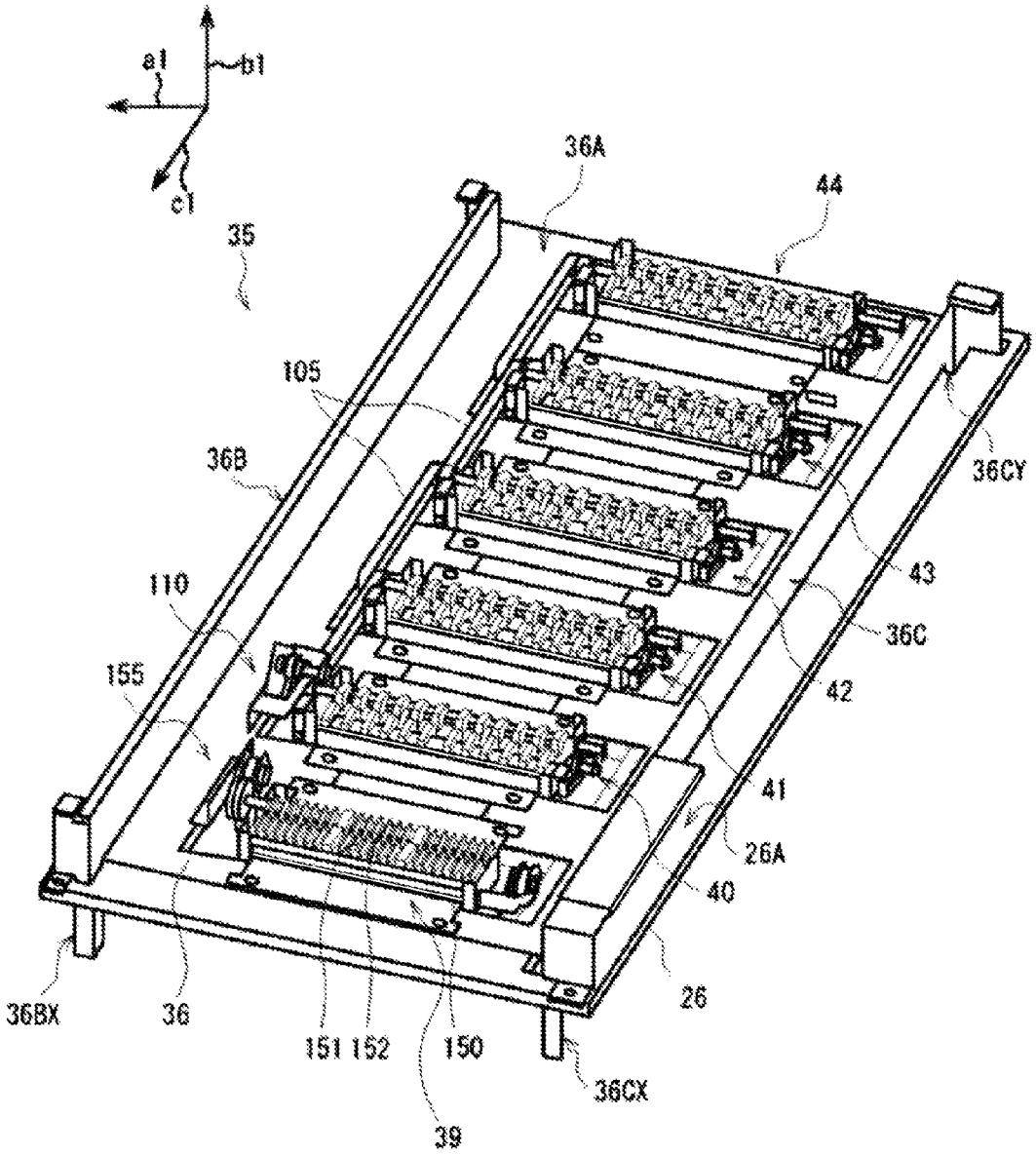
FIG. 3 is a schematic perspective view illustrating a configuration of a coupling section.

As illustrated in FIG. 3, the coupling section 35 is, for example, manufactured from a single substantially rectangular shaped metal sheet, and includes a coupling body 36 formed substantially the same size as the safe top plate 26A.

A substantially rectangular flat plate shaped attachment section 36A that is long in the front-rear direction is provided at a central portion of the coupling body 36. The coupling body 36 also includes a unit left support section 36B and a unit right support section 36C that are formed substantially angular C-shaped and long in the front-rear direction at the left end and the right end of the attachment section 36A, projecting out perpendicularly to the upper-side of the attachment section 36A.

In this example, a front end portion and a rear end portion of the unit left support section 36B of the coupling body 36 are bent at right angles toward the device left direction with respect to a central portion of the unit left support section 36B that is parallel to the device front-rear direction.

In the coupling body 36, at the respective lower sides of the bent portions at the front and rear of the unit left support section 36B, an angle profiled case left front support section 36BX and an angle profiled case left rear support section (not illustrated in the drawings) of a specific length are provided like extensions of the bent portions so as to project toward the lower side.

A front end portion and a rear end portion of the unit right support section 36C of the coupling body 36 are bent at right angles toward the device right direction with respect to a central portion of the unit right support section 36C that is parallel to the device front-rear direction.

In the coupling body 36, at the respective lower sides of the bent portions at the front and rear of the unit right support section 36C, an angle profiled case right front support section 36CX and an angle profiled case right rear support section 36CY of a specific length are provided like extensions of the bent portions so as to project toward the lower side.

A substantially rectangular shaped coupling hole (referred to below as a reject box coupling hole) that is long in the left-right direction is provided piercing through the safe top plate 26A of the safe casing 26 so as to correspond to the reject box conveying section 28A of the reject box 28.

Plural substantially rectangular shaped coupling holes (also referred to below as storage box coupling holes) that are long in the left-right direction are provided piercing through the safe top plate 26A of the safe casing 26 so as to correspond to the storage box conveying sections 29A to 33A of the plural banknote storage boxes 29 to 33.

In the safe top plate 26A of the safe casing 26, a left front insertion hole and a left rear insertion hole are provided at the left front end portion and the left rear end portion, together with a right front insertion hole and a right rear insertion hole provided at the right front end portion and the right rear end portion.

In the coupling body 36, a rectangular shaped attachment hole (also referred to below as a reject safe attachment hole) that is long in the left-right direction is provided at the attachment section 36A so as to correspond to the reject box coupling hole of the safe top plate 26A.

In the coupling body 36, plural rectangular shaped attachment holes (also referred to below as storage box attachment holes) that are long in the left-right direction are provided at the attachment section 36A so as to correspond to the plural storage box coupling holes other than the one storage box coupling hole furthest to the rear of the safe top plate 26A.

In the coupling body 36, a single attachment cutout portion (also referred to below as a storage box attachment cutout portion) is formed to the attachment section 36A so as to correspond to the one storage box coupling hole furthest to the rear in the safe top plate 26A.

The coupling body 36 is thereby attached to the safe top plate 26A of the safe casing 26 such that the case left front support section 36BX and the case left rear support section are inserted into the left front insertion hole and the left rear insertion hole, and the case right front support section 36CX and the case right rear support section 36CY are inserted into the right front insertion hole and the right rear insertion hole, and such that the lower face of the attachment section 36A makes contact with the safe top plate 26A.

Thereby, in coupling section 35, the reject box attachment hole, the plural storage box attachment holes, and the storage box attachment cutout portion of the coupling body 36, face towards the reject box coupling hole and the plural storage box coupling holes of the safe top plate 26A, respectively.

In the coupling section 35, leading end portions of the case left front support section 36BX, the case left rear support section, the case right front support section 36CX, and the case right rear support section 36CY of the coupling body 36 are inserted into the safe casing 26.

The coupling section 35 includes plural handover sections 39 to 44 for passing banknotes between the switching conveying path 14A and the rear-side conveying path 18A, and the take-in conveying path 28AX and the plural take-in/feed-out conveying paths 29AX to 33AX.

In the coupling section 35, the plural handover sections 39 to 44 are attached to the coupling body 36 so as to be inserted through the corresponding reject box attachment hole, plural storage box attachment hole, or storage box attachment cutout portion, into each respective reject box coupling hole or plural storage box coupling hole of the safe top plate 26A.

The plural handover sections 39 to 44 each respectively include various handover path forming components, such as plural handover guides and plural handover rollers.

The handover section 39 inserted into the reject box coupling hole of the safe top plate 26A is formed with a handover path (also referred to below as a unidirectional handover path) 39A (FIG. 2) for conveying reject banknotes using the various handover path forming components in one direction, so as to handover the reject banknotes from the switching conveying path 14A to the facing take-in conveying path 28AX of the reject box 28.

An upper end portion of the unidirectional handover path 39A is connected to a lower end portion of the connection branch portion facing the switching conveying path 14A.

A lower end portion of the unidirectional handover path 39A faces and, is connected to, the upper end portion of the take-in conveying path 28AX of the reject box 28.

In the following explanation, the handover section 39 that is provided to the coupling section 35 and forms the unidirectional handover path 39A is also referred to as the unidirectional handover section 39.

A handover section 40 that has been inserted into the single storage box coupling hole furthest to the front of the safe top plate 26A is formed with handover path 40A (FIG. 2) that uses various handover path forming components to convey banknotes in both directions so as to hand over banknotes from the switching conveying path 14A to the take-in/feed-out conveying path 29AX of the facing banknote storage box 29, and to handover banknotes from the take-in/feed-out conveying path 29AX to the switching conveying path 14A.

An upper end portion the handover path 40A is connected to a lower end portion of the connection branch portion that faces the switching conveying path 14A. A lower end portion of the handover path 40A faces, and is connected to, an upper end portion of the take-in/feed-out conveying path 29AX of the banknote storage box 29.

Plural handover sections 41 to 44 that have been inserted into the plural other storage box coupling holes of the safe top plate 26A are formed with handover paths 41A to 44A (FIG. 2) that use various respective handover path forming components to convey banknotes in both directions so as to hand over banknotes from the rear-side conveying path 18A to the take-in/feed-out conveying paths 30AX to 33AX of the facing banknote storage boxes 30 to 33, and to handover banknotes from the take-in/feed-out conveying paths 30AX to 33AX to the rear-side conveying path 18A.

Upper end portions of the plural handover paths 41A to 44A are connected to lower end portions of the connection branch portions that face the rear-side conveying path 18A.

Respective lower end portions of the plural handover paths 41A to 44A face, and are connected to, upper end portions of the take-in/feed-out conveying paths 30AX to 33AX of the banknote storage boxes 30 to 33.

In the following explanation, the plural handover sections 40 to 44 provided to the coupling section 35 that convey banknotes in both directions for handover are also referred to as bidirectional handover sections 40 to 44, respectively.

Moreover, in the following explanation, the handover paths 40A to 44A formed by the plural bidirectional handover sections 40 to 44 for conveying banknotes for handover in both directions are also referred to as bidirectional handover paths 40A to 44A, respectively.

The switching conveying section 14 and the rear-side conveying section 18 that are provided to the upper unit 10, for conveying reject banknotes and pay-in/pay-out banknotes for collecting in the reject box 28 and the plural banknote storage boxes 29 to 33 inside the safe casing 26, are accordingly coupled by the coupling section 35 to the reject box conveying section 28A and the plural storage box conveying sections 29A to 33A of the reject box 28 and the plural banknote storage boxes 29 to 33, using the unidirectional handover section 39 and the plural bidirectional handover sections 40 to 44.

Figure 4:
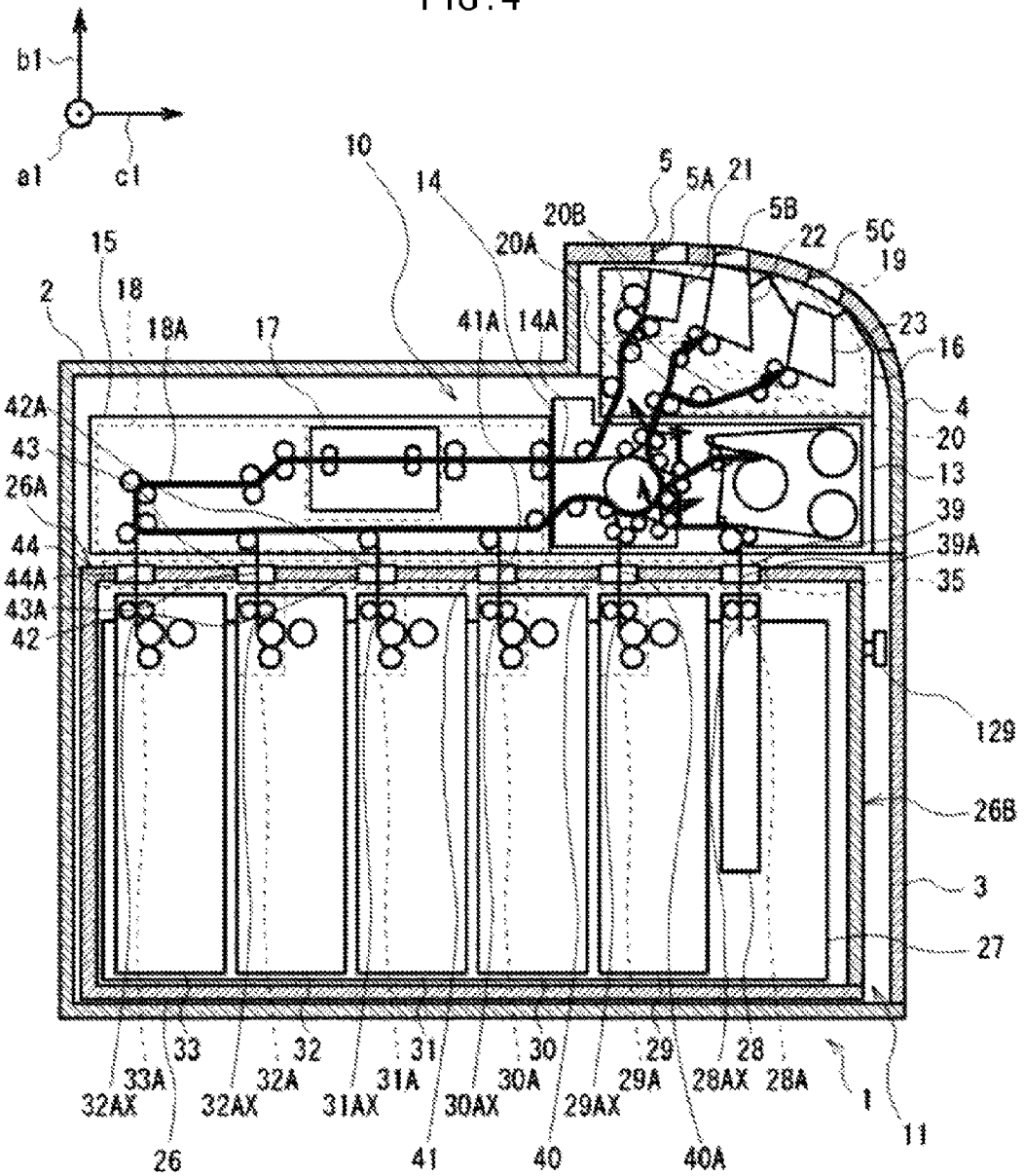
FIG. 4 is a schematic side view to accompany explanation of pay-in processing (1) by a banknote processing device.

Thus, as illustrated in FIG. 4, during pay-in, when one or plural banknotes for pay-in have been inserted into the banknote insertion port 5A by a cashier or customer, the controller receives the banknotes for pay-in using the banknote receiving section 21, and feeds the banknotes out from the banknote receiving section 21 one note at a time.

The controller then conveys the banknotes fed out from the banknote receiving section 21 one note at a time to the classification section 17 in sequence via the upper-side feed-out conveying path 20A, the switching conveying path 14A, and the rear-side conveying path 18A, and classifies the banknotes by denomination, state, and the like in the classification section 17.

As a result, for banknotes classified as normal that have been fed out from the classification section 17, the controller conveys the banknotes in sequence via the rear-side conveying path 18A and the switching conveying path 14A, to the temporary holding section 13, and delays pay-in of these banknotes by temporarily holding them.

For banknotes classified as abnormal due to damage or folding or the like that have been fed out from the classification section 17, the controller conveys the banknotes as reject banknotes in sequence via the rear-side conveying path 18A, the switching conveying path 14A, and the upper-side take-in conveying path 20B, to one of the two banknote delivery sections 22, 23.

The controller thereby returns the reject banknotes so as to be taken out by the cashier or customer from the banknote delivery sections 22, 23 through one of the two banknote pay-out ports 5B, 5C.

Figure 5:
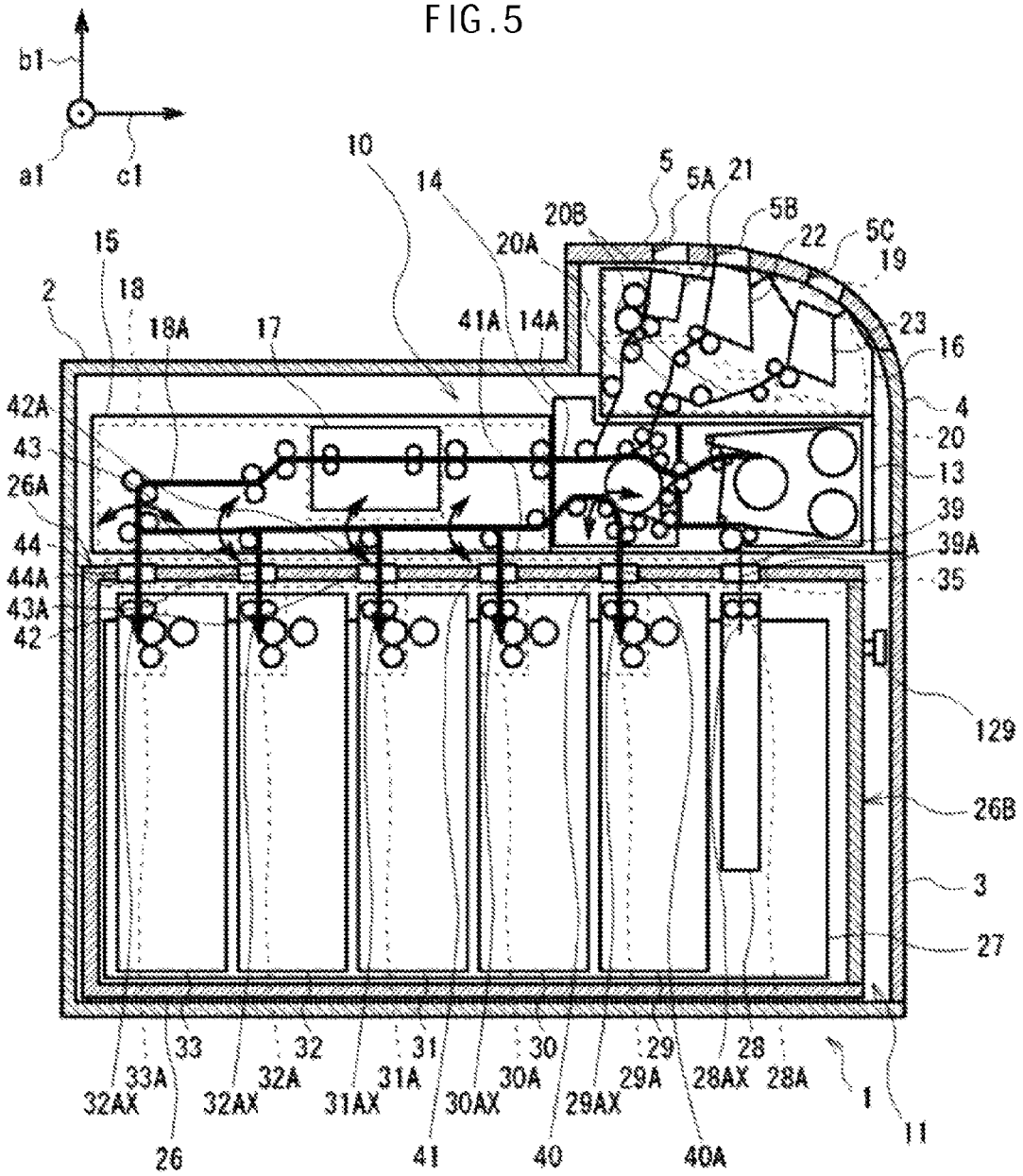
FIG. 5 is a schematic side view to accompany explanation of pay-in processing (2) by a banknote processing device.

As illustrated in FIG. 5, when all of the banknotes for pay-in inserted through the banknote insertion port 5A have been classified in the classification section 17, the controller notifies the cashier or customer using the display section 6 of the total amount of the banknotes classified as normal (namely, the pay in amount).

As a result, when pay-in of the banknotes is instructed, using the operation section 7, by the cashier or customer who has confirmed the pay in amount, the controller feeds the temporarily held banknotes out from the temporary holding section 13 one note at a time.

The controller also conveys the banknotes fed out from the temporary holding section 13 one note at a time in sequence via the switching conveying path 14A and the rear-side conveying path 18A to the classification section 17, and re-classifies the banknotes according to denomination, state, and the like in the classification section 17.

For banknotes classified as normal that have been fed out from the classification section 17, the controller conveys the banknotes in sequence via the rear-side conveying path 18A and the bidirectional handover paths 41A to 44A, or in sequence via the rear-side conveying path 18A, the switching conveying path 14A, and the bidirectional handover path 40A, to the banknote storage box 29 to 33 that corresponds to the denomination of the banknote.

The controller thereby takes in the banknotes through the take-in/feed-out conveying paths 29AX to 33AX in the banknote storage boxes 29 to 33, so as to store the banknotes inside the banknote storage boxes 29 to 33.

However, when doing so, for banknotes classified as abnormal that have been fed out from the classification section 17, the controller conveys the banknotes as reject banknotes to the reject box 28, in sequence via the rear-side conveying path 18A, the switching conveying path 14A, and the unidirectional handover path 39A.

The controller thereby causes the reject banknotes to be taken into the reject box 28 through the take-in conveying path 28AX, and stored such that the reject banknotes are not used in subsequent pay-out processing.

The controller is thereby able to execute pay-in processing in the upper unit 10 and the lower unit 11 so as to pay in the banknotes.

Figure 6:
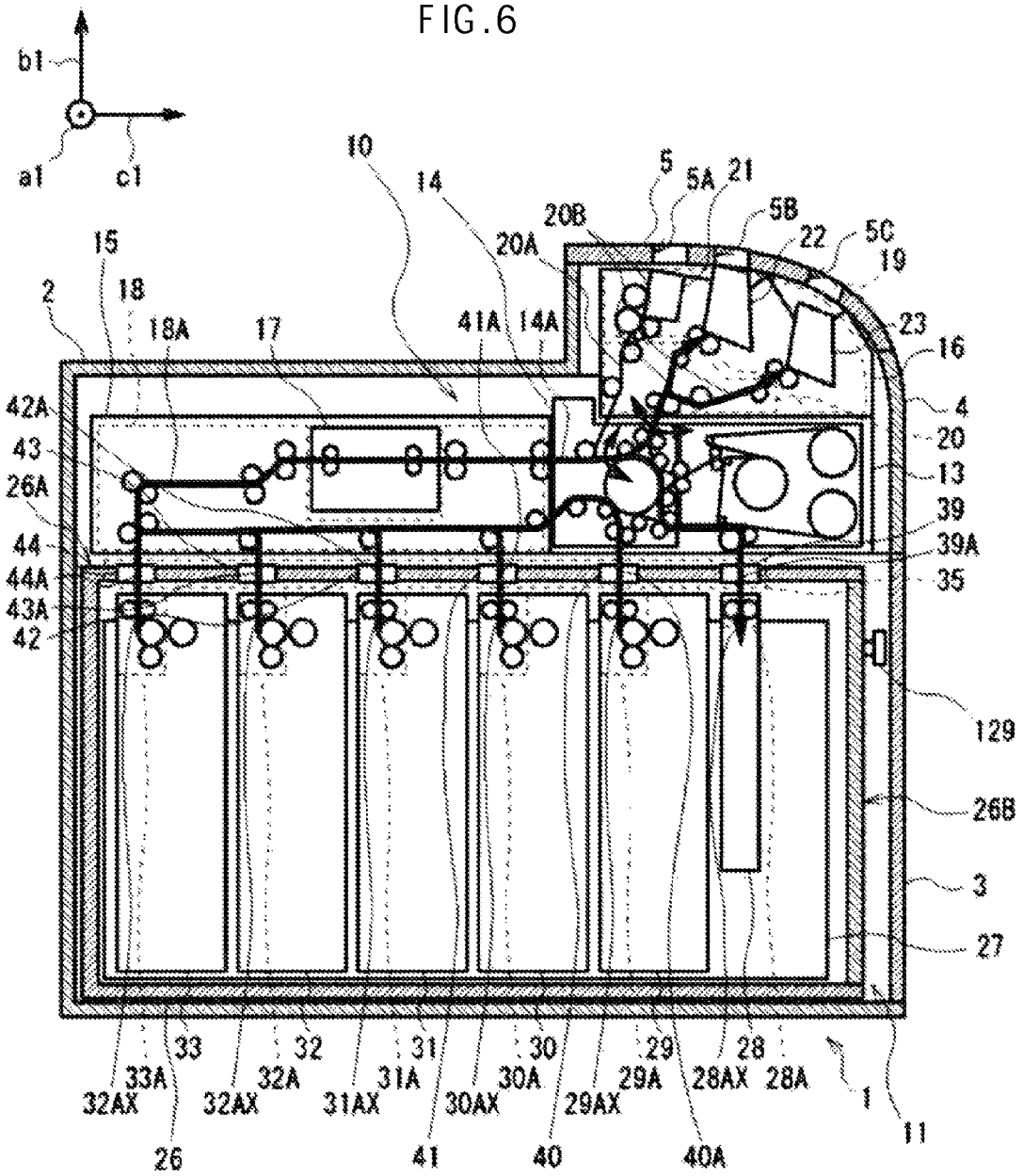
FIG. 6 is a schematic side view to accompany explanation of pay-out processing by a banknote processing device.

However, as illustrated in FIG. 6, when a pay-out amount has been specified by the cashier or customer during pay-out, using the operation section 7, the controller feeds out banknotes of the amount specified by the cashier or customer from inside the banknote storage boxes 29 to 33, through the take-in/feed-out conveying paths 29AX to 33AX, one note at a time.

The controller also conveys the banknotes fed out one note at a time from the banknote storage boxes 29 to 33, in sequence via the bidirectional handover path 40A, the switching conveying path 14A, and the rear-side conveying path 18A, or in sequence via the bidirectional handover paths 41A to 44A and the rear-side conveying path 18A, to the classification section 17, and classifies the denomination, state, and the like of the banknotes in the classification section 17.

As a result, for banknotes classified as normal that have been fed out from the classification section 17, the controller conveys the banknotes in sequence via the rear-side conveying path 18A, the switching conveying path 14A, and the upper-side take-in conveying path 20B, to one of the two banknote delivery sections 22, 23.

However, for banknotes classified as abnormal that have been fed out from the classification section 17, the controller conveys the banknotes as reject banknotes in sequence via the rear-side conveying path 18A, the switching conveying path 14A, and the unidirectional handover path 39A, to the reject box 28.

The controller thereby causes the reject banknotes to be taken into the reject box 28 through the take-in conveying path 28AX, and stored such that the reject banknotes are not employed in subsequent pay-out processing.

When conveying of the banknotes of the amount specified for pay-out has been completed, the controller hands over to the banknote delivery sections 22, 23 banknotes of the amount specified for pay-out, so as to be taken out by the cashier or customer from the banknote delivery sections 22, 23 through the banknote pay-out ports 5B, 5C.

The controller is thereby able to execute pay-out processing in the upper unit 10 and the lower unit 11, so as to pay out the banknotes.

In the banknote processing device 1, conveying is performed through the switching conveying path 14A, the rear-side conveying path 18A, the upper-side feed-out conveying path 20A, and the upper-side take-in conveying path 20B, with the conveying orientation of the rectangular banknotes, for example, such that one short side is placed on the left side, the other short side is place on the right side (namely, with the length direction of the banknotes substantially parallel to the device left-right direction), and with one long side facing toward the conveying direction.

In the following explanation, the length direction of the banknotes is also referred to as the banknote length direction, and the short direction of the banknotes is also referred to as the banknote short direction.

In the banknote processing device 1, the rectangular banknotes are similarly conveyed through the unidirectional handover path 39A, the plural bidirectional handover paths 40A to 44A, the take-in conveying path 28AX, and the plural take-in/feed-out conveying paths 29AX to 33AX, with a conveying orientation of one long side facing toward the conveying direction.

Thus in the banknote processing device 1, during the above pay-in and pay-out, the banknotes are handled by the temporary holding section 13, the classification section 17, the banknote receiving section 21, the banknote delivery sections 22, 23, the reject box 28, and the plural banknote storage boxes 29 to 33 in the orientation in which the one short side is positioned on the left side and the other short side is positioned on the right side (namely, with the length direction of the banknotes substantially parallel to the device left-right direction).

At a front end portion of the safe casing 26, facing the device door 3 that is provided to the device casing 2 so as to be capable of opening and closing, a rectangular shaped door made from comparatively thick metal plate (also referred to below as a safe door) 26B is provided, so as to be capable of opening and closing using a non-illustrated hinge.

Namely, in the safe casing 26, from out of the plural metal plates forming the safe casing 26, the metal plate that forms the front plate is provided as the safe door 26B, and is capable of opening and closing.

The safe door 26B is provided in the safe casing 26 so as to be capable of opening and closing in the same direction as the opening and closing direction of the device door 3 with respect to the device casing 2 (for example, with both the safe door 26B and the device door 3 opening on the left).

Figure 7:
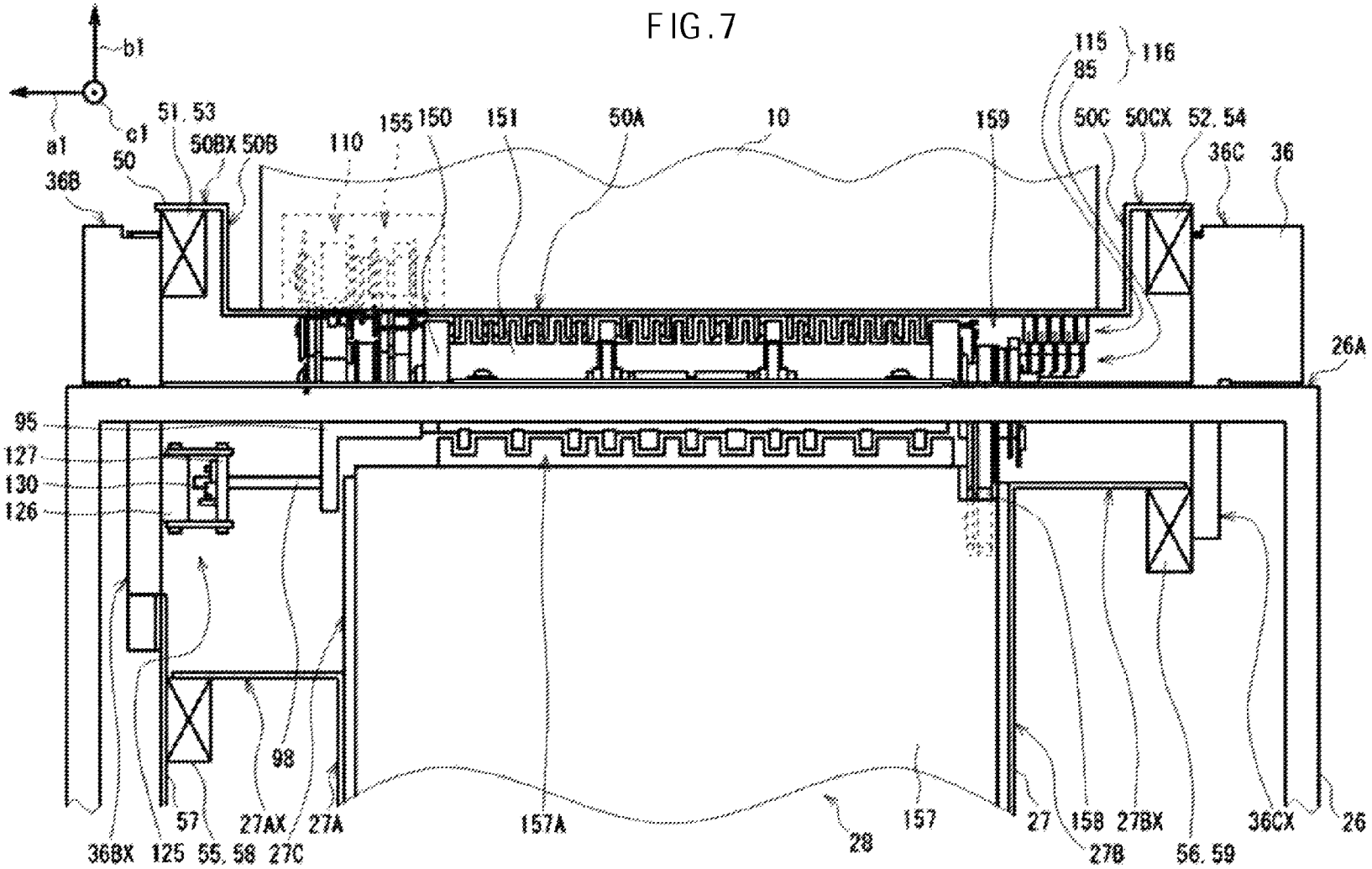
FIG. 7 is a schematic front view to accompany explanation of support by a coupling section of an upper unit and a storage box loading case.

Moreover, as illustrated in FIG. 7, the upper unit 10 includes a unit mounting section 50. The unit mounting section 50 includes a rectangular shaped bottom plate 50A that is long in the front-rear direction, and at the left edge and the right edge of the bottom plate 50A includes a left-side plate 50B and a right-side plate 50C, which are each long-thin-rectangle shaped and long in the front-rear direction, provided perpendicular to the bottom plate 50A.

The unit mounting section 50 is provided at the upper edge of the left-side plate 50B with a left rail placement plate 50BX, which is long-thin-rectangle shaped and long the front-rear direction, provided so as to jut out to the left side.

The unit mounting section 50 is also provided at the upper edge of the right-side plate 50C with a right rail placement plate 50CX, which is long-thin-rectangle shaped and long in the front-rear direction, provided so as to jut out to the right side.

The upper unit 10 is mounted onto the bottom plate 50A of the unit mounting section 50. In the unit mounting section 50, an upper-left slide rail 51 is disposed along the bottom face of the left rail placement plate 50BX, with the length direction of the upper-left slide rail 51 running parallel to the device front-rear direction.

Moreover, in the unit mounting section 50, an upper-right slide rail 52 is disposed along the bottom face of the right rail placement plate 50CX, with the length direction of the upper-right slide rail 52 running parallel to the device front-rear direction.

In the coupling body 36 of the coupling section 35, a left upper rail guide 53 is disposed from an upper edge of a central portion of the unit left support section 36B, with the length direction of the left upper rail guide 53 running parallel to the device front-rear direction.

In the coupling body 36, a right upper rail guide 54 is disposed from an upper edge of a central portion of the unit right support section 36C, with the length direction of the right upper rail guide 54 running parallel to the device front-rear direction.

In the unit mounting section 50, the upper-left slide rail 51 and the upper-right slide rail 52 engage with the left upper rail guide 53 and the right upper rail guide 54 of the coupling body 36.

The coupling section 35 thereby supports the upper unit 10 so as to be capable of moving in the device front direction and the device rear direction, through the left upper rail guide 53 and the right upper rail guide 54, and through the upper-left slide rail 51 and the upper-right slide rail 52.

The storage box loading case 27 is, for example, formed with a left-side plate 27A that is lower in height than a right-side plate 27B, a rear plate 27C, and a front plate (not illustrated in the drawings).

The storage box loading case 27 is, for example, formed with a right-side plate 27B, a rear plate 27C, and a front plate that are of equivalent heights, but are slightly lower in height than the reject box 28 and the plural banknote storage boxes 29 to 33.

In the storage box loading case 27, a left rail placement plate 27AX, which is long-thin-rectangle shaped and long the front-rear direction, is provided at an upper edge of the left-side plate 27A so as to jut out to the left side.

In the storage box loading case 27, a right rail placement plate 27BX, which is long-thin-rectangle shaped and long the front-rear direction, is also provided at an upper edge of the right-side plate 27B so as to jut out to the right side.

In the storage box loading case 27, a left lower slide rail 55 is disposed along the lower face of the left rail placement plate 27AX, with its length direction running parallel to the device front-rear direction.

In the storage box loading case 27, a right lower slide rail 56 is disposed along the lower face of the right rail placement plate 27BX, with its length direction running parallel to the device front-rear direction.

In the coupling body 36, a guide support plate 57 that is long in the front-rear direction is attached to the case left front support section 36BX and to the case left rear support section.

In the coupling body 36, a left lower rail guide 58 is disposed at a specific position on the right face of a guide support plate 57 such that the length direction of the left lower rail guide 58 runs parallel to the device front-rear direction.

In the coupling body 36, a right lower rail guide 59 is disposed facing the left side of the right front support section 36CX and the case right rear support section 36CY with the length direction of the right lower rail guide 59 running parallel to the device front-rear direction.

The left lower slide rail 55 and the right lower slide rail 56 in the storage box loading case 27, engage with the left lower rail guide 58 and the right lower rail guide 59 of the coupling body 36.

The coupling section 35 is thereby supported by the storage box loading case 27 so as to be capable of moving in the device front direction and the device rear direction, through the left lower rail guide 58 and the right lower rail guide 59, and through the left lower slide rail 55 and the right lower slide rail 56.

Figure 8:
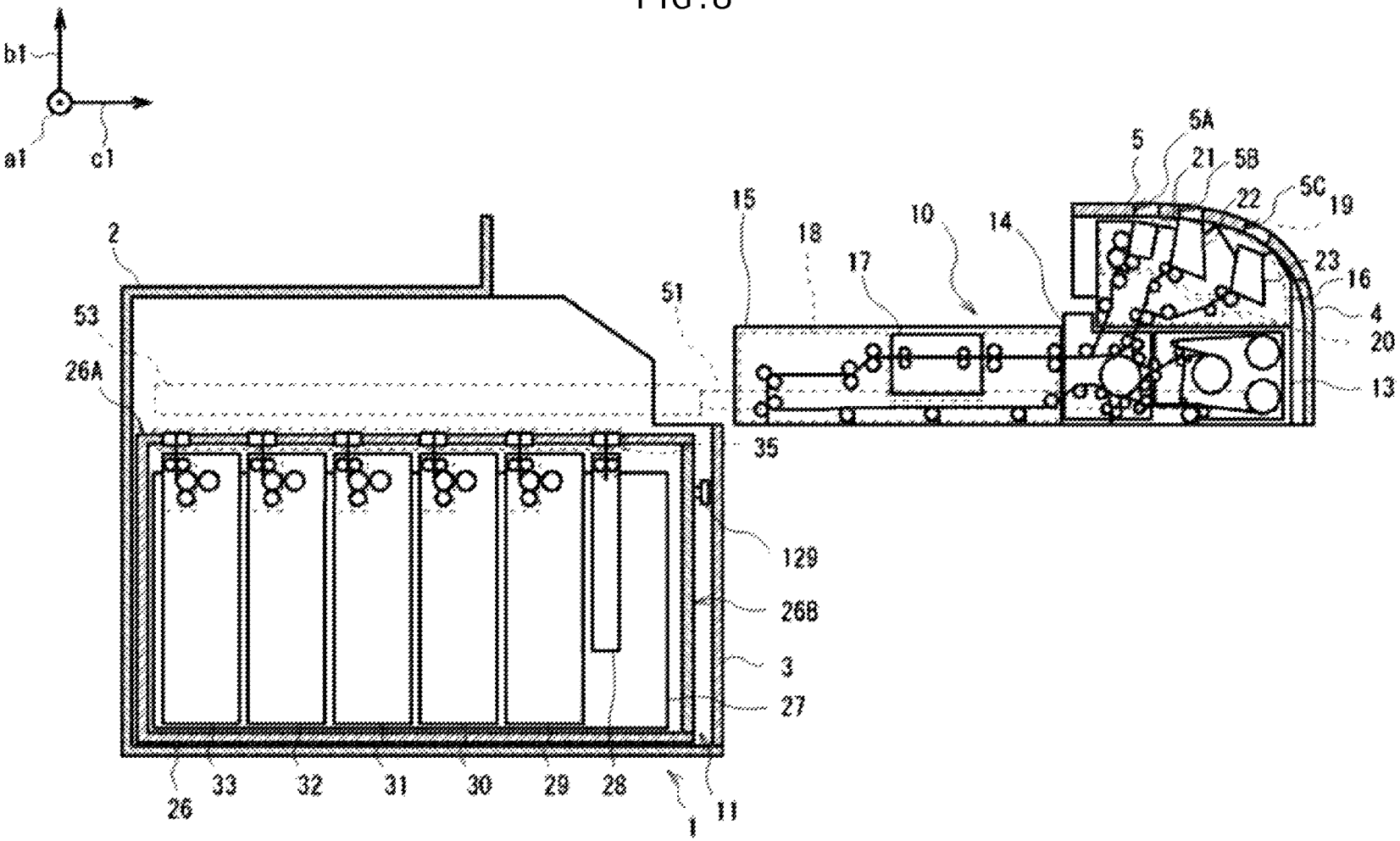
FIG. 8 is a schematic side view to accompany explanation of pulling out, and stowing, of an upper unit with respect to a device casing.

As illustrated in FIG. 8, in the device casing 2, the upper unit 10 is capable of being pulled out from inside the device casing 2 to the front side of the device casing 2 by an operator.

The device casing 2 thereby enables maintenance of the upper unit 10 to be performed outside (to the front side of) the device casing 2.

The upper unit 10 that has been pulled out to the front side of the device casing 2 can then be pushed in by an operator, so as to be stowed in the device casing 2.

Namely, the device casing 2 enables the upper unit 10 to be pushed in to a position where the front face of the unit cover 4 and the front face of the device door 3 are in the same plane as each other, and a portion at the upper side of an opening 2AX is closed off by the unit cover 4 so as to stow the upper unit 10 (namely, the rear side of the upper unit 10).

Figure 9:
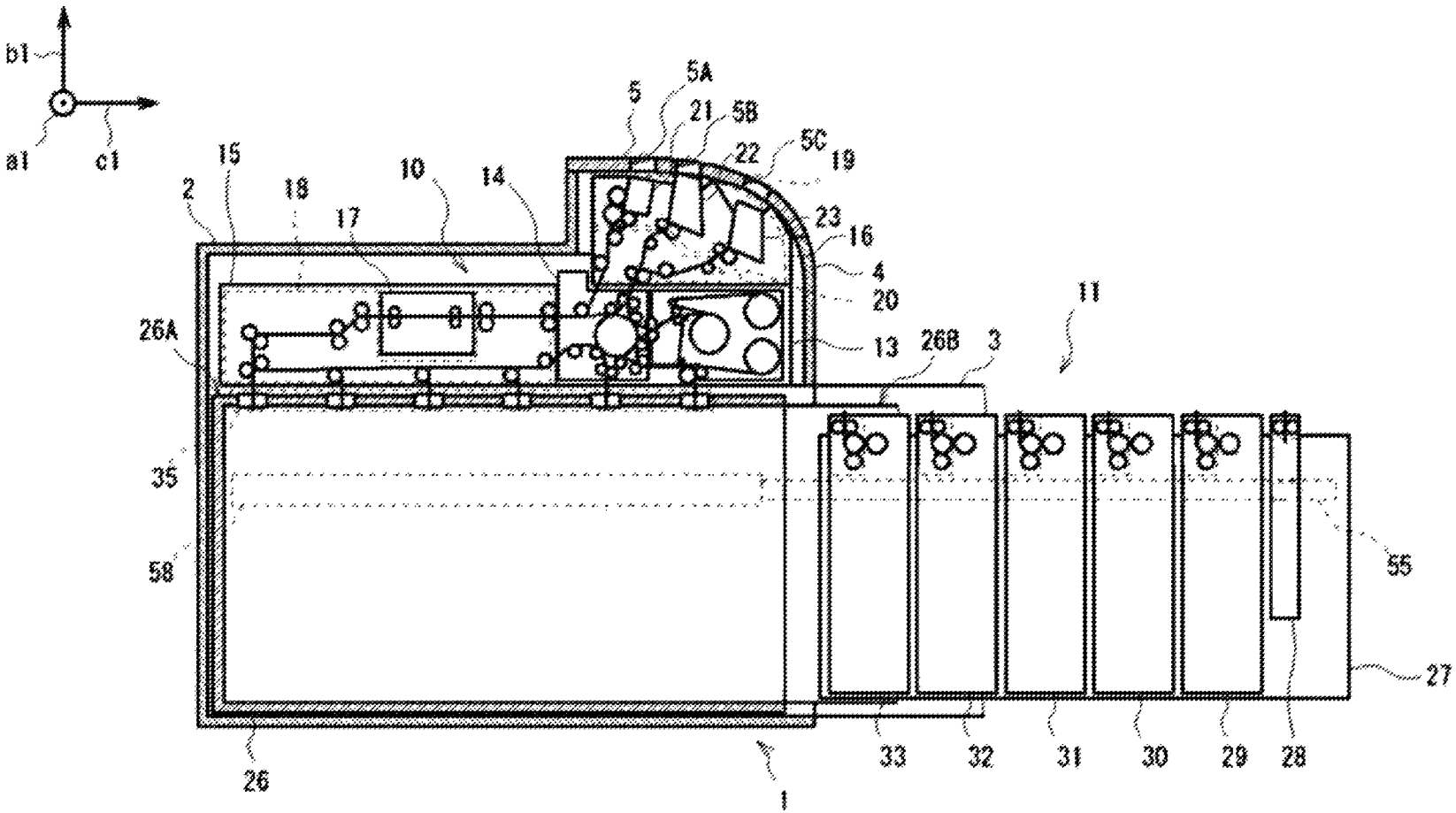
FIG. 9 is a schematic side view to accompany explanation of pulling out, and stowing, of a storage box loading case with respect to a safe casing.

As illustrated in FIG. 9, in the device casing 2, the storage box loading case 27 can be pulled out from inside the safe casing 26 to the front side of the device casing 2, by an operator opening the device door 3 and also opening the safe door 26B.

Thus the device casing 2 enables the reject box 28 to be pulled out from the storage box loading case 27, and the reject banknotes collected and the reject box 28 to be loaded into the space of the storage box loading case 27, while the reject box 28 is outside the safe casing 26 (at the front side of the device casing 2).

Thus in the device casing 2, for example, any of the banknote storage boxes 29 to 33 in which the numbers of stored banknotes has decreased to a specific number of banknotes or less, or have become empty, can be taken out of the storage box loading case 27 that is outside the safe casing 26 (to the front side of the device casing 2), and the banknote storage boxes 29 to 33 that have been replenished with plural banknotes can be loaded into the storage box loading case 27.

The device casing 2 enables an operator to push the storage box loading case 27, which has been pulled out to the front side, into the safe casing 26 and stow the storage box loading case 27, and to then close the safe door 26B and the device door in sequence.

In the coupling section 35, in the unidirectional handover section 39 and the plural bidirectional handover sections 40 to 44, the conveying path connection portions to the switching conveying section 14 and the rear-side conveying section 18 project out to the upper-side of the safe top plate 26A.

In the unidirectional handover section 39, the conveying path connection portion to the switching conveying section 14 is a portion that forms an upper end portion of the unidirectional handover path 39A.

In the plural bidirectional handover sections 40 to 44, the conveying path connection portions to the switching conveying section 14 and the rear-side conveying section 18 are portions that form respective upper end portions of the bidirectional handover paths 40A to 44A.

There are, for example, holes pierced through the bottom plate 50A of the unit mounting section 50 so as to correspond to the plural conveying path connection portions, to the unidirectional handover section 39 and the plural bidirectional handover sections 40 to 44, in the switching conveying section 14 and the rear-side conveying section 18.

Thus in the unit mounting section 50, the plural conveying path connection portions of the switching conveying section 14 and the rear-side conveying section 18 project out to the lower side from the plural holes in the bottom plate 50A.

In the switching conveying section 14, the conveying path connection portion to the unidirectional handover section 39 is a portion forming the lower end portion of the connection branch portion corresponding to the unidirectional handover path 39A in the switching conveying path 14A.

In the switching conveying section 14, the conveying path connection portion to the bidirectional handover section 40 is a portion forming the lower end portion of the connection branch portion corresponding to the bidirectional handover path 40A in the switching conveying path 14A.

Moreover, in the rear-side conveying section 18, the plural conveying path connection portions to the plural bidirectional handover sections 41 to 44 are portions forming the respective lower end portions of the connection branch portions corresponding to the bidirectional handover paths 41A to 44A in the rear-side conveying path 18A.

In the stowed state of the upper unit 10, the device casing 2 positions the conveying path connection portions corresponding to the switching conveying section 14 and the rear-side conveying section 18 above the unidirectional handover section 39 and the plural bidirectional handover sections 40 to 44.

The coupling section 35 is thereby able to connect the upper end portion of the unidirectional handover path 39A and the upper end portions of the plural bidirectional handover paths 40A to 44A with the lower end portions of the connection branch portions corresponding to the switching conveying path 14A and the rear-side conveying path 18A, respectively.

In the device casing 2, when the upper unit 10 is pulled out from inside the device casing 2, the switching conveying section 14 and the rear-side conveying section 18 are moved to the front side, from above the unidirectional handover section 39 and the plural bidirectional handover sections 40 to 44.

Thus when the upper unit 10 has been pulled out from inside the device casing 2, the coupling section 35 is able to separate all of the lower end portions of the connection branch portions corresponding to the switching conveying path 14A and the rear-side conveying path 18A from the upper end portion of the unidirectional handover path 39A and the upper end portions of the plural bidirectional handover paths 40A to 44A.

In the device casing 2, when the upper unit 10 is stowed inside the device casing 2, the conveying path connection portions corresponding to the switching conveying section 14 and the rear-side conveying section 18 are once again positioned above the unidirectional handover section 39 and the plural bidirectional handover sections 40 to 44.

The coupling section 35 is thereby able to once again connect the upper end portion of the unidirectional handover path 39A and the upper end portions of the plural bidirectional handover paths 40A to 44A to the respective lower end portions of the connection branch portions corresponding to the switching conveying path 14A and the rear-side conveying path 18A.

In the coupling section 35, the conveying path connection portions to the reject box conveying section 28A and the plural storage box conveying sections 29A to 33A at the unidirectional handover section 39 and the plural bidirectional handover sections 40 to 44 project out to the lower side of the safe top plate 26A (namely to inside the safe casing 26).

In the unidirectional handover section 39, the conveying path connection portion to the reject box conveying section 28A is a portion formed at the lower end portion of the unidirectional handover path 39A.

In the plural bidirectional handover sections 40 to 44, the conveying path connection portions to the plural storage box conveying sections 29A to 33A are portions forming the lower end portions of the respective bidirectional handover paths 40A to 44A.

In the storage box loading case 27, the upper end portion of the loaded reject box 28, together with the conveying path connection portion to the unidirectional handover section 39 at the reject box conveying section 28A, project out further to the upper-side than the upper ends of the right-side plate 27B, the rear plate 27C, and the front plate.

Moreover, in the storage box loading case 27, the upper end portions of the plural loaded banknote storage boxes 29 to 33, together with the conveying path connection portions to the plural bidirectional handover sections 40 to 44 in the plural storage box conveying sections 29A to 33A, project out further to the upper-side than the upper ends of the right-side plate 27B, the rear plate 27C, and the front plate.

In the reject box conveying section 28A, the conveying path connection portion to the unidirectional handover section 39 is a portion forming an upper end portion of the take-in conveying path 28AX.

Moreover, in the plural storage box conveying sections 29A to 33A, the plural conveying path connection portions to the plural bidirectional handover sections 40 to 44 are portions forming the upper end portions of the respective take-in/feed-out conveying paths 29AX to 33AX.

In the device casing 2, in a state in which the storage box loading case 27 is stowed in the safe casing 26, the corresponding conveying path connection portion to the reject box conveying section 28A, and the corresponding conveying path connection portions to the plural storage box conveying sections 29A to 33A, are positioned below the unidirectional handover section 39 and the plural bidirectional handover sections 40 to 44.

The coupling section 35 is accordingly capable of connecting the lower end portion of the unidirectional handover path 39A and the lower end portions of the plural bidirectional handover paths 40A to 44A to the corresponding upper end portion of the take-in conveying path 28AX and the upper end portions of the plural take-in/feed-out conveying paths 29AX to 33AX.

Moreover, in the storage box loading case 27, as described above, the height of the right-side plate 27B and the rear plate 27C is set lower than the height of the reject box 28 and of the plural banknote storage boxes 29 to 33.

Thus the storage box loading case 27 is capable of being pulled out from inside the safe casing 26, without either the right-side plate 27B or the rear plate 27C catching on the coupling section 35.

In the device casing 2, when the storage box loading case 27 is being pulled out from inside the safe casing 26, the reject box 28 and the plural banknote storage boxes 29 to 33 move toward the front side from under the unidirectional handover section 39 and the plural bidirectional handover sections 40 to 44.

Thus when the storage box loading case 27 has been pulled out from inside the safe casing 26, the coupling section 35 is able to separate all of the corresponding upper end portion of the take-in conveying path 28AX and the upper end portions of the plural take-in/feed-out conveying paths 29AX to 33AX, from the lower end portion of the unidirectional handover path 39A and the lower end portions of the plural bidirectional handover paths 40A to 44A.

Moreover, in the device casing 2, when the storage box loading case 27 is then stowed inside the safe casing 26, the conveying path connection portion of the reject box conveying section 28A and the conveying path connection portions of the plural storage box conveying sections 29A to 33A once again become positioned below the corresponding unidirectional handover section 39 and the plural bidirectional handover sections 40 to 44.

Thus when the storage box loading case 27 has been stored inside the safe casing 26, the coupling section 35 is able to re-connect the lower end portion of the unidirectional handover path 39A and the lower end portions of the plural bidirectional handover paths 40A to 44A to the corresponding upper end portion of the take-in conveying path 28AX and the upper end portions of the plural take-in/feed-out conveying paths 29AX to 33AX.

The banknote processing device 1 is factory assembled by positioning the upper unit 10 and the plural bidirectional handover sections 40 to 44, the unidirectional handover section 39, and the storage box loading case 27, such that there is a straight line connection along the device downward direction, from the lower end portions of the plural connection branch portions to the switching conveying path 14A and the rear-side conveying path 18A, through the corresponding unidirectional handover path 39A and the plural bidirectional handover sections 40 to 44, to the upper end portion of the take-in conveying path 28AX and the upper end portions of the plural take-in/feed-out conveying paths 29AX to 33AX.

Moreover, after factory assembly, the banknote processing device 1 is installed and used in branches of financial institutions within Japan or oversees.

When there is a fault in the upper unit 10 or the storage box loading case 27 in the banknote processing device 1 during use at the installation location, the faulty upper unit 10 or storage box loading case 27 is replaced at the installation location with a new one by a local operator.

Moreover, when the faulty upper unit 10 or storage box loading case 27 has been replaced in the banknote processing device 1, the position of the upper unit 10 and the storage box loading case 27 is re-adjusted after replacement.

In the banknote processing device 1, as described above, the upper unit 10 and the storage box loading case 27 are both supported by the coupling body 36 that is fixed to the safe top plate 26A of the safe casing 26.

In the banknote processing device 1, the upper unit 10 and the storage box loading case 27 are formed with high precision rail guides and slide rails (namely the left upper rail guide 53 and the upper-left slide rail 51, etc.) which are interposed between themselves and the coupling body 36.

Thus in the banknote processing device 1, when the upper unit 10 or the storage box loading case 27 is replaced at the installation location, the local operator is able to easily and precisely adjust the position of the upper unit 10 or the storage box loading case 27 with respect to the device left-right direction and the device up-down direction.

However, in the banknote processing device 1, there is a requirement to adjust the position of the upper unit 10 or the storage box loading case 27 with respect to the device front-rear direction so as to meet the requirements of the respective unidirectional handover section 39 and the plural bidirectional handover sections 40 to 44, and such an adjustment operation would have been bothersome.

Thus in the banknote processing device 1, when the upper unit 10 or the storage box loading case 27 has been replaced at the installation location, there would have been a possibility that the local operator may not be able to adjust the position of the upper unit 10 or the storage box loading case 27 with respect to the device front-rear direction with the same high precision as during assembly.

Namely, in the banknote processing device 1, even if the position of the upper unit 10 or the storage box loading case 27 is adjusted after replacement at the installation location by the local operator in the device front-rear direction, there would have been a possibility that there may still be a slight misalignment of the position after adjustment from the position in the device front-rear direction at assembly.

Moreover, if, for example, the banknote processing device 1 is installed on a floor with a slight slope in a branch of a financial institution, sometimes there is misalignment of the positions of the upper unit 10 and the storage box loading case 27 in the device front-rear direction with respect to the positions at assembly.

In such cases too, the banknote processing device 1, for example, the position of the upper unit 10 and the storage box loading case 27 may be re-adjusted with respect to the device front-rear direction by a local operator at the installation location.

However in the banknote processing device 1, similarly to when replacement due to a fault, as described above, there is still a possibility that a slight misalignment of the position of the upper unit 10 and the storage box loading case 27 might still occur after adjustment, from the position in the device front-rear direction at assembly.

Thus in the banknote processing device 1, the unidirectional handover section 39 and the plural bidirectional handover sections 40 to 44 of the coupling section 35 are configured such that the unidirectional handover path 39A and the bidirectional handover paths 40A to 44A are connectable to the lower end portions of the corresponding connection branch portions of the switching conveying path 14A and the rear-side conveying path 18A, and to the upper end portion of the take-in conveying path 28AX and the upper end portions of the plural take-in/feed-out conveying paths 29AX to 33AX, even if there is a slight misalignment of the position of the upper unit 10 and the storage box loading case 27 from the position in the device front-rear direction at assembly.

(1-3) Configuration of Coupling Section

Explanation next follows regarding a configuration of the coupling section 35. In the coupling section 35, as illustrated in FIG. 3 and FIG. 7 and as described above, the unidirectional handover section 39 and the plural bidirectional handover sections 40 to 44 are attached to the coupling body 36 in sequence along the device rear direction.

In this example, the plural bidirectional handover sections 40 to 44 are configured with fundamentally the same configuration as each other. However, the single bidirectional handover section 40 positioned furthest to the front, and the single bidirectional handover section 44 positioned furthest to the rear, from out of the plural bidirectional handover sections 40 to 44, are configured without some of the components compared to the other plural bidirectional handover sections 41 to 43.

A specific explanation accordingly follows regarding configuration of the single bidirectional handover section 41 positioned second from the front, as an example of configurations of the plural bidirectional handover sections 40 to 44.

For the other plural bidirectional handover sections 40, and 42 to 44, explanation follows regarding only the portions thereof that differ from the single bidirectional handover section 41, positioned second from the front.

Figure 10:
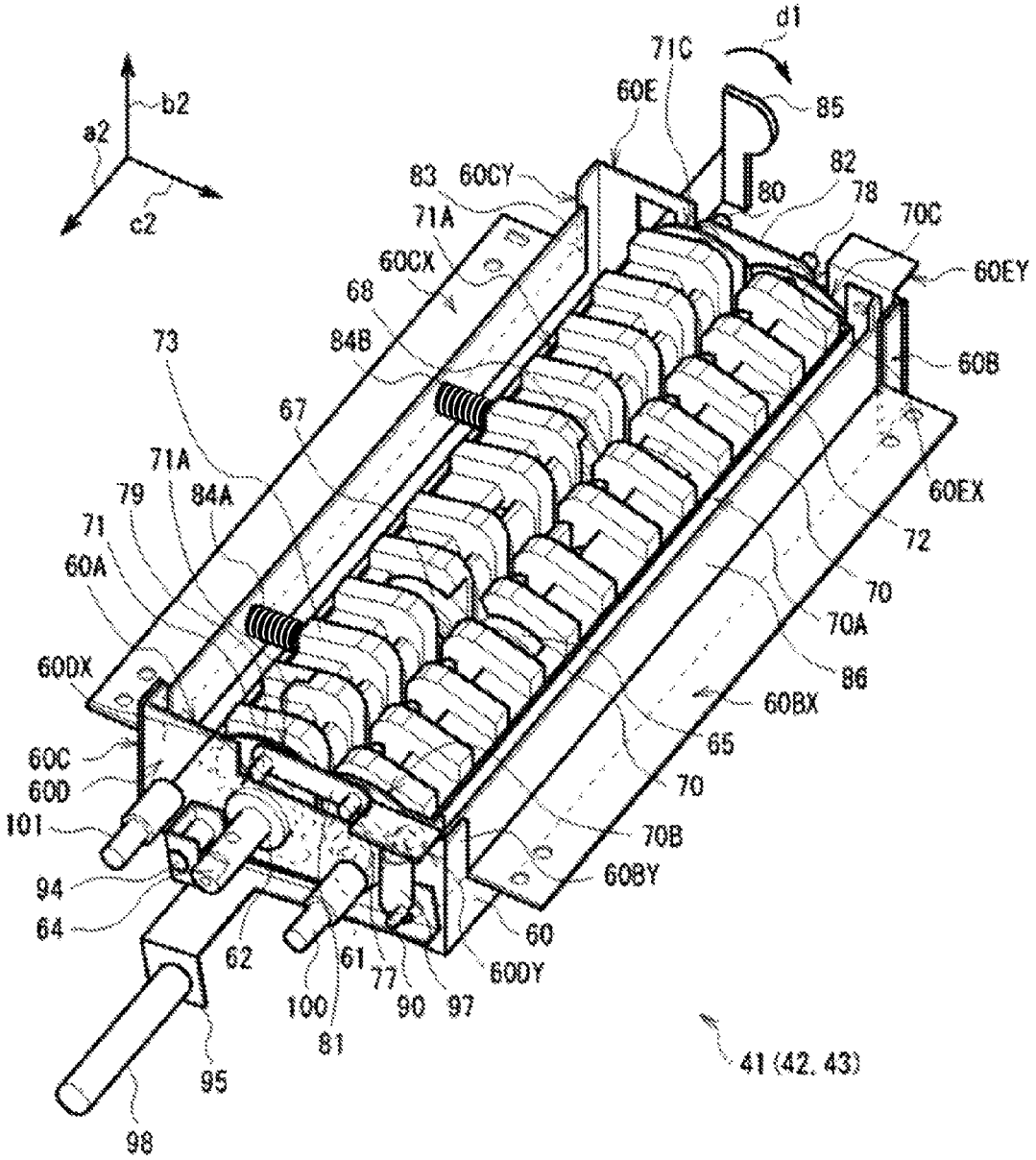
FIG. 10 is a schematic perspective view illustrating a configuration (1) of a bidirectional handover section.
Figure 11:
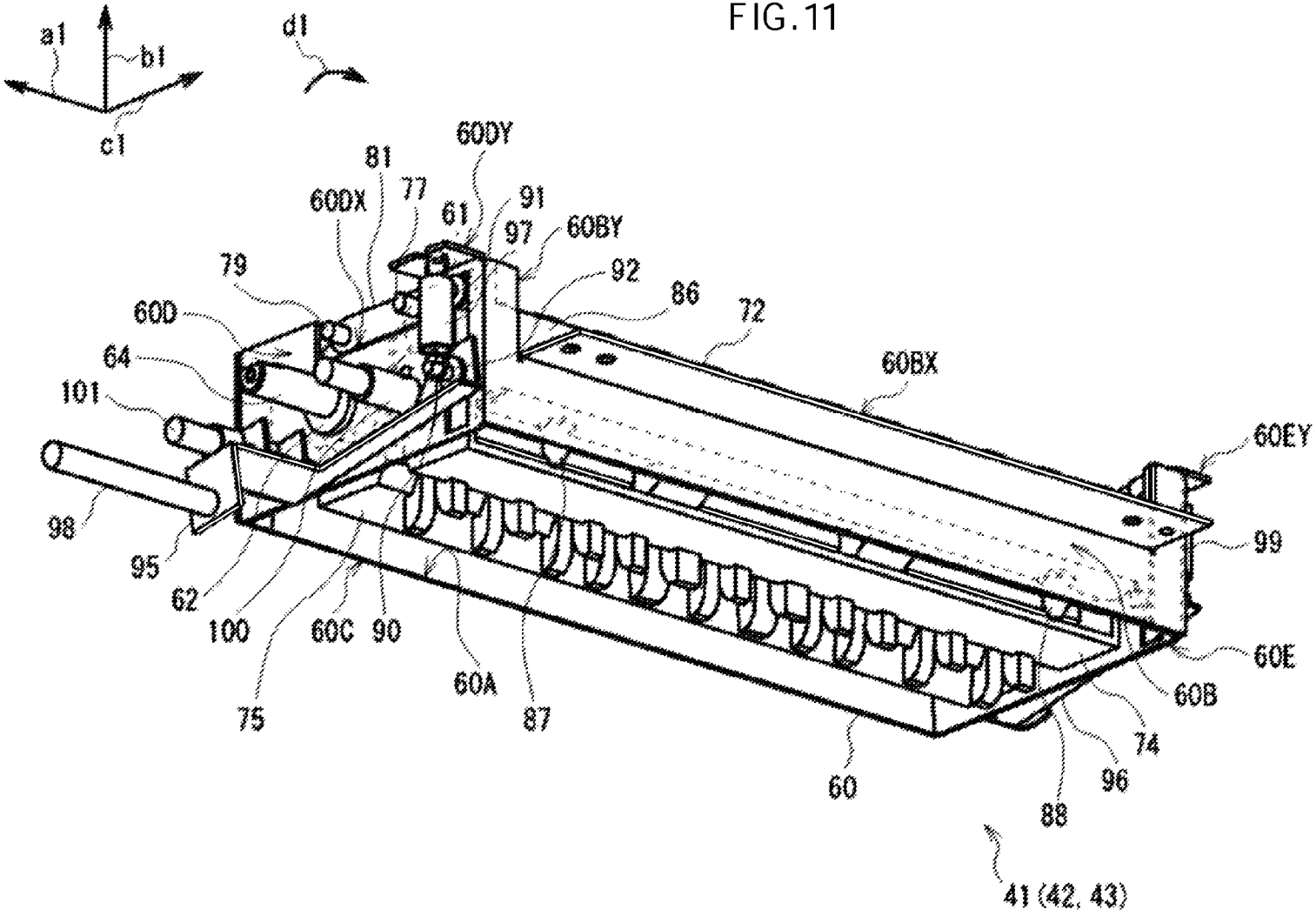
FIG. 11 is a schematic perspective view illustrating a configuration (2) of a bidirectional handover section.
Figure 12:
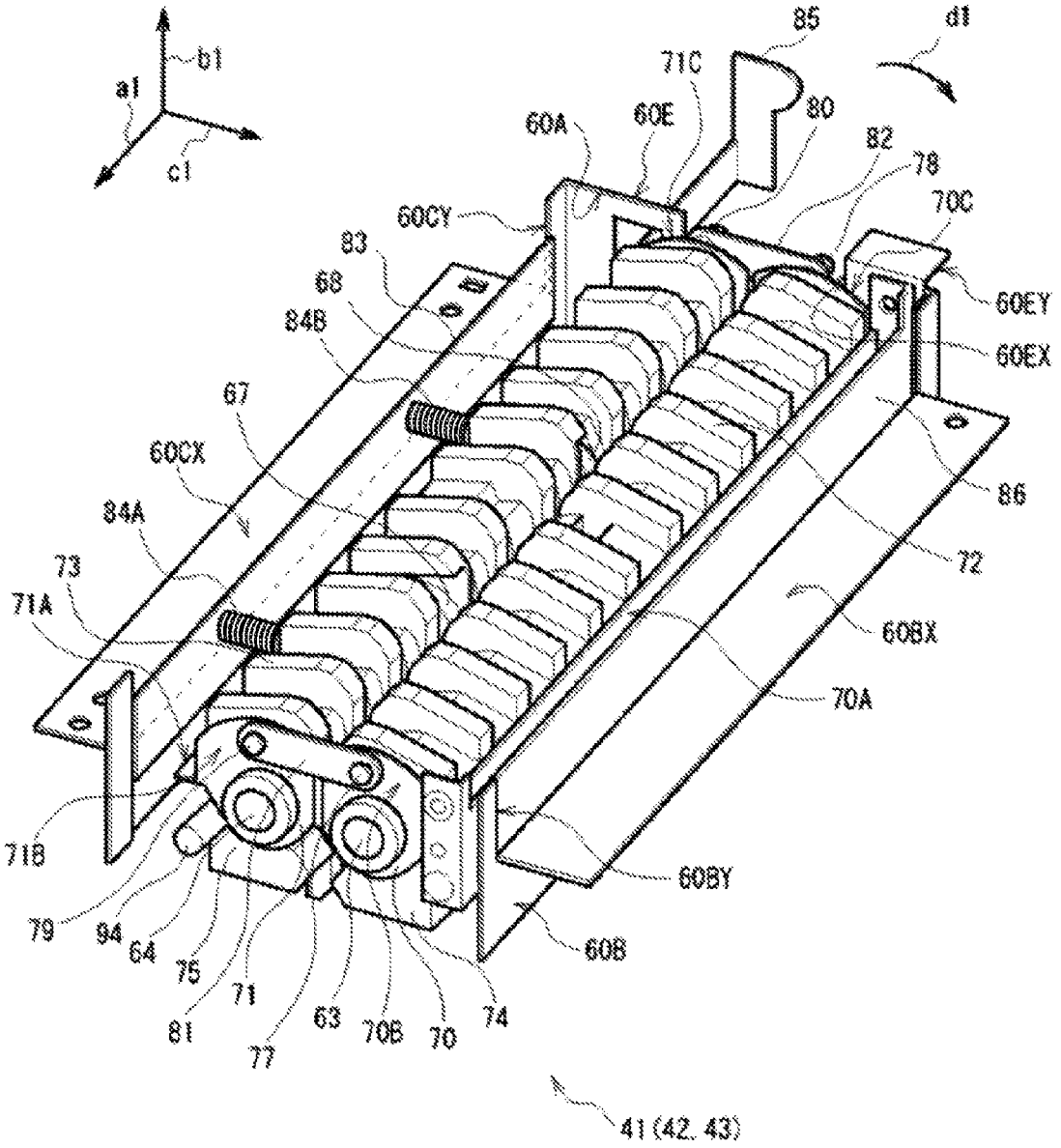
FIG. 12 is a schematic perspective view illustrating a configuration of a handover guide of a bidirectional handover section.

As illustrated in FIG. 10 to FIG. 12, the bidirectional handover section 41 positioned second from the front is, for example, provided with a handover section case 60 formed with a frame 60A that is assembled from a pair of metal plates of substantially L-shaped profiles formed in substantially the same shape as each other so as to have a rectangular shape, long in the left-right direction.

In the handover section case 60, the length of a front plate 60B and a rear plate 60C are set so as to be a specific length that is longer than the length of the long sides of banknotes, and the length of a left-side plate 60D and a right-side plate 60E are set so as to be of a specific length that is shorter than the length of the front plate 60B and the rear plate 60C.

The front plate 60B of the handover section case 60 employs grooves respectively formed toward the front and toward the rear so that the upper end central portion (namely the upper half of the central portion) bends at a right angle toward the device front direction, so as to provide a front-side attachment portion 60BX projecting out from the front plate 60B toward the front side, and a front-side indented portion 60BY on the upper end central portion.

Moreover, the rear plate 60C of the handover section case 60 employs grooves respectively formed toward the front and toward the rear so that the upper end central portion (namely the upper half of the central portion) bends at a right angle toward the device rear direction, so as to provide a rear-side attachment portion 60CX projecting out from the rear plate 60C toward the rear side, and a rear-side indented portion 60CY in the upper end central portion.

In the handover section case 60, the lengths (namely the lengths in the device left-right direction) of the front-side indented portion 60BY of the front plate 60B and of the rear-side indented portion 60CY of the rear plate 60C are set so as to be specific lengths that are the same as each other, and are the length of the long sides of the banknotes or longer.

A pair of a left front shaft bearing 61 and a right front shaft bearing (not illustrated in the drawings) are attached at positions that are further to the front side than the center of the mutually facing inner faces (namely the facing faces) of the left-side plate 60D and the right-side plate 60E of the handover section case 60.

Shaft bearing attachment holes are provided at mutually facing positions further to the rear side than the center of the inner faces of the left-side plate 60D and the right-side plate 60E of the handover section case 60, and a pair of a left rear shaft bearing 62 and a right rear shaft bearing (not illustrated in the drawings) are attached so as to be inserted into these shaft bearing attachment holes.

Thus in the handover section case 60, by inserting a portion at one end and a portion at the other end of a front-side roller shaft 63 into the central holes of the pair of the left front shaft bearing 61 and the right front shaft bearing, the front-side roller shaft 63 is disposed so as to be supported by the pair of the left front shaft bearing 61 and the right front shaft bearing parallel to the device left-right direction, and so as to be rotatable in the one rotation direction illustrated by the arrow dl in the drawings, and the other opposite rotation direction.

Moreover, in the handover section case 60, by inserting a portion at one end and a portion at the other end of a rear-side roller shaft 64 into the central holes of the pair of the left rear shaft bearing 62 and the right rear shaft bearing, the rear-side roller shaft 64 is disposed so as to be supported by the pair of the left rear shaft bearing 62 and the right rear shaft bearing parallel to the device left-right direction, and so as to be rotatable in one rotation direction and another rotation direction.

A pair of handover rollers (also referred to below as front-side rollers) 65 (only one is illustrated, and the other is not illustrated in the drawings) are attached to the front-side roller shaft 63 at positions separated by the same amount to the left side and the right side from the central position between the left-side plate 60D and the right-side plate 60E of the handover section case 60.

A pair of handover rollers (also referred to below as rear-side rollers) 67, 68 are attached to the rear-side roller shaft 64 at positions facing toward the pair of front-side rollers 65 attached to the front-side roller shaft 63, and a portion of the circumferential-side faces of the pair of rear-side rollers 67, 68 are pressed against a portion of the circumferential-side faces of the pair of front-side rollers 65.

The handover section case 60 includes a substantially angular C-shaped pair of a front-side guide retaining portion 70 and a rear-side guide retaining portion 71, which are long in the left-right direction.

The front-side guide retaining portion 70 includes a substantially long-thin rectangular shaped back plate 70A that is positioned at the front side, and is attached to the pair of the left front shaft bearing 61 and the right front shaft bearing through a left plate 70B and a right plate 70C that project out toward the rear side from the left end and the right end of the back plate 70A, such that the front-side guide retaining portion 70 is able to swing in the one rotation direction and the other rotation direction independently of rotation of the front-side roller shaft 63.

Namely, the handover section case 60 supports the front-side guide retaining portion 70 through the pair of the left front shaft bearing 61 and the right front shaft bearing so as to be capable of swinging in the one rotation direction and the other rotation direction about a center of swing of the front-side roller shaft 63, and also independently to the front-side roller shaft 63.

The rear-side guide retaining portion 71 includes a substantially angle shaped back plate 71A that is positioned at the rear side, and is attached to the pair of the left rear shaft bearing 62 and the right rear shaft bearing through a left plate 71B and a right plate 71C that are flat plate shaped and project out toward the front side from the left end and the right end of the back plate 71A, such that the rear-side guide retaining portion 71 is capable of swinging in the one rotation direction and the other rotation direction independently of rotation of the rear-side roller shaft 64.

Namely, the handover section case 60 supports the rear-side guide retaining portion 71 through the pair of the left rear shaft bearing 62 and the right rear shaft bearing so as to be capable of swinging in the one rotation direction and the other rotation direction about a center of swing of the rear-side roller shaft 64, and also independently to the rear-side roller shaft 64.

In the front-side guide retaining portion 70, a handover guide 72 having a specific length of the length of the long side of the banknotes or longer and substantially J-shaped cross-sections is attached so as to be positioned with base portions further to the rear side than the front-side roller shaft 63 and parallel to the back plate 70A of the front-side guide retaining portion 70, and with the leading end portions of the handover guide 72 positioned diagonally above and to the front of the base portions, further to the upper-side than the bottom edge of the front-side indented portion 60BY.

Thus in the handover section case 60, the front-side guide retaining portion 70 is supported together with the handover guide 72 that is retained on (namely attached to) the front-side guide retaining portion 70, so as to be capable of swinging in the one rotation direction and the other rotation direction.

In the following explanation, the handover guide 72 that is retained on, and swings as one with, the front-side guide retaining portion 70 is also referred to as the front-side movable guide 72.

The front-side movable guide 72 is formed with arc shapes such that lower edge portions of one face of the base portions slope gradually diagonally toward the front and downward, such that the combined one face of the leading end portions and the base portions form a comb tooth shape along the device left direction.

In the rear-side guide retaining portion 71, a handover guide 73 having a length equivalent to the length of the front-side movable guide 72 and substantially J-shaped cross-sections is attached so as to be positioned with base portions further to the front side than the rear-side roller shaft 64 and parallel to the back plate 71A of the rear-side guide retaining portion 71, and with leading end portions of the handover guide 73 positioned diagonally to the rear and above the base portions, further to the upper-side than the bottom edge of the rear-side indented portion 60CY.

Thus in the handover section case 60, the rear-side guide retaining portion 71 is supported, together with the handover guide 73 that is retained on (namely attached to) the rear-side guide retaining portion 71, so as to be capable of swinging in the one rotation direction and the other rotation direction.

In the following explanation, the handover guide 73 that is retained on, and swings as one with, the rear-side guide retaining portion 71 is also referred to as the rear-side movable guide 73.

The rear-side movable guide 73 is formed in with arc shapes such that lower edge portions of one face of the base portions slopes gradually diagonally toward the rear and downward, such that the combined one face of the leading end portions and the base portions form a comb tooth shape along the device left direction.

The handover section case 60 includes a handover guide 74 that has a specific length of the length of the long side of the banknotes or longer and a substantially T-shaped cross-section, and is fixed to the pair of the left front shaft bearing 61 and the right front shaft bearing so as to be positioned with flat one face of arm portions vertical and facing the rear side, diagonally to the rear of and below the front-side roller shaft, and with a main portion positioned further to the front side than the arm portions.

In the following explanation, the handover guide 74 that is fixed to the pair of the left front shaft bearing 61 and the right front shaft bearing of the handover section case 60 is also referred to as the front-side fixed guide 74.

In the front-side fixed guide 74, upper edge portions of one face of the arm portions are formed in an arc shape so as to gradually slope diagonally upward and toward the front, and lower edge portions of one face of the arm portions are formed in an arc shape so as to gradually slope diagonally downward and toward the front.

The front-side fixed guide 74 is formed such that the combined one face of the arm portions form a comb tooth shape along the device left direction, such that the upper end portions of the arm portions fit together so as to mesh with the base portions of the front-side movable guide 72, and the lower end portions of the arm portions project out toward the lower side from the frame 60A of the handover section case 60.

Moreover, the handover section case 60 also includes a handover guide 75 that has a specific length equivalent to that of the front-side fixed guide 74 and a substantially T-shaped cross-section, and is fixed to the pair of the left rear shaft bearing 62 and the right rear shaft bearing so as to be positioned with flat one face of arm portions vertical and facing the one face of the arm portions of the front-side fixed guide 74 (namely, facing toward the front side), diagonally to the front of and below the rear-side roller shaft 64, and with a main portion positioned further to the rear side than the arm portions.

In the following explanation, the handover guide 75 that is fixed to the pair of the pair of the left rear shaft bearing 62 and the right rear shaft bearing of the handover section case 60 is also referred to as the rear-side fixed guide 75.

Namely, the front-side fixed guide 74 and the rear-side fixed guide 75 are fixed to the handover section case 60 parallel to each other such that there is a specific separation (for example a separation of about 5 mm) to each other between the one face of the arm portions.

The rear-side fixed guide 75 includes upper edge portions of one face of the arm portions slope formed in an arc shape so as to gradually slope diagonally upward and toward the rear, and lower edge portions of one face of the arm portions formed in an arc shape so as to gradually slope gradually downward and toward the rear.

The rear-side fixed guide 75 is formed such that the combined one face of the arm portions together form an overall comb tooth shape along the device left direction, such that the upper end portions of the arm portions fit together so as to mesh with the base portions of the front-side movable guide 73, and the lower end portions of the arm portions project out toward the lower side from the frame 60A of the handover section case 60.

Thus in the handover section case 60, when the flat portions on one face of the base portions of the front-side movable guide 72 have been made vertical, the front-side fixed guide 74 is fixed such that the flat portions on the one face of the base portions of the front-side movable guide 72, and the flat portions on the one face of the arm portions of the front-side fixed guide 74 are in the same plane.

In the handover section case 60, when the flat portions on one face of the base portions of the rear-side movable guide 73 have been made vertical, the rear-side fixed guide 75 is fixed such that the flat portions on the one face of the base portions of the rear-side movable guide 73, and the flat portions on the one face of the arm portions of the rear-side fixed guide 75, are in the same plane as each other.

Respective holes are provided in the combined one face of the leading end portions and base portions of the front-side movable guide 72, at positions facing toward the pair of front-side rollers 65.

Respective cut out portions are formed in the arm portions and main body portion of the front-side fixed guide 74 at positions facing toward the pair of front-side rollers 65.

Thereby, the front-side movable guide 72 and the front-side fixed guide 74 cause portions at the rear side of the circumferential-side faces of the pair of front-side rollers 65 to project out, through the corresponding holes and the cut out portions, toward the rear side from the one face of the base portions of the front-side movable guide 72 and from the one face of the arm portions of the front-side fixed guide 74.

Respective holes are provided in the combined one face of the leading end portions and base portions of the rear-side movable guide 73, at positions facing toward the pair of rear-side rollers 67, 68.

Respective cut out portions are formed in the arm portions and main body portion of the rear-side fixed guide 75, at positions facing toward the pair of rear-side rollers 67, 68.

Thereby, the rear-side movable guide 73 and the rear-side fixed guide 75 cause portions at the rear side of the circumferential-side faces of the pair of rear-side rollers 67, 68 to project out, through the corresponding holes and the cut out portions, toward the front side from the one face of the base portions of the rear-side movable guide 73 and from the one face of the arm portions of the rear-side fixed guide 75.

In addition thereto, the handover section case 60 also has a left cut out portion 60DX and a right cut out portion 60EX formed to the same specific depth as each other in respective upper end central portions of the left-side plate 60D and the right-side plate 60E.

In the front-side guide retaining portion 70, when the flat portions on the one face of the base portions of the front-side movable guide 72 are vertical (namely, parallel to the device up-down direction), a circular column shaped front-left-side coupling pin 77 projects straight out from the outside face of the left plate 70B at an edge portion directly above the front-side roller shaft 63.

In the front-side guide retaining portion 70, when flat portions on the one face of the base portions of the front-side movable guide 72 are vertical (namely, parallel to the device up-down direction), a circular column shaped front-right-side coupling pin 78 projects straight out from the outside face of the right plate 70C at an edge portion directly above the front-side roller shaft 63.

Moreover, in the rear-side guide retaining portion 71, when flat portions on the one face of the base portions of the rear-side movable guide 73 are vertical (namely, parallel to the device up-down direction), a circular column shaped rear-left-side coupling pin 79 projects straight out from the outside face of the right plate 70C at an edge portion directly above the rear-side roller shaft 64.

Moreover, in the rear-side guide retaining portion 71, when flat portions on the one face of the base portions of the rear-side movable guide 73 are vertical (namely, parallel to the device up-down direction), a circular column shaped rear-right-side coupling pin 80 projects straight out from the outside face of the right plate 70C at an edge portion directly above the rear-side roller shaft 64.

The front-left-side coupling pin 77 and the rear-left-side coupling pin 79 of the front-side guide retaining portion 70 and the rear-side guide retaining portion 71 are inserted into holes provided at one end portion and another end portion of a substantially long-thin rectangular shaped left-side coupling plate 81.

The front-right-side coupling pin 78 and the rear-right-side coupling pin 80 of the front-side guide retaining portion 70 and the rear-side guide retaining portion 71 are inserted into holes provided at one end portion and another end portion of a substantially long-thin rectangular shaped right-side coupling plate 82.

Thus the front-side guide retaining portion 70 and the rear-side guide retaining portion 71 are coupled together though the left-side coupling plate 81 and the right-side coupling plate 82.

The left-side coupling plate 81 and the right-side coupling plate 82 have a set specific length that is slightly longer than the separation between the centers of the front-side roller shaft 63 and the rear-side roller shaft 64, and the separation between the centers of the holes at the one end and the other end is set to be the same as the separation between the centers of the front-side roller shaft 63 and the rear-side roller shaft 64.

Thus the left-side coupling plate 81 and the right-side coupling plate 82 couple the front-side movable guide 72 and the rear-side movable guide 73 together, through the front-side guide retaining portion 70 and the rear-side guide retaining portion 71, in a state in which respective base portions of the front-side movable guide 72 and the rear-side movable guide 73 are parallel to each other.

Namely, the left-side coupling plate 81 and the right-side coupling plate 82 couple the base portions of the front-side movable guide 72 and the rear-side movable guide 73 together, in a state parallel to each other with a separation in between equivalent to the separation between the arm portions of the front-side fixed guide 74 and the rear-side fixed guide 75.

Figure 13A:
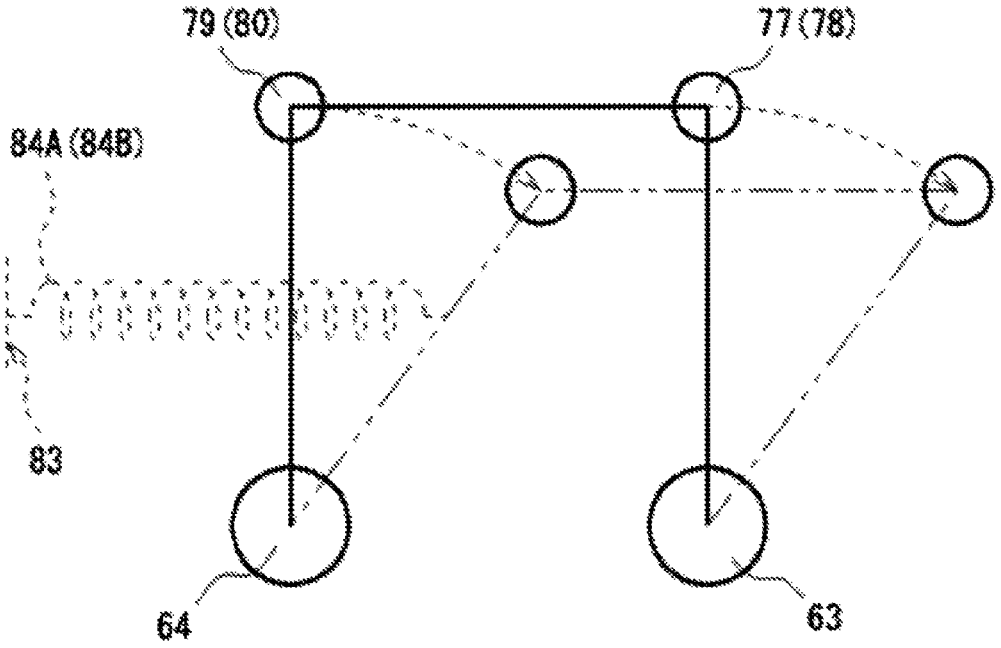
FIG. 13A is a schematic diagram to accompany explanation of swinging of a front-side movable guide and a rear-side movable guide.
Figure 13B:
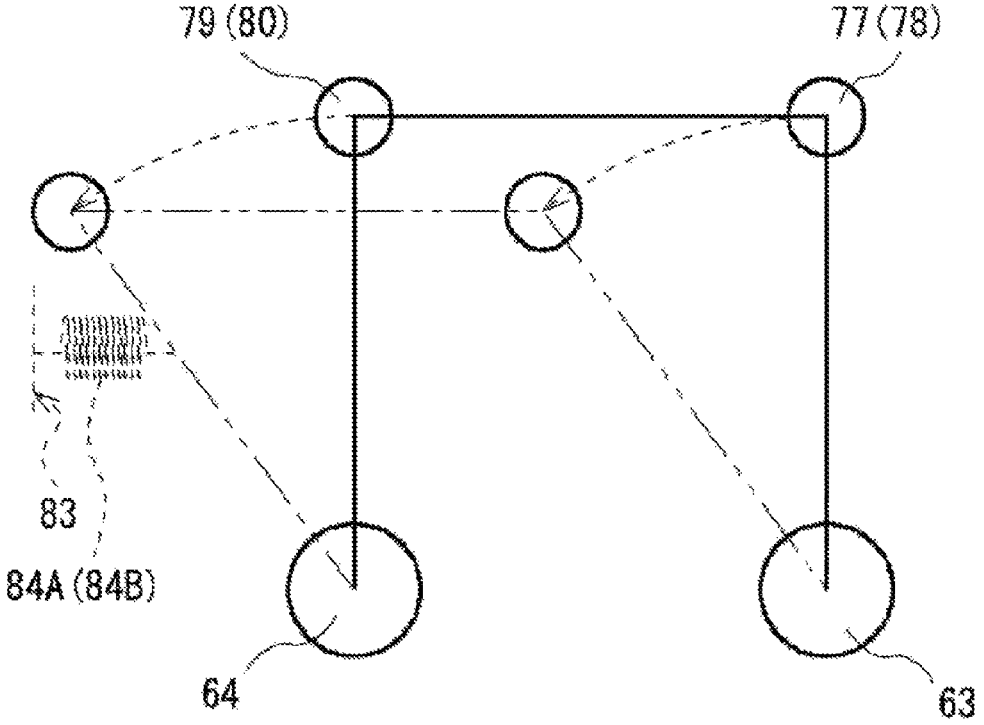
FIG. 13B is a schematic diagram to accompany explanation of swinging of a front-side movable guide and a rear-side movable guide.

Thereby, as illustrated in FIG. 13A and FIG. 13B, the front-side movable guide 72 and the rear-side movable guide 73, together with the left-side coupling plate 81 and the right-side coupling plate 82, form a parallel link that swings about the front-side roller shaft 63 and the rear-side roller shaft 64.

Thus due to coupling by the left-side coupling plate 81 and the right-side coupling plate 82, the front-side movable guide 72 and the rear-side movable guide 73 are able to swing in the one rotation direction and the other rotation direction about the front-side roller shaft 63 and the rear-side roller shaft 64, while their base portions remain parallel to each other with a separation in between equivalent to the separation between the arm portions of the front-side fixed guide 74 and the rear-side fixed guide 75.

Thus in the bidirectional handover section 41, the bidirectional handover path 41A for conveying banknotes using the pair of front-side rollers 65 and the pair of rear-side rollers 67, 68, is formed between the front-side movable guide 72 and the rear-side movable guide 73, and between the front-side fixed guide 74 and the rear-side fixed guide 75, by the front-side movable guide 72 and the rear-side movable guide 73, by the front-side fixed guide 74 and the rear-side fixed guide 75, by the pair of front-side rollers 65, and by the pair of rear-side rollers 67, 68.

Namely, in the bidirectional handover section 41, the bidirectional handover path 41A is formed between the front-side movable guide 72 and the rear-side movable guide 73, and between the front-side fixed guide 74 and the rear-side fixed guide 75, with the length in the device left-right direction of the front-side movable guide 72 and the rear-side movable guide 73 (the front-side fixed guide 74 and the rear-side fixed guide 75) as the handover path cross-width, and with the separation in between as the handover path thickness-width.

In the bidirectional handover section 41, as described above, the lower edge portions of the one face of the base portions of the front-side movable guide 72 and the rear-side movable guide 73 are formed in arc shapes so as to gradually widen in separation from each other.

Moreover, in the bidirectional handover section 41, the upper end portions of the arm portions of the front-side fixed guide 74 and the rear-side fixed guide 75 are also formed in arc shapes so as to gradually widen in separation from each other.

Moreover, in the bidirectional handover section 41, the comb tooth shaped portions of the base portions of the front-side movable guide 72 and the rear-side movable guide 73 fit together by meshing with arm portions of the front-side fixed guide 74 and the rear-side fixed guide 75.

In the bidirectional handover section 41, the front-side movable guide 72 and the rear-side movable guide 73 are also able to rotate parallel to each other with a separation equivalent to the separation between the front-side fixed guide 74 and the rear-side fixed guide 75.

Thus in the bidirectional handover section 41, even in cases in which the front-side movable guide 72 and the rear-side movable guide 73 are inclined from the vertical orientation toward the front side or the rear side, the base portions and the arm portions are prevented from protruding into the bidirectional handover path 41A by the portions of the front-side movable guide 72 and the rear-side movable guide 73 meshing with the front-side fixed guide 74 and the rear-side fixed guide 75.

In the handover section case 60, for example, a spring anchor plate 83 that is long-thin rectangular shaped and long in the left-right direction is attached to the inner face of the rear plate 60C, such that an upper end portion of the spring anchor plate 83 projects upward slightly from the edges of the rear-side indented portion 60CY (namely, so as to be positioned above the edge of the rear-side indented portion 60CY, and below the leading end portions of the front-side movable guide 72 and the rear-side movable guide 73).

In the handover section case 60, for example, one end of each of a pair of springs 84A, 84B, such as compression coil springs (or torsion springs), is anchored to a specific position on the front face of the spring anchor plate 83 further to the upper side than the rear-side roller shaft 64, and the other end of each of the springs 84A, 84B is anchored to a specific position (namely, a specific position further toward the upper side than the rear-side roller shaft 64) on the back plate 71A of the rear-side guide retaining portion 71.

Thereby in the handover section case 60, the specific positions on the rear-side guide retaining portion 71 further to the upper side than the rear-side roller shaft 64 are pressed toward the front side by the springs 84A, 84B.

Thus in the handover section case 60, the rear-side guide retaining portion 71 is biased by the springs 84A, 84B so as to be swung in the one rotation direction about the rear-side roller shaft 64, and, accompanying this, the front-side guide retaining portion 70 coupled to the rear-side guide retaining portion 71 is also biased so as to be swung in the one rotation direction about the front-side roller shaft 63.

In the handover section case 60, in a state in which the upper unit 10 has been pulled out from the device casing 2 as described below, the rear-side guide retaining portion 71 and the front-side guide retaining portion 70 are swung in the one rotation direction by biasing from the springs 84A, 84B, and the front-side movable guide 72 and the rear-side movable guide 73 are inclined toward the front side from the vertical orientation.

In the handover section case 60, for example, a lever insertion hole is provided at a rear end portion of the right-side plate 60E. Moreover, a swing control lever 85 is attached to the back plate 71A of the rear-side guide retaining portion 71 to control swinging of the rear-side guide retaining portion 71 according to the position of the conveying path connection portion of the rear-side conveying section 18 corresponding to the bidirectional handover section 41.

In this example, in the swing control lever 85, a base portion of a long-thin rectangular shaped arm portion of a specific length is joined to the back plate 71A of the rear-side guide retaining portion 71, and the leading end portion of the arm portion projects out toward the right side through a lever insertion hole in the right-side plate 60E of the handover section case 60.

The swing control lever 85 is provided with a substantially L-shaped plate form receiver portion at the leading end portion of the arm portion, rising upward from the arm portion, such that the receiver projection faces toward the front side. The shape and dimensions of the receiver portion of the swing control lever 85 are set as appropriate.

A leading end of the receiver projection of the swing control lever 85 is, for example, attached with respect to the rear-side guide retaining portion 71, so as to be perpendicular to the handover path thickness-width direction between the front-side movable guide 72 and the rear-side movable guide 73, and is attached in the same plane as an imaginary plane positioned at the center of the handover path vertical width between the front-side movable guide 72 and the rear-side movable guide 73.

The handover section case 60 includes a pin retaining section 86 that is long in the left-right direction. The pin retaining section 86 is provided with a long-thin rectangular shaped pin attachment plate that projects out toward the rear side at a lower end portion of a substantially angular C-shaped body plate.

The pin retaining section 86 is provided with a left-side positioning pin 87 and a right-side positioning pin 88 of upright cylindrical column shapes, provided so as to project out downwards at specific respective positions towards the left and toward the right of the bottom face of the pin attachment plate.

In this example, the leading end portions of the left-side positioning pin 87 and the right-side positioning pin 88 are formed with a tapered shape, so as to gradually become thinner in diameter on progression toward the leading end.

The pin retaining section 86 is provided with a left-side shaft attachment plate and a right-side shaft attachment plate of long-thin rectangular shapes that project out toward the rear side at the left end and the right end of the pin attachment plate.

An outer face of the left-side shaft attachment portion of the pin retaining section 86 is provided with, for example, two shafts, a left upper guide shaft (not illustrated in the drawings) and a left lower guide shaft 90 of the same diameter as each other, that project straight out and are at a specific separation from each other along the device downward direction.

An outer face of the right-side shaft attachment portion of the pin retaining section 86 is also provided with, for example, two shafts, a right upper guide shaft and a right lower guide shaft (neither illustrated in the drawings) of the same diameter as each other, that project straight out, and are at a specific separation from each other along the device downward direction.

In the handover section case 60, front end portions of the left-side plate 60D and the right-side plate 60E are provided with a left-side raising/lowering guide hole and a right-side raising/lowering guide hole that are long along the up-down direction and face each other.

Thus in the pin retaining section 86, in a state in which the pin attachment plate is interposed between the front-side guide retaining portion 70 and the front plate 60B of the handover section case 60, the left upper guide shaft and the left lower guide shaft 90 project out to the left side through the left-side raising/lowering guide hole of the left-side plate 60D, and the right upper guide shaft and the right lower guide shaft project out toward the right side through the right-side raising/lowering guide hole of the right-side plate 60E.

Moreover, in the pin retaining section 86, guide rollers 91, 92 that are of the same diameter as each other are attached to the left upper guide shaft and the left lower guide shaft 90, so as to be rotatable about the left upper guide shaft and the left lower guide shaft 90 and so as to engage with the left-side raising/lowering guide hole of the left-side plate 60D of the handover section case 60.

Moreover, in the pin retaining section 86, guide rollers (not illustrated in the drawings) that are of the same diameter as each other are attached to the right upper guide shaft and the right lower guide shaft, so as to be rotatable about the right upper guide shaft and the right lower guide shaft and so as to engage with the right-side raising/lowering guide hole of the right-side plate 60E of the handover section case 60.

Thus in the handover section case 60, the pin retaining section 86 is retained so as to be capable of raising and lowering in the up-down direction, thereby enabling the left-side positioning pin 87 and the right-side positioning pin 88 to project out to the lower side of the frame 60A when the pin retaining section 86 is lowered, and the left-side positioning pin 87 and the right-side positioning pin 88 to be housed inside the frame 60A when the pin retaining section 86 is raised.

In the pin retaining section 86, the height of the main body portion is appropriately set such that the body plate does not to project out further to the upper side than the bottom edge of the front-side indentation 60BY of the handover section case 60 in a state in which the left-side positioning pin 87 and the right-side positioning pin 88 are raised and housed within the frame 60A of the handover section case 60.

Moreover, in the handover section case 60, a left-side shaft insertion hole and a right-side shaft insertion hole are provided so as to face each other at the outside face of the left-side plate 60D and the right-side plate 60E, diagonally below and to the rear of the pair of the left rear shaft bearing 62 and the right rear shaft bearing.

In the handover section case 60, a lever swing shaft 94 is inserted so as to span from the left-side shaft insertion hole of the left-side plate 60D to the right-side shaft insertion hole of the right-side plate 60E.

Thus in the handover section case 60, a portion at one end of the lever swing shaft 94 projects out to the left side from the left-side shaft insertion hole, and a portion at the other end thereof projects out to the right side from the right-side shaft insertion hole, such that the lever swing shaft 94 is supported by the left-side shaft insertion hole and the right-side shaft insertion hole so as to be capable of swinging in the one rotation direction and the other rotation direction.

The handover section case 60 includes a pair of a left-side raising/lowering control lever 95 and a right-side raising/lowering control lever 96, which are substantially angular in shape, for controlling the raising and lowering of the left-side positioning pin 87 and the right-side positioning pin 88 together with the pin retaining section 86.

In this example, the left-side raising/lowering control lever 95 is provided with a coupling portion of substantially L-shaped flat plate form at a lower end of a case attachment portion of substantially angular C-shaped flat plate form, so as to project out to the left side.

The left-side raising/lowering control lever 95 is provided with a substantially angular C-shaped shaft anchoring portion formed to the rear end portion of the case attachment portion so as to turn back on itself in sequence toward the left side then toward the front side.

In the left-side raising/lowering control lever 95, a pair of shaft anchoring holes are provided in the left plate and right plate of the shaft anchoring portion so as to face each other, and a portion at one end of the lever swing shaft 94 is inserted into the pair of shaft anchoring holes, in sequence from the right, and anchored therein.

Thus the handover section case 60 supports the left-side raising/lowering control lever 95 so as to be capable of swinging in the one rotation direction and the other rotation direction about the lever swing shaft 94.

Moreover, in the left-side raising/lowering control lever 95, a shaft engagement hole is provided at a front end portion of the case attachment portion, and the left lower guide shaft 90 of the pin retaining section 86 is inserted into, and engages with, the shaft engagement hole.

Moreover, in the handover section case 60, a left-side spring anchor portion 60DY is provided toward the upper end and front of the left-side plate 60D (namely, directly above the left-side raising/lowering guide hole) so as to project out toward the left side.

In the left-side raising/lowering control lever 95, a portion at one end of a coil spring 97 is anchored to the portion of the left lower guide shaft 90 that projects out toward the left side of the case attachment portion, and a portion at the other end of the coil spring 97 is anchored to the left-side spring anchor portion 60DY of the handover section case 60.

Thus the left-side raising/lowering control lever 95 is biased by the coil spring 97 so as to rotate in the other rotation direction, so as to pull the case attachment portion up toward the upper side together with the left lower guide shaft 90.

Moreover, in the left-side raising/lowering control lever 95, a pin attachment portion is provided to the leading end of a left side projection portion of the coupling portion so as to project downward, and a circular rod shaped coupling pin 98 is provided on the outside face of the pin attachment plate that faces toward the left side, so as to project straight out toward the left side.

The right-side raising/lowering control lever 96 is configured fundamentally the same as a configuration of a left-side raising/lowering control lever 95 that has been left-to-right inverted.

Namely, the right-side raising/lowering control lever 96 is provided with a coupling portion of substantially L-shaped flat plate form at a lower end of a case attachment portion of substantially angular C-shaped flat plate form, so as to project out to the right side.

The right-side raising/lowering control lever 96 is provided with a substantially angular C-shaped shaft anchoring portion formed to the rear end portion of the case attachment portion so as to turn back on itself in sequence toward the right side then toward the front side.

In the right-side raising/lowering control lever 96, a pair of shaft anchoring holes are provided in the left plate and right plate of the shaft anchoring portion so as to face each other, and in a state orientated to match the left-side raising/lowering control lever 95, a portion at the other end of the lever swing shaft 94 is inserted into the pair of shaft anchoring holes in sequence from the left, and anchored therein.

Thus the handover section case 60 supports the right-side raising/lowering control lever 96 so as to be capable of swinging in the one rotation direction and the other rotation direction about the lever swing shaft 94 in a state oriented to match that of the left-side raising/lowering control lever 95.

Moreover, in the right-side raising/lowering control lever 96, a shaft engagement hole is provided at a front end portion of the case attachment portion, and the right lower guide shaft of the pin retaining section 86 is inserted into, and engages with, the shaft engagement holes.

Moreover, in the handover section case 60, a right-side spring anchor portion 60EY is provided toward the upper end and front of the right-side plate 60E (namely, directly above the right-side raising/lowering guide hole) so as to project out toward the right side.

In the right-side raising/lowering control lever 96, a portion at one end of a coil spring 99 having a resilient force similar to that of the coil spring 97 described above is anchored to the portion of the right lower guide shaft that projects out toward the right side of the case attachment portion, and a portion at the other end of the coil spring 99 is anchored to the right-side spring anchor portion 60EY of the handover section case 60.

Thus the right-side raising/lowering control lever 96 is biased by the coil spring 99 so as to rotate in the other rotation direction so as to pull the case attachment portion up toward the upper side together with the right lower guide shaft.

The right-side raising/lowering control lever 96 is configured differently from the left-side raising/lowering control lever 95, in that the length of the right side projection portion of the coupling portion is shorter, and the pin attachment portion and the coupling pin are omitted.

The thus configured handover section case 60 swings in the one rotation direction and the other rotation direction with the left-side raising/lowering control lever 95 and the right-side raising/lowering control lever 96 in a state of matched orientation to each other.

Thus in the handover section case 60, swinging of the left-side raising/lowering control lever 95 and of the right-side raising/lowering control lever 96 is coupled together, enabling the pin retaining section 86 to be raised or lowered with the length direction of the pin retaining section 86 remaining substantially parallel to the device left-right direction (namely, with the length direction of the left-side positioning pin 87 and the right-side positioning pin 88 remaining substantially parallel to the device up-down direction).

Figure 14:
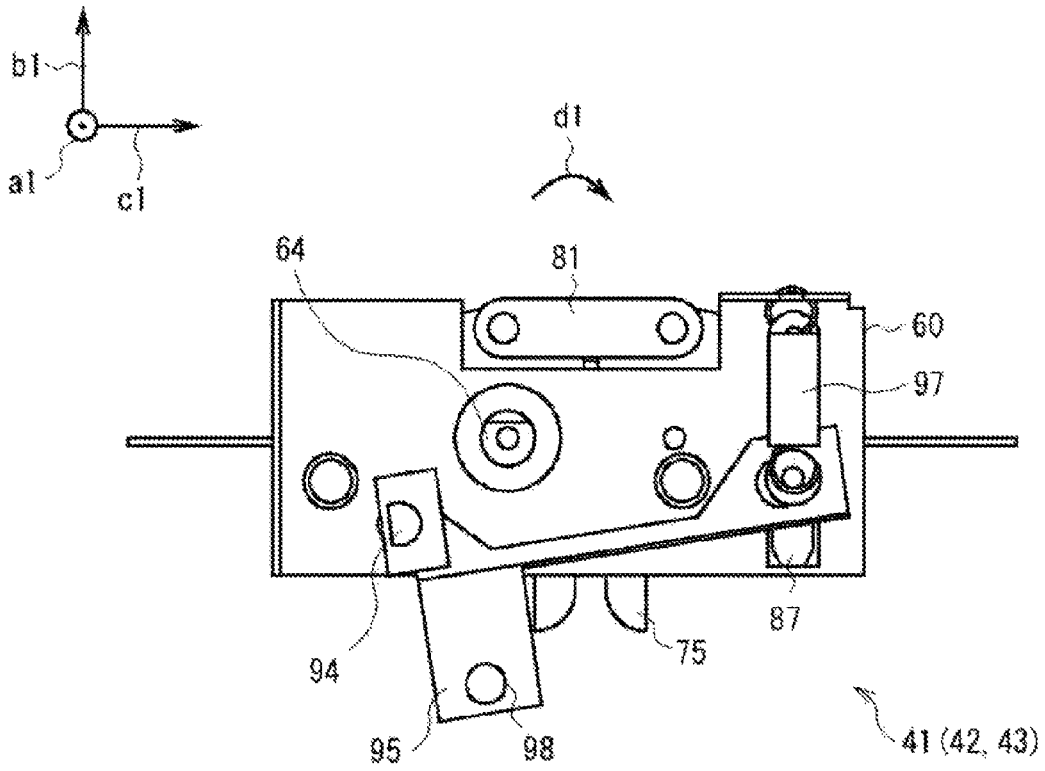
FIG. 14 is a schematic side view to accompany explanation of housing of a left-side positioning pin and a right-side positioning pin coupled to swinging of a left-side raising/lowering control lever and a right-side raising/lowering control lever.

As illustrated in FIG. 14, in the handover section case 60, when the left-side raising/lowering control lever 95 and the right-side raising/lowering control lever 96 are swung together in the other rotation direction, coupled thereto, the pin retaining section 86 is raised so as to be pressed upward, enabling the left-side positioning pin 87 and the right-side positioning pin 88 to be housed within the frame 60A.

Figure 15:
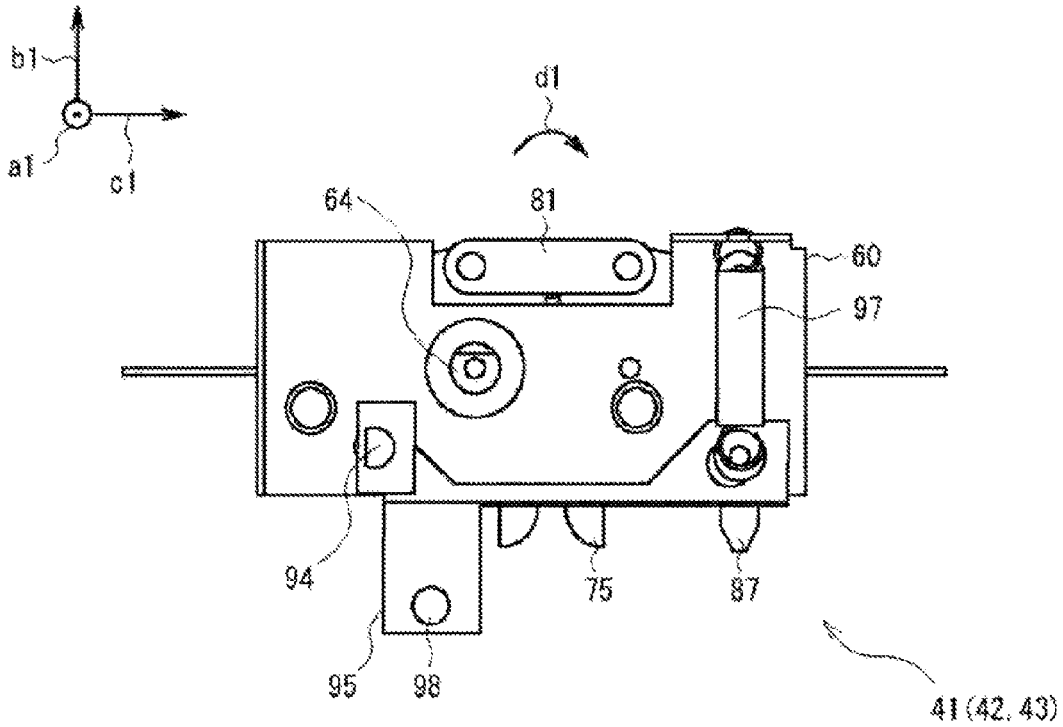
FIG. 15 is a schematic side view to accompany explanation of projecting out of the left-side positioning pin and the right-side positioning pin coupled to swinging of the left-side raising/lowering control lever and the right-side raising/lowering control lever.

Moreover, as illustrated in FIG. 15, in the handover section case 60, when the left-side raising/lowering control lever 95 and the right-side raising/lowering control lever 96 are swung together in the one rotation direction, coupled thereto, the pin retaining section 86 is lowered so as to be pressed downward, enabling the left-side positioning pin 87 and the right-side positioning pin 88 to be projected out from the frame 60A.

Moreover, in the handover section case 60, for example, a front-side pulley support shaft 100 and a rear-side pulley support shaft 101 are provided projecting straight out from the outside face of the left-side plate 60D, at positions to the lower side of the rear-side roller shaft 64 and at equal separations to the front side and the rear side of the rear-side roller shaft 64.

As described above with respect to FIG. 3, the handover section case 60 of the bidirectional handover section 41 is attached to the coupling body 36 through the front-side attachment portion 60BX and the rear-side attachment portion 60CX, with the leading end portions of the front-side movable guide 72 and the rear-side movable guide 73 projecting out to the upper side of the safe top plate 26A, and with lower end portions of the arm portions of the front-side fixed guide 74 and the rear-side fixed guide 75 projecting out to the lower side of the safe top plate 26A.

From out of the plural bidirectional handover sections 40 to 44, the bidirectional handover sections 42 and 43 positioned third and fourth from the front are configured similarly to the bidirectional handover section 41 that is positioned second from the front, described above.

The one bidirectional handover section 40 that is positioned furthermost to the front is also configured similarly to the bidirectional handover section 41 that is positioned second from the front, described above, except in the point that the front-side pulley support shaft 100 is not provided to the handover section case.

The one bidirectional handover section 44 that is positioned furthermost to the rear is also configured similarly to the bidirectional handover section 41 that is positioned second from the front, described above, except in the point that the rear-side pulley support shaft 101 is not provided to the handover section case.

Figure 16:
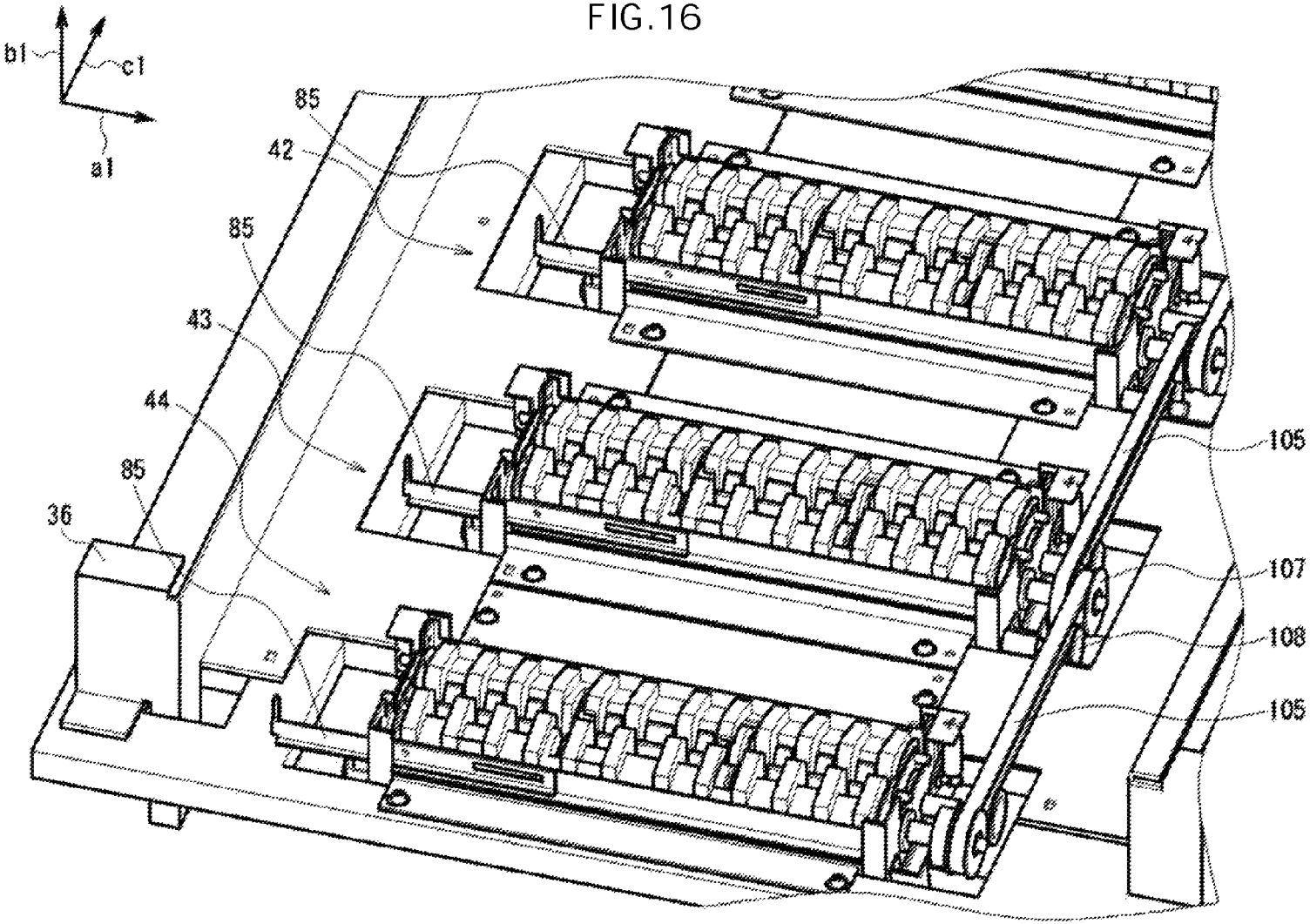
FIG. 16 is a schematic perspective view illustrating a configuration (3) of a bidirectional handover section.

Namely, as illustrated in FIG. 3 and FIG. 16, in the plural bidirectional handover sections 40 to 44, drive pulleys 107 are attached to portions of the rear-side roller shafts 64 that project out toward the left side from the left-side plate 60D of the handover section case 60, enabling two drive belts 105 to be entrained, on the left and right, around the drive pulleys 107.

In the plural bidirectional handover sections 40 to 44, in order to apply tension to each respective single drive belt, tension pulleys 108 capable of rotating in the one rotation direction and the other rotation direction are attached to the front-side pulley support shaft 100 and to the rear-side pulley support shaft 101.

Thus in the plural bidirectional handover sections 40 to 44, for example, when the drive belt 105 entrained between the one-in-front bidirectional handover section 40 to 43 and the right side of the drive pulley 107, there is also a drive belt 105 entrained between the one-behind bidirectional handover section 41 to 44 and the left side of the drive pulley 107.

In the plural bidirectional handover sections 40 to 44, the lower side of the drive belts 105 entrained around the drive pulleys 107 is pressed upward by the tension pulleys 108, such that a specific tension is imparted to the drive belts 105.

Out of the plural bidirectional handover sections 40 to 44, for example in the single bidirectional handover section 40 positioned furthermost toward the front, a drive transfer section 110 including a gear, a drive pulley, a drive belt, and the like, is disposed at the left side of the handover section case 60.

Thus in the single bidirectional handover section 40 positioned furthermost toward the front, when, for example, the upper unit 10 is stowed in the device casing 2, the drive transmission gear provided to the switching conveying section 14 is coupled to the gear of the drive transfer section 110.

Thus in the single bidirectional handover section 40 positioned furthermost toward the front, drive force of the drive motor transmitted from the switching conveying section 14 through the drive transmission gear during pay-in and pay-out, is received by the gear of the drive transfer section 110, and transmitted from the gear of the handover section case 60 whose the drive pulley 107 is rotated, through the drive pulleys and drive belts, in sequence to the drive pulleys 107 of the other handover section cases 60.

Thus even though a drive motor is not specifically provided to the plural bidirectional handover sections 40 to 44, it is still possible to drive the bidirectional handover paths 40A to 44A and convey banknotes during pay-in and pay-out.

As illustrated in FIG. 7 and FIG. 16, in the plural bidirectional handover sections 40 to 44, the swing control levers 85 are attached to the respective rear-side guide retaining portions 71 of the handover section cases 60 as described above.

Moreover, in the plural bidirectional handover sections 40 to 44, the swing control levers 85 are attached with respect to the rear-side guide retaining portions 71 of the respective handover section cases 60 such that the receiving portions of the swing control levers 85 are positioned displaced at specific intervals more to the right side, in sequence on progression along the device rear direction.

In the switching conveying section 14 and the rear-side conveying section 18, respective pairs of parallel conveying guides are disposed along the plural conveying path connection portions corresponding to the plural bidirectional handover sections 40 to 44, disposed such that the one face of each is vertical, disposed along the front-rear direction, and disposed together with conveying rollers, conveyor belts, and the like.

In the following explanation, one of the conveying guides that is positioned at the front side of the pairs of conveying guides, respectively disposed at the plural conveying path connection portions of the switching conveying section 14 and the rear-side conveying section 18, is also referred to as the connection portion front guide, and the other conveying guide positioned at the rear side is also to referred to as the connection portion rear guide.

Thus in the switching conveying section 14 and the rear-side conveying section 18, the lower end portions of the connection branch portions of the switching conveying path 14A and the rear-side conveying path 18A, between the respective connection portion front guide and the connection portion rear guide in the plural conveying path connection portions, have conveying path cross-widths and conveying path thickness-widths that are equivalent to the handover path cross-width and the handover path thickness-width of the plural bidirectional handover sections 40 to 44, and are formed such that banknotes can be conveyed toward the upper side and the lower side along the conveyance direction, parallel to the device up-down direction.

Namely, in the switching conveying section 14 and the rear-side conveying section 18, between the respective connection portion front guide and the connection portion rear guide in the plural conveying path connection portions, the lower end portions of the connection branch portions of the switching conveying path 14A and the rear-side conveying path 18A are formed such that the length in the device left-right direction of the connection portion front guide and the connection portion rear guide is a conveying path cross-width equivalent to the handover path cross-width, and the separation in between is a conveying path thickness-width equivalent to the handover path thickness-width.

Respective lower end portions of the pairs of connection path front guides and connection portion rear guides for each of the conveying path connection portions form comb tooth shapes running along the device left direction, with one face of each of the respective lower end portions formed with an arc shape such that the separation in between gradually widens on progression from above to below.

In the plural conveying path connection portions of the switching conveying section 14 and the rear-side conveying section 18, from out of the pairs of connection path front guides and connection portion rear guides, pressing arms 115 are attached, for example, to the connection portion front guides so as to align with the swing control levers 85.

In this example, base portions of long-thin rectangular shaped arm portions of the pressing arm 115 are of specific respective lengths and joined to specific positions of the connection portion front guide, and leading end portions of the arm portions are positioned further to the right side than the connection portion front guides.

Substantially block shaped pressing portions that are long in the vertical direction are, for example, provided to the respective leading ends of the arm portions of the pressing arms 115 so as to project downward from the leading ends of the arm portions, and are provided with pressing faces that face toward the rear side. The shape and dimensions of the pressing portions of the pressing arms 115 are appropriately set.

Thus the pressing arms 115 are attached, for example, with respect to the connection portion front guides, such that the pressing faces of the pressing portions are perpendicular to the conveying path thickness-width direction of the pairs of connection portion front guides and connection portion rear guides, and so as to be in the same plane as an imaginary flat plane positioned at the conveying path thickness-width center between the respective pairs of connection portion front guides and connection portion rear guides.

In the switching conveying section 14 and the rear-side conveying section 18, the pressing arms 115 for the respective connection portion front guides of the plural conveying path connection portions are attached such that the pressing portions of the pressing arms 115 are displaced at specific intervals in sequence more to the right side on progression along the device rear direction, so as to be positioned facing toward the respective receiver projections of the swing control levers 85.

The swing control levers 85 and the pressing arms 115 provided to the plural bidirectional handover sections 40 to 43, the switching conveying section 14, and the rear-side conveying section 18, configure a positioning section 116 (FIG. 7) that functions to position the upper end portions of the plural bidirectional handover paths 40A to 43A and the lower end portions of the connection branch portions of the switching conveying path 14A and the rear-side conveying path 18A for connection when the upper unit 10 is stowed in the device casing 2.

In the explanation below, the positioning section 116 that is configured by the swing control levers 85 and the pressing arms 115 provided to the plural bidirectional handover sections 40 to 43, the switching conveying section 14, and the rear-side conveying section 18 is also referred to as an upper-side positioning section 116.

Due to such configuration of each of the plural bidirectional handover sections 40 to 44, the rear-side guide retaining portion 71 and the front-side movable guide 72 in the handover section case 60 are rotated in the one rotation direction when the upper unit 10 is pulled out from the device casing 2 as described above, and the front-side movable guide 72 and the rear-side movable guide 73 are tilted from the vertical orientation toward the front side.

In this state, when the upper unit 10 is moved toward the device rear direction from a specific unit pulled-out position at the front side of the device casing 2, to a specific unit stowed position inside the device casing 2 so as to be stowed in the device casing 2, the switching conveying section 14 and the rear-side conveying section 18 are moved as part of the upper unit 10 toward the device rear direction accompanying stowing.

When this occurs, just before the upper unit 10 reaches the unit stowed position, in the switching conveying section 14 and the rear-side conveying section 18, the front-side swing guide 72 starts to be swung together with the rear-side swing guide 73 in the other rotation direction so that the pressing portions of the pressing arms 115 of the respective plural conveying path connection portions press against the receiver projection of the receiver portions of the swing control levers 85 corresponding to the plural bidirectional handover sections 40 to 44.

Namely, in the switching conveying section 14 and the rear-side conveying section 18, when the upper unit 10 is moved to just before the unit stowed position, the front-side swing guide 72 starts to be swung together with the rear-side swing guide 73 in the other rotation direction so that the respective pressing portion of the pressing arms 115 of each of the conveying path connection portions presses against the receiver projection of the receiver portion of the swing control lever 85 of the corresponding bidirectional handover section 40 to 44 at an individual timing according to the adjusted position between the conveying path connection portions and the corresponding bidirectional handover sections 40 to 44.

Moreover, in the switching conveying section 14 and the rear-side conveying section 18, by continuing to move the upper unit 10 toward the unit stowed position side, as the front-side movable guide 72 and the rear-side movable guide 73 of each of the bidirectional handover sections 40 to 44 are being respectively swung in the other rotation direction, the lower end portions of the corresponding connection portion front guide and connection portion rear guide fit together with the leading end portions of the front-side movable guide 72 and the rear-side movable guide 73 so as to mesh.

When the upper unit 10 has reached the unit stowed position and stopped moving, in the switching conveying section 14 and the rear-side conveying section 18, the front-side movable guide 72 and the rear-side movable guide 73 of each of the bidirectional handover sections 40 to 44 remain fitted together with the connection portion front guide and the connection portion rear guide, and are swung to a specific angle according to the adjusted position with the conveying path connection portion, and stop swinging.

Figure 17:
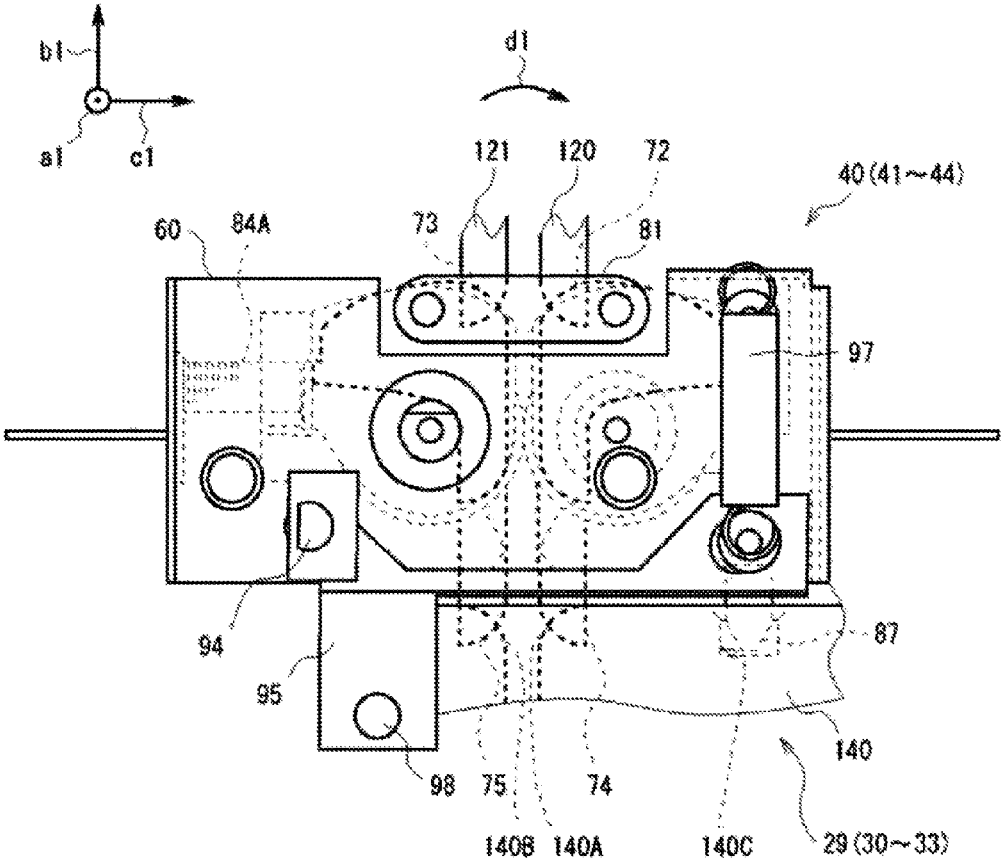
FIG. 17 is a schematic side view to accompany explanation of connection (1) of a switching conveying path and a rear-side conveying path, and a take-in conveying path, to a bidirectional handover path.

As illustrated in FIG. 17, in the stowed state of the upper unit 10 inside the device casing 2, in the switching conveying section 14 and the rear-side conveying section 18, the front-side swing guide 72 and the rear-side swing guide 73 adopt a vertical orientation when the corresponding conveying path connection portions are positioned directly above the bidirectional handover sections 40 to 44, and the leading end portions of the front-side movable guide 72 and the rear-side movable guide 73 are fitted together with the leading end portions of a connection portion front guide 120 and a connection portion rear guide 121.

Namely, in the switching conveying section 14 and the rear-side conveying section 18, in such cases, the front-side movable guide 72 and the rear-side movable guide 73 adopt a vertical orientation, the one face of the base portions of the front-side movable guide 72 and the one face of the connection portion front guide 120 are in the same plane as each other, and the one face of the base portions of the rear-side movable guide 73 and the one face of the connection portion rear guide 121 are in the same plane as each other, and the upper end portions of the bidirectional handover paths 40A to 44A are connected to the lower end portions of the connection branch portions of the switching conveying path 14A and the rear-side conveying path 18A.

Figure 18:
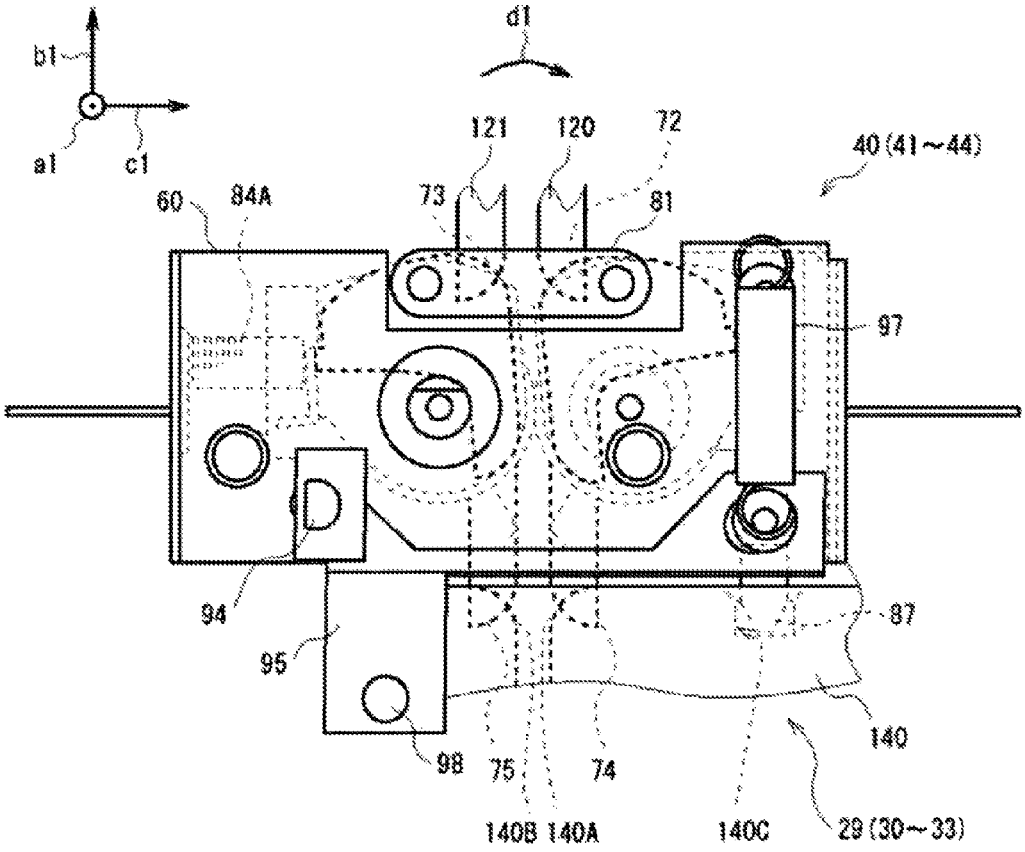
FIG. 18 is a schematic side view to accompany explanation of connection (2) of a switching conveying path and a rear-side conveying path, and a take-in conveying path, to a bidirectional handover path.

As illustrated in FIG. 18, in the switching conveying section 14 and the rear-side conveying section 18, when, in the stowed state of the upper unit 10 inside the device casing 2, the position of the corresponding conveying path connection portion is to the rear side of directly above the bidirectional handover sections 40 to 44, the front-side movable guide 72 and the rear-side movable guide 73 adopt an orientation tilted toward the rear side, and the leading end portions of the connection portion front guide 120 and the connection portion rear guide 121 are fitted together with the leading end portions of the front-side movable guide 72 and the rear-side movable guide 73.

Namely, in the switching conveying section 14 and the rear-side conveying section 18, in such cases the front-side movable guide 72 and the rear-side movable guide 73 are oriented tilted toward the rear side, and the one face of the base portions of the front-side movable guide 72 and the one face of the connection portion front guide 120 intersect with each other in a shallow V shape, and the one face of the base portions of the rear-side movable guide 73 and the one face of the connection portion rear guide 121 intersect with each other in a shallow V shape, and the upper end portion of the respective bidirectional handover path 40A to 44A is connected to the lower end portion of the respective connection branch portion of the switching conveying path 14A and the rear-side conveying path 18A.

Figure 19:
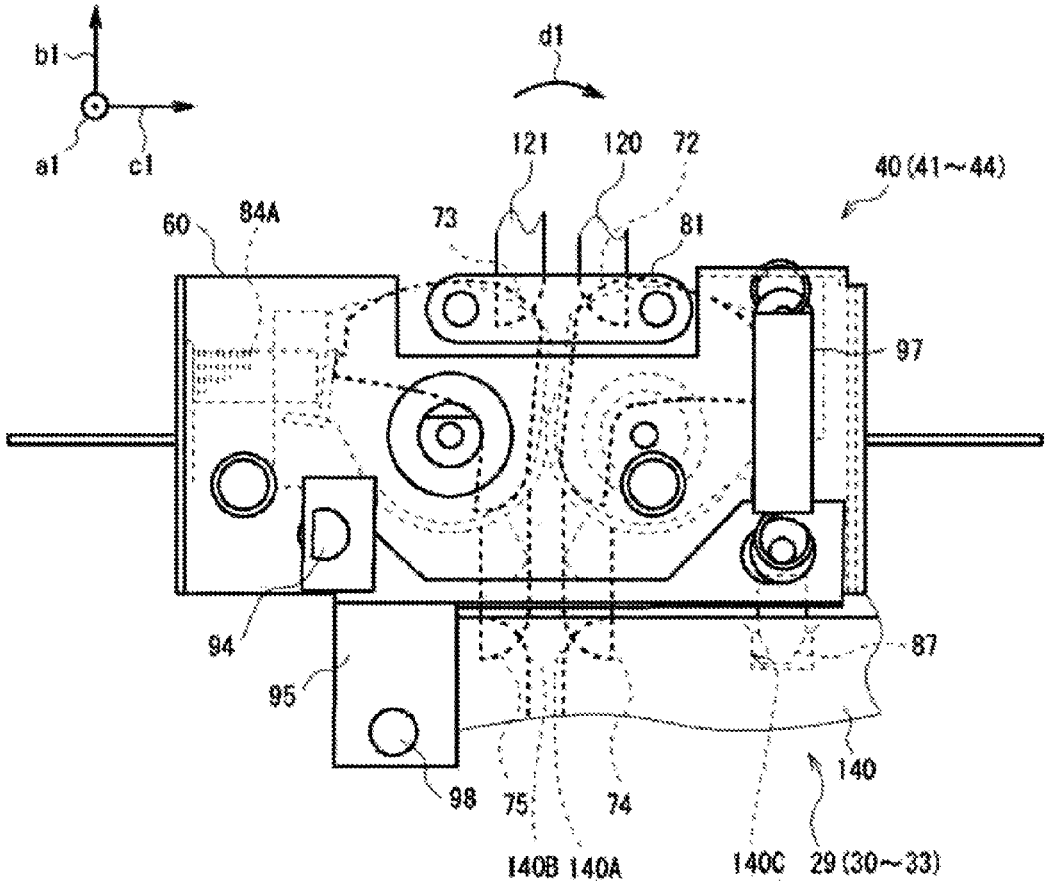
FIG. 19 is a schematic side view to accompany explanation of connection (3) of a switching conveying path and a rear-side conveying path, and a take-in conveying path, to a bidirectional handover path.

Moreover, as illustrated in FIG. 19, in the switching conveying section 14 and the rear-side conveying section 18, when, in the stowed state of the upper unit 10 inside the device casing 2, the position of the corresponding conveying path connection portion is to the front side of directly above the bidirectional handover sections 40 to 44, the front-side movable guide 72 and the rear-side movable guide 73 adopt an orientation tilted toward the front side, and the leading end portions of the connection portion front guide 120 and the connection portion rear guide 121 are fitted together with the leading end portions of the front-side movable guide 72 and the rear-side movable guide 73.

Namely, in the switching conveying section 14 and the rear-side conveying section 18, in such cases the front-side movable guide 72 and the rear-side movable guide 73 are oriented tilted toward the front side, and the one face of the base portions of the front-side movable guide 72 and the one face of the connection portion front guide 120 intersect with each other in a shallow V shape, and the one face of the base portions of the rear-side movable guide 73 and the one face of the connection portion rear guide 121 intersect with each other in a shallow V shape, and the upper end portion of the respective bidirectional handover path 40A to 44A is connected to the lower end portion of the respective connection branch portion of the switching conveying path 14A and the rear-side conveying path 18A.

Thus in the switching conveying section 14 and the rear-side conveying section 18, even in cases in which the position of the upper unit 10 is not sufficiently well adjusted in the device front-rear direction, when stowing the upper unit 10, an operator simply pushes the upper unit 10 into the device casing 2, and by pushing in and moving toward the device rear direction, it is possible to position and connect the upper end portions of the corresponding bidirectional handover paths 40A to 44A with good precision with respect to the lower end portions of the plural connection branch portions of the switching conveying path 14A and the rear-side conveying path 18A.

In the plural bidirectional handover sections 40 to 44, when this occurs, the front-side movable guide 72 and the rear-side movable guide 73 are swung while remaining parallel to each other as described above.

Thus in the bidirectional handover sections 40 to 44, even if the upper end portions of the bidirectional handover paths 40A to 44A and the lower end portions of the connection branch portions of the switching conveying path 14A and the rear-side conveying path 18A are connected together with the front-side movable guide 72 and the rear-side movable guide 73 fitted together with the connection portion front guides 120 and the connection portion rear guides 121 in a tilted orientation toward the front side or toward the rear side, it is possible to reliably prevent a step or indentation from being formed by the leading end portions and the lower end portions intruding into the connection portions.

Figure 20:
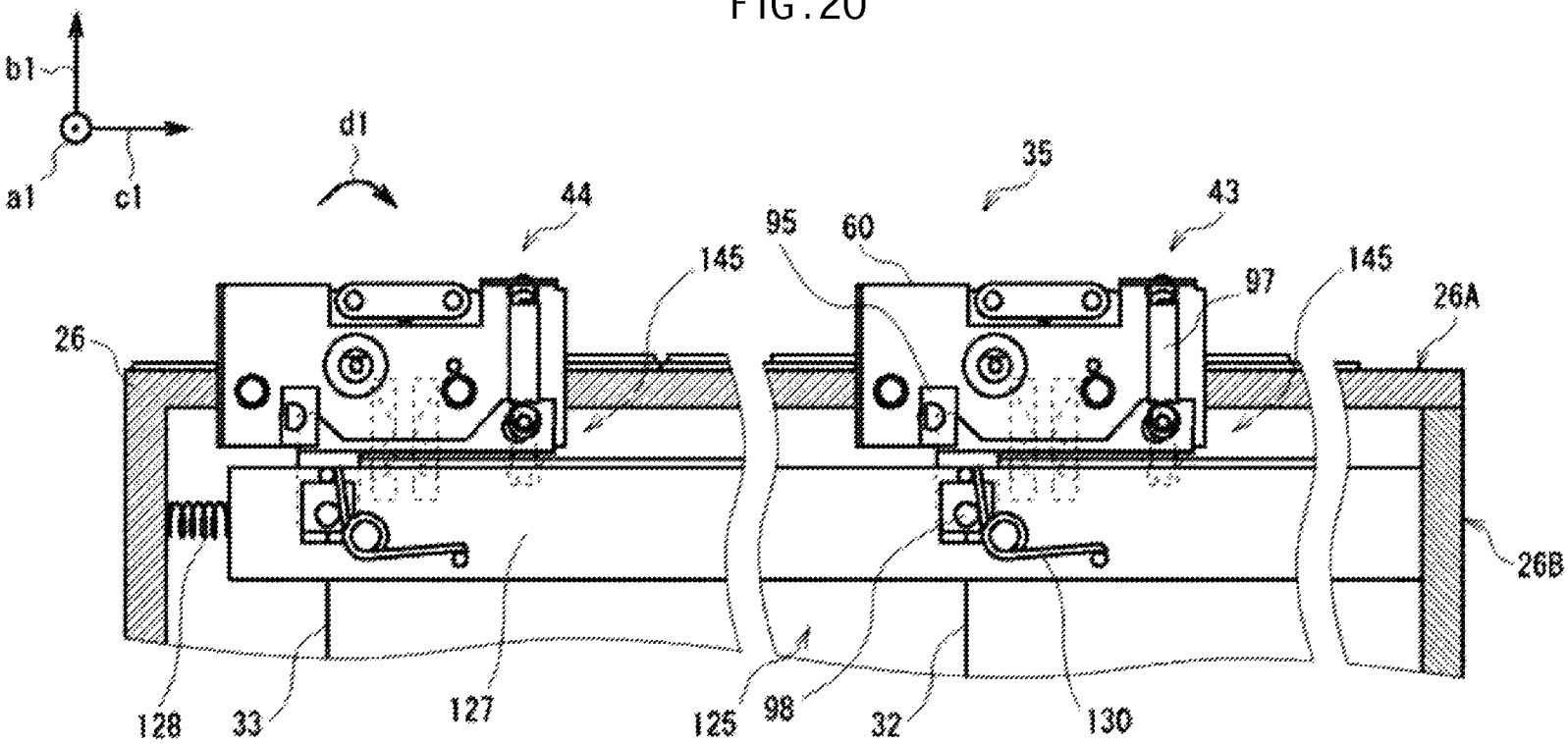
FIG. 20 is a schematic side view to accompany explanation of positioning of banknote storage boxes with respect to bidirectional handover sections.
Figure 21:
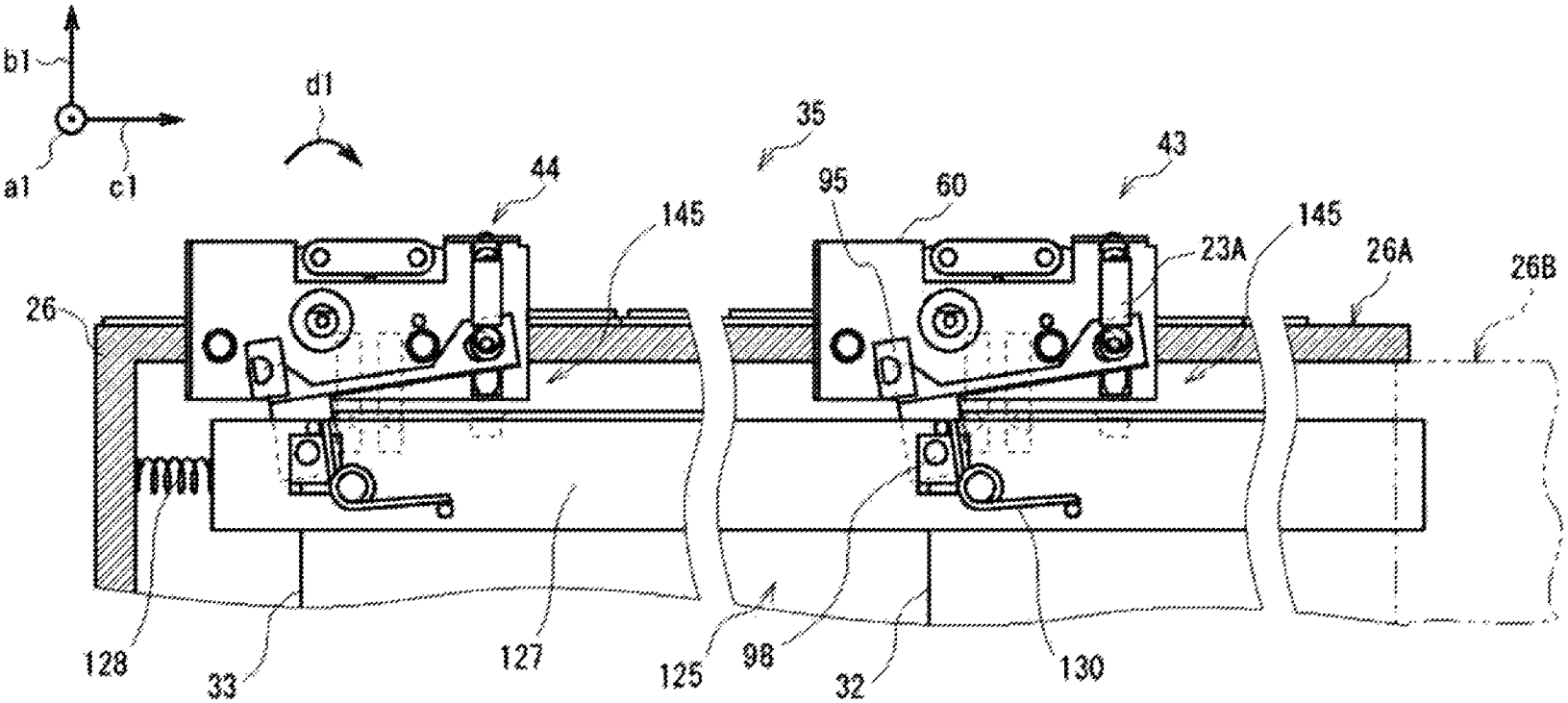
FIG. 21 is a schematic side view to accompany explanation of release of positioning of banknote storage boxes with respect to bidirectional handover sections.

However, as illustrated in FIG. 7, FIG. 20, and FIG. 21, in the coupling section 35, a insertion and retraction section 125 is provided at the right face of the case left front support section 36BX and the case left rear support section in the coupling body 36 for insertion and retraction of the left-side positioning pins 87 and the right-side positioning pins 88 of the plural bidirectional handover sections 40 to 44 into positioning holes in the banknote storage boxes 29 to 33.

The insertion and retraction section 125 includes an angular pillar shaped arm support portion 126 of a specific length (not illustrated in FIG. 20 and FIG. 21), and an angular pillar shaped movable arm 127 of a specific length that is slightly shorter than the front-to-back dimension of the safe casing 26.

In this example, the arm support portion 126 is parallel to the device front-rear direction and fixed to a specific position on the right face of the case left front support section 36BX and the case left rear support section.

In a parallel state to the arm support portion 126, the movable arm 127 is coupled to the arm support portion 126 at the top and bottom through plural coupling pins and plural coupling plates (not illustrated in FIG. 20 and FIG. 21).

Thus in the insertion and retraction section 125, a parallel link is formed by the plural connection pins and plural connection plates together with the movable arm 127, such that the movable arm 127 is movable in the front-rear direction while remaining parallel to the arm support portion 126 and displacing in the left-right direction.

In the insertion and retraction section 125, a compression coil spring 128 is disposed between a rear end of the movable arm 127 and the inner face of the rear plate of the safe casing 26, with the movable arm 127 biased by the compression coil spring 128 so as to move toward the device front direction.

Thus when the safe door 26B is closed with respect to the safe casing 26, in the insertion and retraction section 125, the front end of the movable arm 127 is pressed against a left end portion of the inner face of the safe door 26B (the hinge side where the safe door 26B is supported so as to be capable of opening and closing) while the movable arm 127 is being biased so as to move toward the front side due to the compression coil spring 128.

When the safe door 26B is opened with respect to the safe casing 26, in the insertion and retraction section 125, the movable arm 127 is moved toward the front side by the compression coil spring 128, and the leading end portion of the movable arm 127 is projected out from inside the safe casing 26 to the front side.

An opening and closing handle 129 (FIG. 2) is attached to the front face of the safe door 26B for gripping and rotation operation by hand when opening and closing the safe door 26B.

A latch (not illustrated in the drawings) that displaces coupled to such rotation is attached to the opening and closing handle 129.

Thus in the safe casing 26, when the safe door 26B is closed and the opening and closing handle 129 is rotationally operated, the latch engages with a specific engagement position in the safe casing 26, and the closed state of the safe door 26B can be maintained.

A lock (namely, a cylinder lock or a dial lock) is, for example, also attached to the front face of the safe door 26B, to lock the closed state of the safe door 26B with respect to the safe casing 26 by fixing the latch engaged with the engagement position such that the latch cannot be temporarily displaced.

Thus in the safe casing 26, while the safe door 26B is closed and the latch is engaged with the engagement position, the movable arm 127 can be held inside irrespective of whether the safe door 26B is locked or unlocked.

In the safe casing 26, when the opening and closing handle 129 is rotationally operated when the safe door 26B is closed but the lock is in a released state (namely, a state in which the latch is engaged with the specific engagement position in the safe casing 26), the latch is retracted from the engagement position, enabling the safe door 26B to be opened.

Thus in the safe casing 26, while the safe door 26B is open, the movable arm 127 is moved by the action of the compression coil spring 128 toward the front side, such that the leading end portion of the movable arm 127 projects out from inside the safe casing 26 to the front side.

A right face of the movable arm 127 is provided with square shaped pin insertion holes, having a horizontal width and a vertical width that are longer than the diameter of the coupling pin 98, at positions facing respectively toward the coupling pins 98 provided to the left-side raising/lowering control levers 95 of the plural bidirectional handover sections 40 to 44.

The leading end portions of the coupling pins 98 corresponding to the respective plural pin insertion holes are inserted into the movable arm 127 from the right face side, and project out from the left face.

Moreover, spring pressing portions and spring anchor portions are provided on the left face of the movable arm 127 so as to project out to the upper side and front side of the respective plural pin insertion holes.

Respective torsion springs 130 in a somewhat compressed state are provided on the left face of the movable arm 127 at the front side of the plural pin insertion holes, with one end portion of each of the torsion springs 130 anchored to the respective spring anchor portion and the other end portion pressing against the spring pressing portion from the front side.

Figure 22:
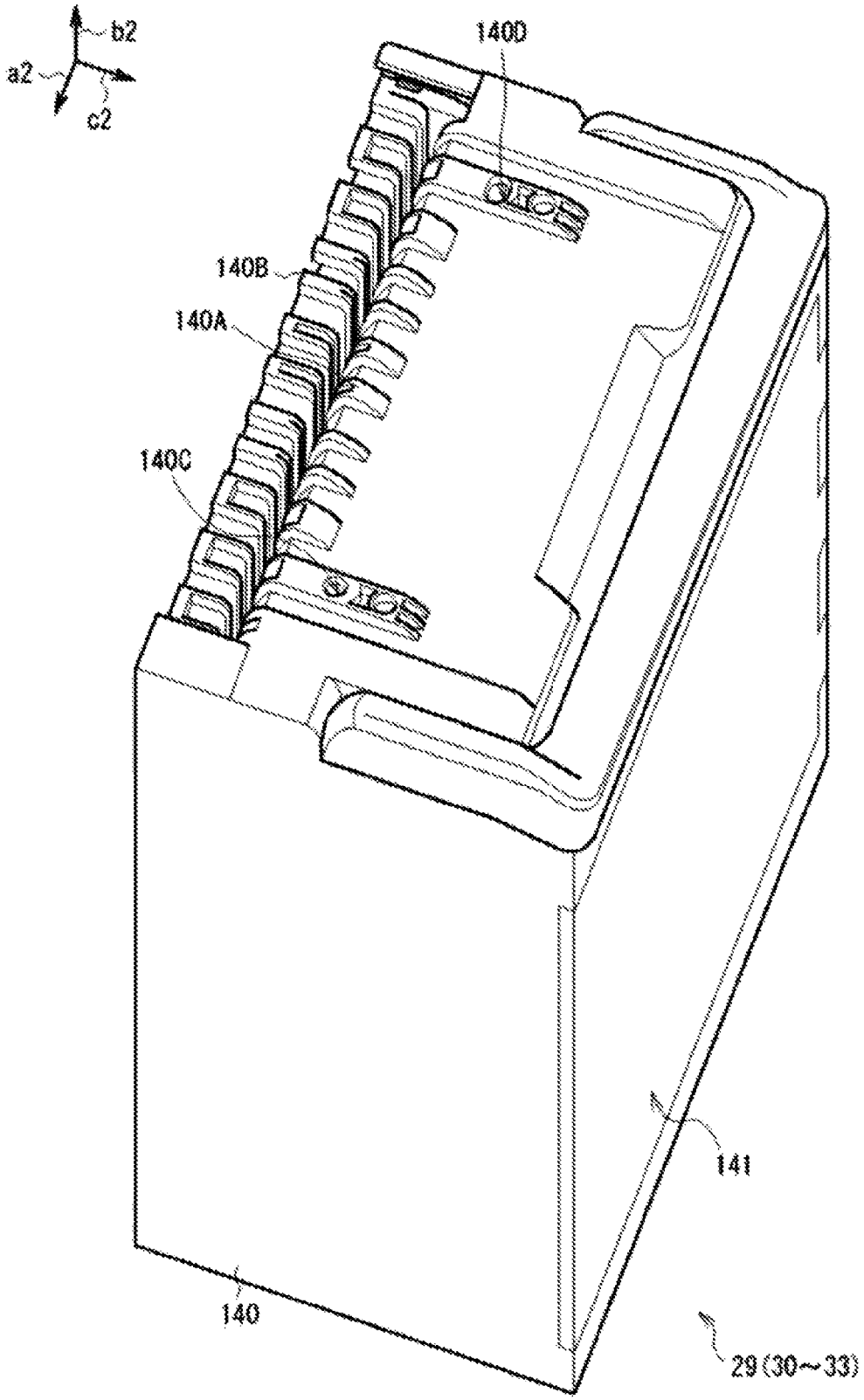
FIG. 22 is a schematic perspective view illustrating a configuration of a banknote storage box.

Explanation next follows regarding configuration of the plural banknote storage boxes 29 to 33 with reference to FIG. 22. The plural banknote storage boxes 29 to 33 each have similar configurations.

The configuration of one banknote storage box, that of the banknote storage box 29, will accordingly be explained, and explanation regarding the configurations of the other plural banknote storage boxes 30 to 33 will be omitted.

The banknote storage box 29 includes, for example, an external case 140 formed in a substantially rectangular box shape that is long in the up-down direction. A door (also referred to below as a storage box door) 141 is provided on the front face of the external case 140 so as to be openable and closeable.

In the following explanation, when the banknote storage box 29 is viewed facing toward the front face of the external case 140, the left direction indicated by the arrow a2 in the drawings is also referred to as the storage box left direction, and the opposite direction thereto is also referred to as the storage box right direction.

In the following explanation, unless there is a particular need to discriminate between the storage box left direction and the storage box right direction, these are also referred to collectively as the storage box left-right direction.

In the following explanation, when the banknote storage box 29 is viewed facing toward the front face of the external case 140, the upward direction indicated by the arrow b2 in the drawings is also referred to as the storage box upward direction, and the opposite direction thereto is also referred to as the storage box downward direction.

In the following explanation, unless there is a particular need to discriminate between the storage box upward direction and the storage box downward direction, these are also referred to collectively as the storage box up-down direction.

In the following explanation, when the banknote storage box 29 is viewed facing toward the front face of the external case 140, the nearside direction indicated by the arrow c2 in the drawings is also referred to as the storage box front direction, and the opposite direction thereto is also referred to as the storage box rear direction.

In the following explanation, unless there is a particular need to discriminate between the storage box front direction and the storage box rear direction, these are also referred to collectively as the storage box front-rear direction.

In this example, pairs of parallel conveying guides 140A, 140B are integrally formed to a rear end portion on the top face of the external case 140, such that mutual one face thereof are vertical and positioned to the front and rear of each other.

In the following explanation, out of the pairs of conveying guides 140A, 140B integrally formed to the top face of the external case 140, the one set of the conveying guides 140A positioned on the front side are referred to as the storage box front guides 140A, and the other set of the conveying guides 140B positioned on the rear side are referred to as the storage box rear guides 140B.

Plural conveying rollers are disposed inside the external case 140 so as to correspond to the storage box front guides 140A and the storage box rear guides 140B.

Thus in the banknote storage box 29, the upper end portion of the take-in/feed-out conveying path 29AX between the storage box front guides 140A and the storage box rear guides 140B is formed with a conveying path cross-width and a conveying path thickness-width that are equivalent to the handover path cross-width and the handover path thickness-width of the plural bidirectional handover sections 40 to 44, enabling banknotes to be conveyed toward the upper side or the lower side along a conveying direction parallel to the storage box up-down direction.

Namely, in the banknote storage box 29, the upper end portion of the take-in/feed-out conveying path 29AX is formed between the storage box front guides 140A and the storage box rear guides 140B, with the length of the storage box front guides 140A and the storage box rear guides 140B in the device left-right direction as the conveying path cross-width equivalent to the handover path cross-width, and with the separation between the storage box front guides 140A and the storage box rear guides 140B as the conveying path thickness-width equivalent to the handover path thickness-width.

Respective upper end portions of the storage box front guides 140A and the storage box rear guides 140B are formed in comb tooth shapes running along the storage box left direction, and the upper end portion of each of the storage box front guides 140A and each of the storage box rear guides 140B is formed with an arc shape such that the mutual separation between the respective one face thereof gradually widens on progression upward from below.

Moreover, a circular shaped left-side positioning hole 140C of a specific depth is, for example, also formed on the top face of the external case 140, to the front side and toward the left of the storage box front guides 140A, so as to correspond to the left-side positioning pin 87 of the bidirectional handover section 40.

The internal diameter of a bottom portion of the left-side positioning hole 140C is set so as to be substantially the same length as the diameter of the left-side positioning pin 87.

The left-side positioning hole 140C is formed in a funnel shape such that the internal diameter of the left-side positioning hole 140C widens, to wider than the bottom portion, around the circumference of a pin inlet.

Moreover, an oval shaped right-side positioning hole 140D of a specific depth is also formed on the top face of the external case 140, to the front side and toward the right of the storage box front guides 140A, so as to correspond to the right-side positioning pin 88 of the bidirectional handover section 40. The length direction of the right-side positioning hole 140D is parallel to the storage box left-right direction.

The width in the front-rear direction of the bottom portion of the right-side positioning hole 140D is set to be substantially the same length as the diameter of the right-side positioning pin 88, and the width in the left-right direction of the bottom portion is set to be a specific length longer than the diameter of the right-side positioning pin 88.

The right-side positioning hole 140D is formed in a substantially funnel shape such that the width of the right-side positioning hole 140D in the front-rear and left-right direction widens, to wider than the bottom portion around the circumference of a pin inlet.

The banknote storage box 29, and the other banknote storage boxes 30 to 33 of similar configuration, are loaded into the storage box loading case 27, for example, in a state in which the front face of the external case 140 faces toward the front side.

The left-side positioning pins 87, the right-side positioning pins 88, the left-side positioning holes 140C and the right-side positioning holes 140D provided to the plural bidirectional handover sections 40 to 43 and the plural banknote storage boxes 29 to 33 configure a positioning section 145 (FIG. 20 and FIG. 21) that functions to position for connection of the lower end portions of the plural bidirectional handover paths 40A to 43A to the upper end portions of the plural take-in/feed-out conveying paths 29AX to 33AX when the plural banknote storage boxes 29 to 33 are housed in the safe casing 26, together with the storage box loading case 27.

In the following explanation, the positioning section 145 that is configured from the left-side positioning pins 87 and the right-side positioning pins 88, and the left-side positioning hole 140C and the right-side positioning hole 140D provided to the plural bidirectional handover sections 40 to 43 and the plural banknote storage boxes 29 to 33, is also referred to below as the lower-side positioning section 145.

Due to the configuration of the plural bidirectional handover sections 40 to 44 (FIG. 20 and FIG. 21), when the safe door 26B is open with respect to the safe casing 26, the left-side raising/lowering control lever 95 and the right-side raising/lowering control lever 96 are swung in the other rotation direction as described below, and the left-side positioning pin 87 and the right-side positioning pin 88 are housed inside the frame 60A of the handover section case 60.

From such a state of the bidirectional handover sections 40 to 44, when the storage box loading case 27 loaded with the plural banknote storage boxes 29 to 33 is stowed as far as a specific case stowing position inside the safe casing 26, the lower end portions of the front-side fixed guide 74 and the rear-side fixed guide 75 fit together with the upper end portions of the storage box front guides 140A and the storage box rear guides 140B of the corresponding banknote storage boxes 29 to 33, so as to mesh together.

When this occurs, the plural bidirectional handover sections 40 to 44 are position-adjusted at high precision with respect to the device front-rear direction of the storage box loading case 27, and as illustrated in FIG. 17, the one face of arm portions of the front-side fixed guides 74 and the one face of storage box front guides 140A of the corresponding banknote storage box 29 to 33 are placed in the same plane as each other, the one face of the arm portions of the rear-side fixed guides 75 and the one face of the storage box rear guides 140B of the corresponding banknote storage box 29 to 33 are placed in the same plane as each other, thereby connecting the lower end portions of the bidirectional handover paths 40A to 44A and the upper end portions of the take-in/feed-out conveying paths 29AX to 33AX in a state in which there is no step present within the connection portions.

However, when the plural bidirectional handover sections 40 to 44 are not sufficiently well position-adjusted in the device front-rear direction with respect to the storage box loading case 27, the lower end portions of the bidirectional handover paths 40A to 44A connect to the upper end portions of the take-in/feed-out conveying paths 29AX to 33AX so as to form a step within the connection portions, due to the storage box front guides 140A and the storage box rear guides 140B of the banknote storage boxes 29 to 33 being positioned displaced toward the front side or the rear side with respect to the front-side fixed guide 74 and the rear-side fixed guide 75.

Thus in the insertion and retraction section 125, in a loaded state of the storage box loading case 27 loaded with the plural banknote storage boxes 29 to 33 in the safe casing 26, when the safe door 26B that has hitherto been open with respect to the safe casing 26 is then closed, the front end of the movable arm 127 is pressed by the inner face of the safe door 26B, and the movable arm 127 is moved toward the device rear direction.

When this occurs, in the insertion and retraction section 125, as the movable arm 127 is being moved, the other end portions of the torsion springs 130 corresponding to the respective leading end portions of the coupling pins 98 of the plural bidirectional handover sections 40 to 44 are pressed against the left face side of the movable arm 127.

Thus in the insertion and retraction section 125, the left-side raising/lowering control levers 95 and the right-side raising/lowering control levers 96 are rotated in the one rotation direction while the respective coupling pins 98 in the plural bidirectional handover sections 40 to 44 are being displaced toward the rear side, lowering the left-side positioning pin 87 and the right-side positioning pin 88.

Thereby in the insertion and retraction section 125, the left-side positioning pins 87 and the right-side positioning pins 88 of the plural bidirectional handover sections 40 to 44 are inserted all at once into the left-side positioning holes 140C and the right-side positioning holes 140D of the corresponding banknote storage boxes 29 to 33.

When doing so, the position of the storage box loading case 27 is adjusted with high precision with respect to the device front-rear direction, and the centers of the left-side positioning holes 140C and the centers of the right-side positioning holes 140D of the corresponding banknote storage boxes 29 to 33 are positioned directly below the centers of the left-side positioning pins 87 and directly below the centers of the right-side positioning pins 88 of the plural bidirectional handover sections 40 to 44.

Thus in such a case, the insertion and retraction section 125 enables the left-side positioning pins 87 and the right-side positioning pins 88 of the plural bidirectional handover sections 40 to 44 to be inserted into the left-side positioning holes 140C and the right-side positioning holes 140D without specifically positioning the corresponding banknote storage boxes 29 to 33.

However, when the position of the storage box loading case 27 is not sufficiently well adjusted with respect to the device front-rear direction, then the centers of the left-side positioning holes 140C and the centers of the right-side positioning holes 140D of the corresponding banknote storage boxes 29 to 33 are displaced to the front side or to the rear side, with respect to directly below the centers of the left-side positioning pins 87 and directly below the centers of the right-side positioning pins 88 of the plural bidirectional handover sections 40 to 44.

However, the respective leading end portions of the left-side positioning pins 87 and the right-side positioning pins 88 are formed in a tapered shape as described above.

The left-side positioning holes 140C and the right-side positioning holes 140D are also respectively formed with funnel shaped pin inlets as described above.

Thus the insertion and retraction section 125 is able to insert the left-side positioning pins 87 into the left-side positioning holes 140C while changing the position and orientation of the banknote storage boxes 29 to 33 such that the centers of the left-side positioning holes 140C are pulled to directly below the centers of the left-side positioning pins 87, even in cases in which the centers of the left-side positioning holes 140C of the corresponding banknote storage boxes 29 to 33 are displaced toward the front side or the rear side, with respect to directly below the centers of the left-side positioning pins 87 of the plural bidirectional handover sections 40 to 44.

The insertion and retraction section 125 is also able to insert the right-side positioning pins 88 into the right-side positioning holes 140D while similarly changing the position and orientation of the banknote storage boxes 29 to 33 such that the centers of the right-side positioning holes 140D are pulled to directly below the centers of the right-side positioning pins 88, even in cases in which the centers of the right-side positioning holes 140D of the corresponding banknote storage boxes 29 to 33 are displaced toward the front side or the rear side, with respect to directly below the centers of the right-side positioning pins 88 of the plural bidirectional handover sections 40 to 44.

The insertion and retraction section 125 is thereby able to position the corresponding banknote storage boxes 29 to 33 with respect to the plural bidirectional handover sections 40 to 44.

Thus when positioning has been performed by changing the position and the orientation of the corresponding banknote storage boxes 29 to 33 with respect to the plural bidirectional handover sections 40 to 44 in this manner, the insertion and retraction section 125 is also able to perform accompanying correction of positional misalignment of the storage box front guides 140A and the storage box rear guides 140B with respect to the front-side fixed guide 74 and the rear-side fixed guide 75.

Namely, the insertion and retraction section 125 corrects positional misalignment so as to place the one face of the arm portions of the front-side fixed guides 74 and the one face of the storage box front guides 140A in the same plane as each other, and to place the one face of the arm portions of the rear-side fixed guides 75 and the one face of the storage box rear guides 140B in the same plane as each other, enabling the state of the lower end portions of the bidirectional handover paths 40A to 44A and the upper end portions of the take-in/feed-out conveying paths 29AX to 33AX to be changed to a state in which there is no step within the connection portions.

Thus even in cases in which the position of the storage box loading case 27 is not sufficiently well adjusted with respect to the device front-rear direction, the insertion and retraction section 125 is still capable of positioning with good precision and connecting together the upper end portions of the take-in/feed-out conveying paths 29AX to 33AX of the corresponding banknote storage boxes 29 to 33 with respect to the lower end portions of the bidirectional handover paths 40A to 44A of the plural bidirectional handover sections 40 to 44, merely by an operator closing the safe door 26B of the safe casing 26 when stowing the storage box loading case 27.

When the safe door 26B of the safe casing 26 is opened in order to pull out the storage box loading case 27, in response thereto, the insertion and retraction section 125 moves the movable arm 127 toward the device front direction by the action of the compression coil spring 128.

When this occurs, in the insertion and retraction section 125, the rear face inside the plural pin insertion holes in the movable arm 127 press against the coupling pins 98 that are inserted into the respective pin insertion holes while the movable arm 127 is being moved.

Thus the insertion and retraction section 125 swings the left-side raising/lowering control levers 95 and the right-side raising/lowering control levers 96 in the other rotation direction while displacing the respective coupling pins 98 toward the front side in the plural bidirectional handover sections 40 to 44, and raises the left-side positioning pins 87 and the right-side positioning pins 88.

The insertion and retraction section 125 accordingly pulls the left-side positioning pins 87 and the right-side positioning pins 88 of the plural bidirectional handover sections 40 to 44 out from the left-side positioning holes 140C and the right-side positioning holes 140D of the corresponding banknote storage boxes 29 to 33, all at once.

In the insertion and retraction section 125, when the left-side positioning pins 87 and the right-side positioning pins 88 have been pulled out from the left-side positioning holes 140C and the right-side positioning holes 140D in this manner, following on from the pull-out point, the left-side raising/lowering control levers 95 and the right-side raising/lowering control levers 96 are further swung in the other rotation direction by the action of the pairs of coil springs 97, 99 for each of the plural bidirectional handover sections 40 to 44, and the left-side positioning pins 87 and the right-side positioning pins 88 are raised and stored inside the frame 60A of the handover section case 60.

Thus when pulling out the storage box loading case 27, the insertion and retraction section 125 is capable of pulling the left-side positioning pins 87 and the right-side positioning pins 88 of the corresponding bidirectional handover sections 40 to 44 out from the left-side positioning holes 140C and the right-side positioning holes 140D of the plural banknote storage boxes 29 to 33 all at once, simply by opening the safe door 26B of the safe casing 26 to pull out the storage box loading case 27, without the operator performing a specific separate operation to pull the respective left-side positioning pins 87 and the right-side positioning pins 88 of the plural bidirectional handover sections 40 to 44 out from the left-side positioning holes 140C and the right-side positioning holes 140D of the plural banknote storage boxes 29 to 33.

A certain amount of force is required in order to open or close the safe door 26B of the safe casing 26 due to the comparatively heavy weight from being formed from comparatively thick metal plate.

The compression coil spring 128 with comparatively large resilient force is provided in the insertion and retraction section 125 in order to bias the movable arm 127 toward the front side.

When, during pulling out of the storage box loading case 27, the opening and closing handle 129 is rotationally operated in order to open the safe door 26B of the safe casing 26 and the latch is retracted from the engagement position with the inside of the safe casing 26, at this point in time, the insertion and retraction section 125 is capable of pushing the safe door 26B toward the front side so as to slightly open the safe door 26B using the movable arm 127 under the action of the compression coil spring 128 (namely the safe door 26B is moved slightly away from the safe casing 26).

The insertion and retraction section 125 is thereby able to reduce the burden on the operator when opening the safe door 26B with respect to the safe casing 26.

Moreover, in the insertion and retraction section 125, the movable arm 127 is provided so as to move in the front-rear direction as described above using a parallel link mechanism.

Thus when the safe door 26B is being closed with respect to the safe casing 26, the insertion and retraction section 125 is capable of preventing the movable arm 127 from deforming or being damaged due to pressing force in a rotation direction imparted by the safe door 26B, even though the movable arm 127 is pressed by the inner face of the safe door 26B rotating about the hinge.

The plural bidirectional handover paths 40A to 44A, the lower end portions of the plural connection branch portions of the corresponding switching conveying path 14A and the rear-side conveying path 18A, and the plural take-in/feed-out conveying paths 29AX to 33AX need to be mutually positioned and connected together with good precision in order to convey banknotes in both directions, the device downward direction and the device upward direction.

Hence by adopting the configuration described above, high precision positioning is accordingly realized during connection for the plural bidirectional handover paths 40A to 44A, for the lower end portions of the plural connection branch portions of the corresponding switching conveying path 14A and the rear-side conveying path 18A, and for the plural take-in/feed-out conveying paths 29AX to 33AX.

In contrast thereto, since reject banknotes are only conveyed in one direction, the device downward direction, reject banknotes can be conveyed without problems on the unidirectional handover path 39A, on the lower end portion of the connection branch portion at the single location of the corresponding switching conveying path 14A, and on the take-in conveying path 28AX, even if connected without as high precision positioning being performed as when conveying banknotes in both directions.

Thus in the switching conveying section 14, even though the lower end portion of the connection branch portion is formed similarly to the other conveying path connection portions at the single conveying path connection portion corresponding to the unidirectional handover section 39, the unidirectional handover section 39 is configured differently to the plural bidirectional handover sections 40 to 44.

Namely, as illustrated in FIG. 3 and FIG. 7, in the unidirectional handover section 39, for example, a pair of handover guides 151, 152 that each have a substantially angular C-shaped cross section of a specific length of the length of the long side of the banknotes or greater, are fixed inside a handover section casing 150 with one positioned on the front side and one positioned on the rear side, such that one face of each face each other.

In the following explanation, the one handover guide 151 that is positioned at the front side in the unidirectional handover section 39 is also referred to as the unidirectional front-side guide 151, and the other handover guide 152 that is positioned at the rear side is also referred to as the unidirectional rear-side guide 152.

In this example, the one face of each of the unidirectional front-side guide 151 and the unidirectional rear-side guide 152 are sloped, and are disposed such that the mutual separation in between gradually becomes narrower on progression from above to below.

Upper end portions and lower end portions of the unidirectional front-side guide 151 and the unidirectional rear-side guide 152 are formed with respective comb tooth shapes running along the device left direction.

Moreover, in the unidirectional handover section 39, a pair of conveying rollers are disposed inside the unidirectional front-side guide 151 so as to be rotatable through a roller shaft parallel to the device left-right direction. One portion of the circumferential-side faces of the pair of conveying rollers projects toward the rear side though corresponding holes provided in the unidirectional front-side guide 151.

Moreover, in the unidirectional handover section 39, a pair of conveying rollers are disposed inside the unidirectional rear-side guide 152 so as to be rotatable through a roller shaft parallel to the device left-right direction. One portion of the circumferential-side faces of the pair of conveying rollers projects toward the front side though corresponding holes provided in the unidirectional rear-side guide 152.

In the unidirectional handover section 39, the rear side of the circumferential-side faces of the pair conveying rollers of the unidirectional front-side guide 151, and the front side of the circumferential-side faces of the pair of conveying rollers of the unidirectional rear-side guide 152 are pressed against each other between the unidirectional front-side guide 151 and the unidirectional rear-side guide 152.

Thus in the unidirectional handover section 39, although the unidirectional handover path 39A is formed with a handover path cross-width between the unidirectional front-side guide 151 and the unidirectional rear-side guide 152 similar to that in the plural bidirectional handover sections 40 to 44, the handover path thickness-width thereof gradually gets narrower from above to below.

A left-side drive transfer section 155, including a gear, a drive pulley, a drive belt, and the like, is disposed in the unidirectional handover section 39 at the left side of a handover section casing 150.

Thus in the unidirectional handover section 39, when the upper unit 10 is stowed in the device casing 2, a drive transfer gear provided to the switching conveying section 14 is coupled to the gear of the left-side drive transfer section 155.

Thereby in the unidirectional handover section 39, drive force of a drive motor transferred from the switching conveying section 14 though the drive transfer gear during pay-in or pay-out is received by the gear in the left-side drive transfer section 155, and rotation of the gear is transmitted, through the drive pulley and the drive belt, to the drive pulley of its own handover section casing 150, rotating the roller shaft.

Thus even though there is no specific drive motor provided in the unidirectional handover section 39, reject banknotes can still be conveyed by driving the unidirectional handover path 39A during pay-in or pay-out.

In the thus configured unidirectional handover section 39, when the upper unit 10 is being stowed inside the device casing 2, the upper end portions of the unidirectional front-side guide 151 and the unidirectional rear-side guide 152 fit together with the lower end portions of the connection portion front guide and the connection portion rear guide of the conveying path connection portion corresponding to the switching conveying section 14, connecting the upper end portion of the unidirectional handover path 39A to the lower end portion of the corresponding connection branch portion of the switching conveying path 14A.

Note that in the unidirectional handover section 39, the separation between the upper end portions of the unidirectional front-side guide 151 and the unidirectional rear-side guide 152 (namely, the handover path thickness-width of the upper end portion of the unidirectional handover path 39A) is set so as to be wider than the separation between the connection portion front guide and the connection portion rear guide of the switching conveying section 14 (namely, the conveying path thickness-width of the lower end portion of the connection branch portion corresponding to the switching conveying path 14A).

Thus in the unidirectional handover section 39, the reject banknotes fed out from the lower end portion of the connection branch portion of the switching conveying path 14A can be received by the upper end portion of the unidirectional handover path 39A, and conveying continued, even if the center of the conveying path thickness-width of the lower end portion of the connection branch portion corresponding to the switching conveying path 14A is displaced to the front or rear from the center of the handover path thickness-width of the upper end portion of the unidirectional handover path 39A.

The reject box 28 includes an external case 157, and a pair of conveying guides 157A (only one is illustrated in the drawings, the other is not illustrated in the drawings) integrally formed to a rear end portion of the top face of the external case 157 such that one face of each is positioned to the front and rear, facing each other.

In the following explanation, from out of the pair of conveying guides 157A integrally formed to the top face of the external case 157, the one conveying guide 157A that is positioned at the front side is also referred to as the reject box front guide 157A, and the other conveying guide that is positioned at the rear side is also referred to as the reject box rear guide.

In this example, the reject box front guide 157A and the reject box rear guide are, for example, formed such that a mutual separation between the one faces of each gradually becomes narrower on progression from above to below.

The upper end portions of the reject box front guide 157A and the reject box rear guide are each formed with comb tooth shapes running along the respective device left direction.

Plural conveying rollers corresponding to the reject box front guide 157A and the reject box rear guide, and a gear 158 coupled to the conveying rollers, and the like are also disposed inside the external case 157.

Thus in the reject box 28, although there is a conveying path cross-width between the reject box front guide 157A and the reject box rear guide equivalent to the handover path cross-width, the upper end portion of the take-in conveying path 28AX is formed such that the conveying path thickness-width gradually becomes narrower on progression from above to below.

Namely, in the reject box 28, although between the reject box front guide 157A and the reject box rear guide the upper end portion of the take-in conveying path 28AX is formed with a conveying path cross-width along the device left-right direction of the reject box front guide 157A and the reject box rear guide equivalent to the handover path cross-width length, the separation between the reject box front guide 157A and the reject box rear guide is a conveying path thickness-width that, unlike the handover path thickness-width, gradually becomes narrower on progression from above to below.

The reject box 28 is configured without providing an internal drive motor. Therefore a right-side drive transfer section 159 including a gear, a drive pulley, a drive belt and the like is disposed in the unidirectional handover section 39 at the right side of the handover section casing 150. The right-side drive transfer section 159 is coupled to the left-side drive transfer section 155 through a roller shaft.

A cutaway portion is formed to the reject box 28 at a right end portion on the top face of the external case 157, through which the internal gear 158 is exposed.

In the unidirectional handover section 39, during pulling out, or stowing of the storage box loading case 27, the gear of the right-side drive transfer section 159 is lifted up by a specific operation, thereby avoiding the gear from impeding pulling out, or impeding stowing, of the storage box loading case 27.

In the unidirectional handover section 39, in the stowed state of the storage box loading case 27 in the safe casing 26, the gear of the right-side drive transfer section 159 is lowered by a specific operation, and meshed with the gear 158 of the reject box 28.

Thus in the unidirectional handover section 39, rotation of the gear of the right-side drive transfer section 159 is transmitted to the reject box 28 during pay-in or pay-out, enabling the conveying rollers in the reject box 28 to be rotated to take in the reject banknotes.

In the thus configured unidirectional handover section 39, when the storage box loading case 27 loaded with the plural banknote storage boxes 29 to 33 and the reject box 28 is loaded into the safe casing 26, the lower end portions of the unidirectional front-side guide 151 and the unidirectional rear-side guide 152 are fitted together with the upper end portions of the reject box front guide 157A and the reject box rear guide of the reject box 28, and the lower end portion of the unidirectional handover path 39A is connected to the lower end portion of the take-in conveying path 28AX.

Note that, in the reject box 28, the separation between the upper end portions of the reject box front guide 157A and the reject box rear guide (namely, the conveying path thickness-width of the upper end portion of the take-in conveying path 28AX) is set so as to be wider than the separation between the lower end portions of the unidirectional front-side guide 151 and the unidirectional rear-side guide 152 (namely, the handover path thickness-width of the lower end portion of the unidirectional handover path 39A).

The unidirectional handover section 39 is accordingly able to convey reject banknotes fed out from the lower end portion of the unidirectional handover path 39A so as to be passed across to the upper end portion of the take-in conveying path 28AX, even if the center of the handover path thickness-width of the lower end portion of the unidirectional handover path 39A is displaced to the front or rear from the center of the conveying path thickness-width of the upper end portion of the take-in conveying path 28AX.

Accordingly, in cases in which there is insufficient positional adjustment with respect to the device front-rear direction of the upper unit 10, and/or the storage box loading case 27, the unidirectional handover section 39 is still able to hand over reject banknotes being conveyed by the switching conveying path 14A, into the take-in conveying path 28AX, even when connected without the upper end portion and the lower end portion of the unidirectional handover path 39A being specifically positioned with respect to the lower end portion of the connection branch portion corresponding to the switching conveying path 14A and the upper end portion of the take-in conveying path 28AX, respectively.

The coupling section 35 couples the switching conveying section 14 and the rear-side conveying section 18 to the reject box conveying section 28A and the plural storage box conveying sections 29A to 33A through the unidirectional handover section 39 and the plural bidirectional handover sections 40 to 44 as described above.

Namely, for the plural bidirectional handover sections 40 to 44, the coupling section 35 positions with respect to the conveying path connection portions corresponding to the switching conveying section 14 and the rear-side conveying section 18 before connecting the upper end portions of the bidirectional handover paths 40A to 44A to the lower end portions of the connection branch portions corresponding to the switching conveying path 14A and the rear-side conveying path 18A, such that there are no steps present.

Moreover, for the plural bidirectional handover sections 40 to 44, the coupling section 35 positions the storage box conveying sections 29A to 33A of the plural banknote storage boxes 29 to 33 with respect to the plural bidirectional handover sections 40 to 44 before the lower end portions of the bidirectional handover paths 40A to 44A are connected to the upper end portions of the corresponding take-in/feed-out conveying paths 29AX to 33AX such that there are no steps present.

Moreover, for the unidirectional handover section 39, the coupling section 35 adopts a structure that is capable of accommodating positional displacement to the conveying path connection portion corresponding to the switching conveying section 14 (namely, the handover path thickness-width at the upper end portion of the unidirectional handover path 39A gradually narrows from above to below), and connects the upper end portion of the unidirectional handover path 39A to the lower end portion of the connection branch portion corresponding to the switching conveying path 14A.

Moreover, a structure is adopted in the reject box 28 that is capable of accommodating positional displacement of the reject box conveying section 28A to the unidirectional handover section 39 (namely, the conveying path thickness-width of the upper end portion of the take-in conveying path 28AX gradually narrows from above to below).

The thus configured coupling section 35 connects the lower end portion of the unidirectional handover path 39A to the upper end portion of the take-in conveying path 28AX.

The coupling section 35 accordingly prevents jams (namely, banknote blocks) from occurring when reject banknotes and pay-in/pay-out banknotes are being conveyed by the unidirectional handover section 39 and the plural bidirectional handover sections 40 to 44 so as to be handed over between the switching conveying section 14 and the rear-side conveying section 18 and the reject box conveying section 28A and the plural storage box conveying sections 29A to 33A.

1-4 Configuration of Upper Unit

Figure 23:
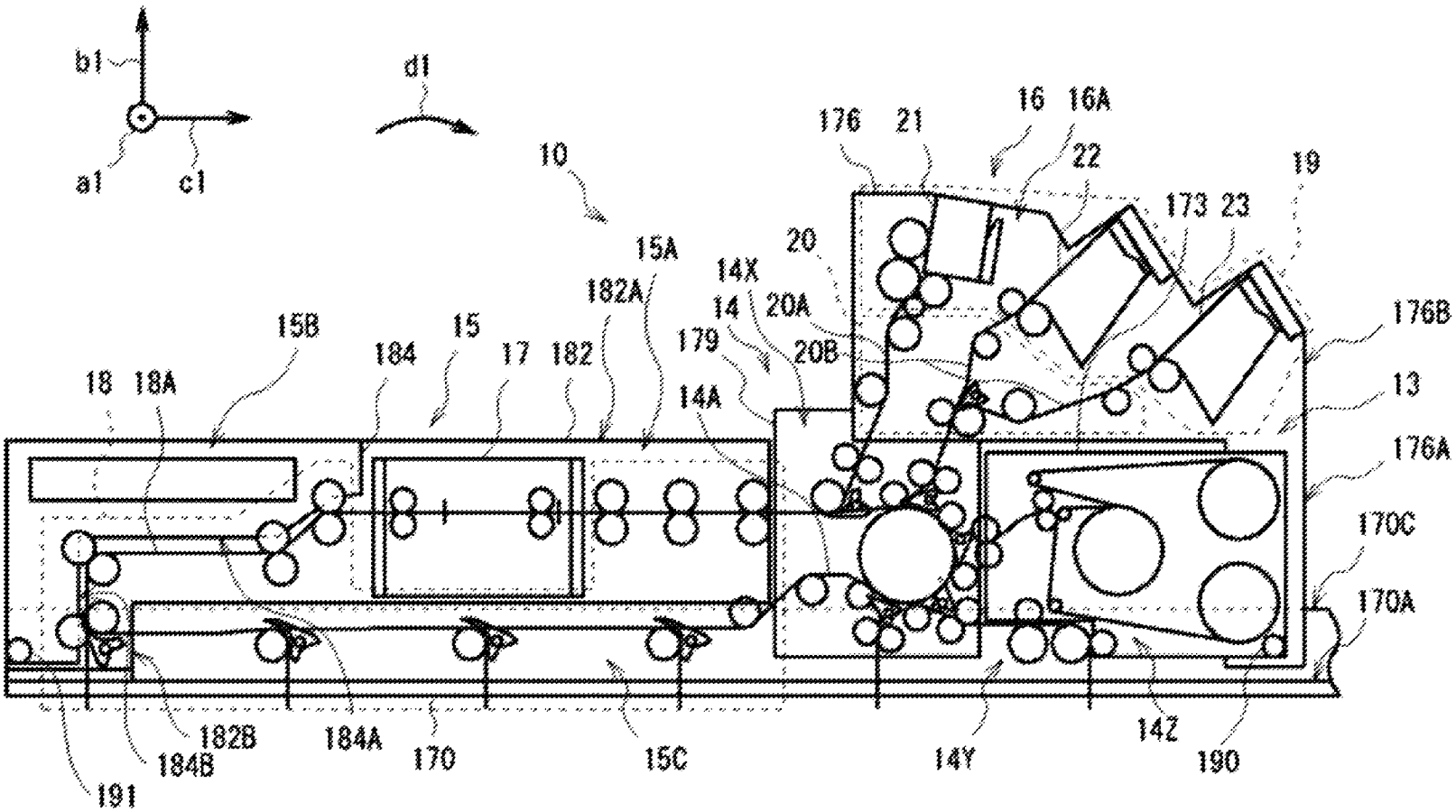
FIG. 23 is a schematic side view illustrating a configuration (1) of an upper unit.
Figure 24:
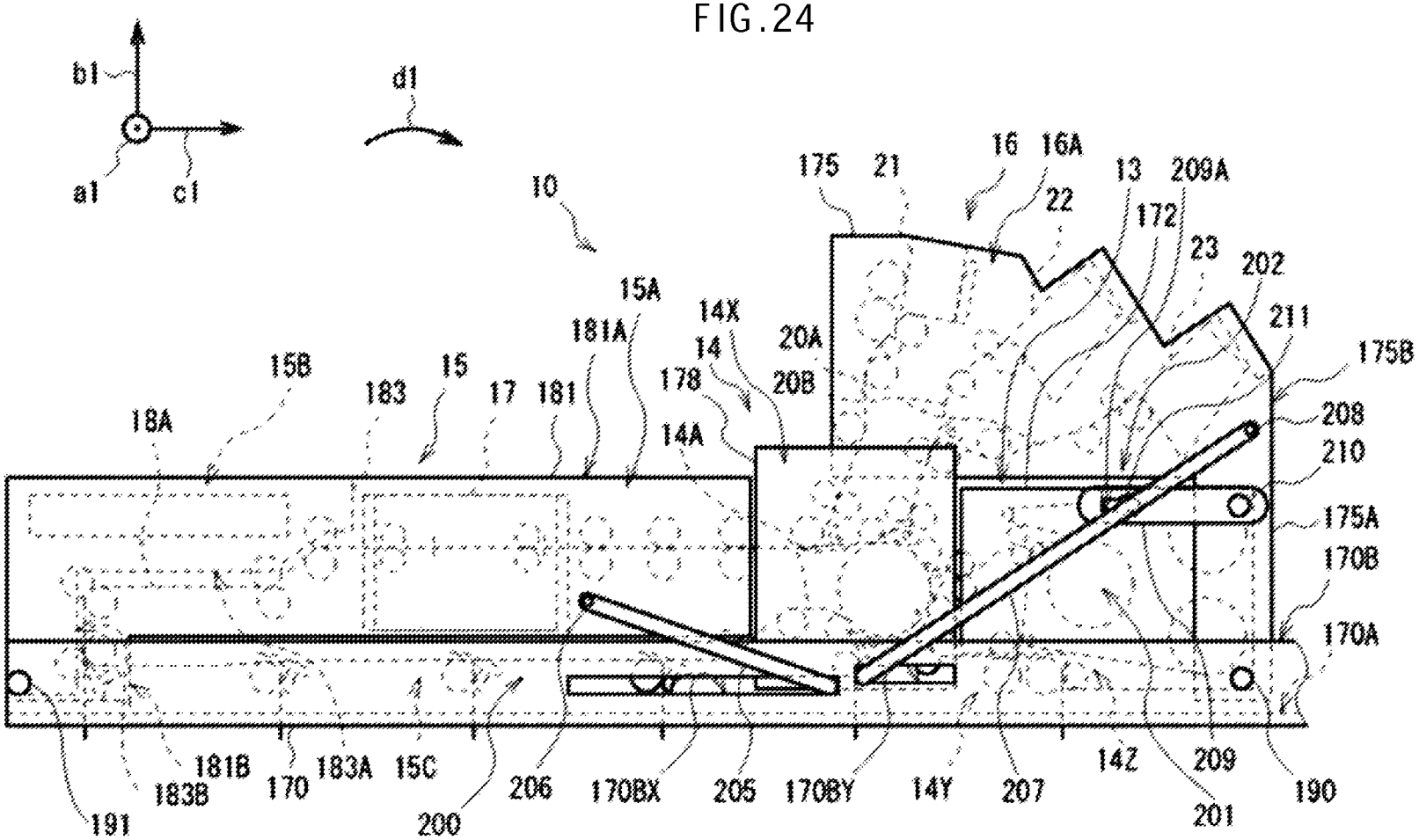
FIG. 24 is a schematic side view illustrating a configuration (2) of an upper unit.

Explanation next follows regarding configuration of the upper unit 10. As illustrated in FIG. 23 and FIG. 24, the upper unit 10 includes, for example, a substantially frame shaped upper frame 170.

The upper frame 170 includes a bottom plate 170A, which has a substantially rectangular frame plate shape that is long in the device front-rear direction, and a left-side plate 170B and a right-side plate 170C, which are substantially long-thin rectangular shaped, respectively provided upright so as to span from the front end to the rear end at the left end and the right end of the bottom plate 170A.

The upper frame 170 is provided so that the temporary holding section 13, the switching conveying section 14, the classification and conveying unit 15, and the pay-in/pay-out conveying unit 16 are mounted on the bottom plate.

In the upper frame 170 the heights (namely, lengths in the device up-down direction) of the left-side plate 170B and the right-side plate 170C are set to be comparatively low.

Thus in the upper frame 170, the respective lower end portions of the temporary holding section 13, the switching conveying section 14, and the classification and conveying unit 15 are positioned between the left-side plate 170B and the right-side plate 170C, and the respective central portions and upper end portions of the temporary holding section 13, the switching conveying section 14, and the classification and conveying unit 15 project out to the upper side of the left-side plate 170B and the right-side plate 170C.

The temporary holding section 13 includes a pair of a left-side plate 172 and a right-side plate 173 that are substantially rectangular shaped and disposed facing each other along the device left-right direction at a specific separation from each other.

The left-side plate 172 and the right-side plate 173 each have a cutaway at a rear lower corner portion, such that a lower front end portion juts out slightly further to the lower side than a lower rear end portion.

The temporary holding section 13 is provided between the left-side plate 172 and the right-side plate 173, such that the previously described plural rollers and plural conveyor belts, the single rotation drum, and the pair, or plural pairs, of tape reels, are each rotatable in one rotation direction and the other rotation direction about a rotation shaft parallel to the device left-right direction.

The pay-in/pay-out conveying unit 16 includes a pair of a left-side plate 175 and a right-side plate 176 that are substantially L-shaped, and disposed so as to face each other along the device left-right direction at a wider specific separation than the separation of the left-side plate 172 and the right-side plate 173 of the temporary holding section 13.

In the left-side plate 175 and the right-side plate 176, lengths of leg portions 175A, 176A (namely, the length in the device up-down direction) that are respectively long-thin rectangular shapes are set to be a specific length that is the height (namely, the length in the device up-down direction) of the left-side plate 172 and the right-side plate 173 of the temporary holding section 13, or longer.

In the left-side plate 175 and the right-side plate 176, the respective leg portions 175A, 176A are positioned at the front side, and substantially long-thin rectangular shaped body portions 175B, 176B are positioned diagonally to the rear and at the upper side of the leg portions 175A, 176A.

In the pay-in/pay-out conveying unit 16, the single banknote receiving section 21, and the two banknote handover sections 22, 23 described above that are configuration components of the pay-in/pay-out section 19 are provided, for example, slightly inclined between the body portion 175B of the left-side plate 175 and the body portion 176B of the right-side plate 176.

In the pay-in/pay-out conveying unit 16, the two banknote handover sections 22, 23, are, for example, provided between the body portion 175B of the left-side plate 175 and the body portion 176B of the right-side plate 176 such that the inclination angle of the banknote handover sections 22, 23 is variable when banknotes for pay-out are being taken in, and when banknotes for pay-out are passed over to the cashier or customer.

Moreover, in the pay-in/pay-out conveying unit 16, the plural rollers described above for feeding out or taking in banknotes that are configuration components of the pay-in/pay-out section 19 are provided between the body portion 175B of the left-side plate 175 and the body portion 176B of the right-side plate 176 so as to each be rotatable in the one rotation direction and the other rotation direction about a rotation shaft parallel to the device left-right direction.

Moreover, in the pay-in/pay-out conveying unit 16, plural conveying guides are provided and fixed between the body portion 175B of the left-side plate 175 and the body portion 176B of the right-side plate 176, together with the plural conveying rollers, the plural conveyor belts, the plural conveying direction switching blades described above that are configuration components of the upper-side conveying section 20 provided so as to each be rotatable in the one rotation direction and the other rotation direction about a rotation shaft parallel to the device left-right direction.

Thus in the pay-in/pay-out conveying unit 16, the upper-side feed-out conveying path 20A and the upper-side take-in conveying path 20B described above are formed between the body portion 175B of the left-side plate 175 and the body portion 176B of the right-side plate 176.

In the following explanation, the substantially rectangular box shaped portion 16A in the pay-in/pay-out conveying unit 16 configured using the body portion 175B of the left-side plate 175 and the body portion 176B of the right-side plate 176 as a base is also referred to in particular as the pay-in/pay-out unit main body section 16A.

The switching conveying section 14 includes a pair of a left-side plate 178 and a right-side plate 179 that are substantially square shaped and disposed facing each other along the device left-right direction at a specific separation, wider than the separation between the left-side plate 175 and the right-side plate 176 in the pay-in/pay-out conveying unit 16.

In the switching conveying section 14, the single conveying roller of comparatively large external diameter and the plural conveying rollers of smaller external diameter described above are provided between the left-side plate 178 and the right-side plate 179 so as to each be rotatable in the one rotation direction and the other rotation direction about a rotation shaft parallel to the device left-right direction.

In the switching conveying section 14, plural conveying guides are provided and fixed between the left-side plate 178 and the right-side plate 179, together with the plural conveyor belts and the plural conveying direction switching blades described above provided so as to each be rotatable in the one rotation direction and the other rotation direction about a rotation shaft parallel to the device left-right direction.

In addition thereto, in the switching conveying section 14, for example, a single or plural conveying guides is/are also provided and fixed at a portion facing toward the lower end portion of the temporary holding section 13 between the left-side plate 170B and the right-side plate 170C of the upper frame 170 (namely, between the cutaway portions of the left-side plate 172 and the right-side plate 173 of the temporary holding section 13), together with the plural conveying rollers and the plural conveyor belts that are some of the configuration components of the switching conveying section 14, provided so as to each be rotatable in the one rotation direction and the other rotation direction about a rotation shaft parallel to the device left-right direction.

In the switching conveying section 14, a single or plural conveying guides is/are also provided and fixed at a portion running along the cutaway portion between the left-side plate 172 and the right-side plate 173 of the temporary holding section 13, together with the plural conveying rollers and the plural conveyor belts that are some of the configuration components of the switching conveying section 14, provided so as to each be rotatable in the one rotation direction and the other rotation direction about a rotation shaft parallel to the device left-right direction.

In the following explanation, a portion 14X in the switching conveying section 14 configured using the left-side plate 178 and the right-side plate 179 as a base is also referred to in particular as a switching conveying main body section 14X.

Moreover, in the following explanation, a substantially long-thin rectangular shaped portion 14Y in the switching conveying section 14 configured using the left-side plate 170B and the right-side plate 170C of the upper frame 170 as a base is also referred to in particular as a frame-side switching conveying section 14Y.

Moreover, in the following explanation, a substantially L-shaped portion 14Z in the switching conveying section 14 configured using the left-side plate 172 and the right-side plate 173 of the temporary holding section 13 as a base is also referred to in particular as a temporary holding-side switching conveying section 14Z.

Thus in the switching conveying section 14, an upper portion, a circular arc portion, and a lower portion of the switching conveying path 14A are formed in the switching conveying main body section 14X.

In the switching conveying section 14, connection branch portions are formed in the switching conveying main body section 14X for the plural connection branch portions of the switching conveying path 14A other than the connection branch portion corresponding to the take-in conveying path 28AX of the reject box 28 (also referred to below in particular as the reject branch portion).

Moreover, in the switching conveying section 14 the reject branch portion of the switching conveying path 14A is formed between the frame-side switching conveying section 14Y and the temporary holding-side switching conveying section 14Z.

The classification and conveying unit 15 includes a pair of a first left-side plate 181 and a first right-side plate 182 that are substantially L-shaped and disposed facing each other along the device left-right direction at a specific separation from each other.

The classification and conveying unit 15 also includes a pair of a second left-side plate 183 and a second right-side plate 184 that are substantially L-shaped and disposed facing each other along the device left-right direction at a specific separation narrower than the separation between the first left-side plate 181 and the first right-side plate 182.

In the first left-side plate 181 and the first right-side plate 182, respective lengths (namely, lengths in the device front-rear direction) of body portions 181A, 182A are set to be a comparatively long specific length.

In the first left-side plate 181 and the first right-side plate 182, respective lengths (namely, lengths in the device up-down direction) of leg portions 181B, 182B are set to be a comparatively short specific length.

Moreover, in the first left-side plate 181 and the first right-side plate 182, respective widths (namely, lengths in the device front-rear direction) of the leg portions 181B, 182B are set to be a specific length that is significantly shorter than the length of the body portions 181A, 182A.

The first left-side plate 181 and the first right-side plate 182 are respectively positioned at the rear side of the leg portions 181B, 182B, and the body portions 181A, 182A are positioned diagonally to the front of and at the upper side of the leg portions 181B, 182B.

Respective lengths of body portions 183A, 184A (namely, lengths in the device front-rear direction) of a second left-side plate 183 and a second right-side plate 184 are set to be a specific length that is shorter than the length of the body portions 181A, 182A (namely, the lengths in the device front-rear direction) of the first left-side plate 181 and the first right-side plate 182.

Moreover, respective lengths of leg portions 183B, 184B (namely, the length in the device up-down direction) in the second left-side plate 183 and the second right-side plate 184 are set to be a specific length that is longer than the length of the leg portions 181B, 182B (namely, the length in the device up-down direction) of the first left-side plate 181 and the first right-side plate 182.

Moreover, respective widths of the leg portions 183B, 184B (namely, lengths in the device front-rear direction) in the second left-side plate 183 and the second right-side plate 184 are set to be a specific length that is shorter than the length of the leg portions 181B, 182B (namely, the lengths in the device front-rear direction) of the first left-side plate 181 and the first right-side plate 182.

The second left-side plate 183 and the second right-side plate 184 are positioned between the rear end portion of the first left-side plate 181 and the rear end portion of the first right-side plate 182, and to the rear side of the respective leg portions 183B, 184B, with the body portions 183A, 184B positioned diagonally to the front of, and at the upper side of, the leg portions 183B, 184B.

In the classification and conveying unit 15, the classification section 17 is provided between central portions of the body portion 181A of the first left-side plate 181 and the body portion 182A of the first right-side plate 182.

The classification section 17 is provided between central portions of the body portion 181A of the first left-side plate 181 and the body portion 182A of the first right-side plate 182, and is configured from various sensors, and from plural rollers and the like which are each provided so as to be rotatable in the one rotation direction and the other rotation direction about a rotation shaft parallel to the device left-right direction.

In the classification and conveying unit 15, plural conveying guides are provided and fixed between first left-side plate 181 and the first right-side plate 182, together with the plural conveying rollers, the plural conveyor belts and the plural conveying direction switching blades described above that are configuration components of the rear-side conveying section 18 provided so as to be rotatable in the one rotation direction and the other rotation direction about rotation shafts parallel to the device left-right direction.

In the classification and conveying unit 15, plural conveying guides are also provided and fixed between second left-side plate 183 and the second right-side plate 184, together with the previously described plural conveying rollers, the plural conveyor belts and the plural conveying direction switching blades that are configuration components of the rear-side conveying section 18 provided so as to be rotatable in the one rotation direction and the other rotation direction about rotation shafts parallel to the device left-right direction.

In addition, in the classification and conveying unit 15, for example, plural conveying guides are also provided and fixed between left-side plate 170B and the right-side plate 170C of the upper frame 170 at portions facing toward points between the body portion 181A of the first left-side plate 181 and the body portion 182A of the first right-side plate 182, together with the plural conveying rollers, the plural conveyor belts and the plural conveying direction switching blades that are some of the configuration components of the rear-side conveying section 18 provided so as to be rotatable in the one rotation direction and the other rotation direction about rotation shafts parallel to the device left-right direction.

In the following explanation, in the conveying unit 15, the substantially L-shaped portion 15A configured using the first left-side plate 181 and the first right-side plate 182 as a based is also referred to in particular as a conveying unit main body section 15A.

Moreover, in the following explanation, in the conveying unit 15, a portion 15B configured using the second left-side plate 183 and the second right-side plate 184 as a base is also referred to in particular as a conveying unit guide section 15B.

Moreover, in the following explanation, in the conveying unit 15, a substantially flat rectangle shaped portion 15C configured using the second left-side plate 170B and the right-side plate 170C of the upper frame 170 as a base is also referred to in particular as a conveying unit fixed section 15C.

Thus in the classification and conveying unit 15, a portion of the classification-side portion of the rear-side conveying path 18A described above is formed at the front end portion of the conveying unit main body section 15A (namely, at the front side of the classification section 17 between the body portions 181A of the first left-side plate 181 and the body portion 182A of the first right-side plate 182).

In the classification and conveying unit 15, a folding back portion of the rear-side conveying path 18A is formed, together with the remaining portion in the classification-side portion of the rear-side conveying path 18A, between the substantially L-shaped internal face of the conveying unit guide section 15B, and the facing portions inside the conveying unit main body section 15A (namely, at the rear side of the classification section 17 between the first left-side plate 181 and the first right-side plate 182).

Moreover, in the classification and conveying unit 15, a classification lower portion of the rear-side conveying path 18A is formed between the lower front end portion of the conveying unit main body section 15A (namely, the portion between the body portion 181A of the first left-side plate 181 and the body portion 182A of the first right-side plate 182) and the upper end portion of the conveying unit fixed section 15C.

Moreover, in the classification and conveying unit 15, plural connection branch portions of the rear-side conveying path 18A (namely, plural connection branch portions corresponding to the take-in/feed-out conveying paths 30AX to 33AX of the plural banknote storage boxes 30 to 33) are formed inside the conveying unit fixed section 15C.

As described above, inside the safe casing 26 of the lower unit 11 in the banknote processing device 1, there are no conveying sections provided that form conveying paths that would appropriately switch the conveying direction and convey reject banknotes and banknotes for pay-in or pay-out with respect to the reject box 28 and the plural banknote storage boxes 29 to 33.

Moreover, in the banknote processing device 1, as described above, the unidirectional handover path 39A and the plural bidirectional handover paths 40A to 44A are connected to the switching conveying path 14A and the rear-side conveying path 18A, and to the take-in conveying path 28AX and the plural take-in/feed-out conveying paths 29AX to 33AX, so as to enable banknotes to be handed over without blocking (namely, without causing jams).

Thus, in the banknote processing device 1, even were a jam to occur during conveying banknotes during pay-in or pay-out, the location of such a jam can be limited to the upper unit 10 where the switching conveying path 14A, the rear-side conveying path 18A, the upper-side feed-out conveying path 20A, and the upper-side take-in conveying path 20B are formed.

Hence configuration of the upper unit 10 is such that even were a jam to occur during conveying banknotes through the switching conveying path 14A, the rear-side conveying path 18A, the upper-side feed-out conveying path 20A, and the upper-side take-in conveying path 20B, the banknotes that jammed (namely, blocked) can be removed (also referred to below as jammed banknotes).

Namely, in the upper unit 10, although the switching conveying section 14 (namely the switching conveying main body section 14X and the frame-side switching conveying section 14Y) is provided fixed to the upper frame 170, the temporary holding section 13, the classification and conveying unit 15 (namely, the conveying unit main body section 15A and the conveying unit guide section 15B) and the pay-in/pay-out conveying unit 16 are each provided so as to be openable and closable.

In the temporary holding section 13, a shaft insertion hole is provided at a specific position facing a lower front corner portion of the left-side plate 172 and a lower front corner portion of the right-side plate 173 (namely, front corner portions of portions that both jut out to the lower side).

In the temporary holding section 13, for example, a rotation shaft employed for opening and closing (also referred to below as a front-side opening and closing shaft) 190, having a specific length of the cross-width of the upper frame 170 (namely, a length in the device left-right direction) or longer, is inserted into the pair of shaft insertion holes in the left-side plate 172 and the right-side plate 173. The temporary holding section 13 is thereby supported by the front-side opening and closing shaft 190 so as to be capable of swinging, through the pair of shaft insertion holes.

Moreover, in the pay-in/pay-out conveying unit 16, shaft insertion holes are provided at specific mutually facing locations in the vicinity of the leading ends of the leg portion 175A of the left-side plate 175 and leg portion 176A of the right-side plate 176.

In the pay-in/pay-out conveying unit 16, on the front-side opening and closing shaft 190, one end portion that projects out toward the left side from the shaft insertion hole of the left-side plate 172 of the temporary holding section 13 is inserted into the shaft insertion hole of the leg portion 175A of the left-side plate 175.

In the pay-in/pay-out conveying unit 16, on the front-side opening and closing shaft 190, the other end portion that projects out toward the right side from the shaft insertion hole of the right-side plate 173 of the temporary holding section 13 is inserted into the shaft insertion hole of the leg portion 176A of the right-side plate 176.

Thus in a state in which the front end portion of the temporary holding section 13 has been introduced between the leg portion 175A of the left-side plate 175 and the leg portion 176A of the right-side plate 176, the pay-in/pay-out conveying unit 16 is supported by the front-side opening and closing shaft 190 so as to be capable of swinging, through the pair of shaft insertion holes.

Moreover in the upper frame 170, shaft fixing holes (also respectively referred to below as front-side shaft fixing holes) are provided at specific mutually facing portions in the vicinity of the front end of the left-side plate 170B and in the vicinity of the front end of the right-side plate 170C.

In the upper frame 170, one end portion of the front-side opening and closing shaft 190 that projects out to the left side from the shaft insertion hole of the left-side plate 175 of the pay-in/pay-out conveying unit 16 is inserted into, and fixed to, the front-side shaft fixing hole of the left-side plate 170B of the upper frame 170.

Moreover, in the upper frame 170, the other end portion of the front-side opening and closing shaft 190 that projects out to the right side from the shaft insertion hole of the right-side plate 176 of the pay-in/pay-out conveying unit 16 is inserted into, and fixed to, the front-side shaft fixing hole of the right-side plate 170C of the upper frame 170.

The upper frame 170 accordingly supports the temporary holding section 13 and the pay-in/pay-out conveying unit 16 so as to be individually capable of swinging in the one rotation direction and the other rotation direction about the front-side opening and closing shaft 190.

In the upper frame 170, for example, shaft insertion holes (not illustrated in the drawings) are provided at specific mutually facing positions on the front end portion of the left-side plate 170B and on the front end portion of the right-side plate 170C, in front of the positions where the pair of front-side shaft fixing holes are provided (namely, further forward than the front-side opening and closing shaft 190).

A lower end portion of the unit cover 4 described above is, for example, provided with a non-illustrated rotation shaft that is fixed thereto for opening and closing the unit cover 4 (also referred to below as a cover opening and closing shaft).

The upper frame 170 supports the cover opening and closing shaft in an orientation parallel to the device left-right direction using a pair of shaft insertion holes, so as to be rotatable in the one rotation direction and the other rotation direction.

Thus in the upper unit 10, the unit cover 4 can be opened or closed with respect to the temporary holding section 13 and the pay-in/pay-out conveying unit 16.

Namely, in the upper unit 10, the unit cover 4 can be opened so as to retract toward the front side and separate from the upper end portion of the pay-in/pay-out conveying unit 16 and the front end portion of the temporary holding section 13, and can be closed so as to approach the upper end portion of the pay-in/pay-out conveying unit 16 and the front end portion of the temporary holding section 13.

Thus in the upper unit 10, when the unit cover 4 is pulled out from the device casing 2 and opened by an operator, the pay-in/pay-out conveying unit 16 and the temporary holding section 13 can both be further opened up from this state.

Namely, in the upper unit 10, the pay-in/pay-out conveying unit 16 can be opened and closed with respect to the temporary holding section 13 and the switching conveying section 14. Moreover, in the upper unit 10, the temporary holding section 13 can also be opened and closed with respect to the upper frame 170.

In the conveying unit guide section 15B of the classification and conveying unit 15, shaft insertion holes are provided at specific mutually facing positions in the vicinity of the leading ends of the leg portion 183B of the second left-side plate 183 and the leg portion 184B of the second right-side plate 184.

In the conveying unit guide section 15B, for example, a rotation shaft employed for opening and closing (also referred to below as a rear-side opening and closing shaft) 191 has a specific length of the cross-width of the upper frame 170 (namely, a length in the device left-right direction) or longer, and is inserted into the pair of shaft insertion holes of the second left-side plate 183 and the second right-side plate 184.

The conveying unit guide section 15B is thereby supported by the rear-side opening and closing shaft 191 so as to be capable of swinging, through the pair of shaft insertion holes of the second left-side plate 183 and the second right-side plate 184.

Moreover, in the conveying unit main body section 15A of the classification and conveying unit 15, shaft insertion holes are provided at specific mutually facing positions in the vicinity of the leading ends of the leg portion 181B of the first left-side plate 181 and the leg portion 182B of the first right-side plate 182.

In the conveying unit main body section 15A, one end portion of the rear-side opening and closing shaft 191 that projects out to the left side from the shaft insertion hole of the second left-side plate 183 of the conveying unit guide section 15B is rotatably inserted into the shaft insertion hole of the first left-side plate 181.

In the conveying unit main body section 15A, on the rear-side opening and closing shaft 191, the other end portion that projects out to the right side from the shaft insertion hole of the second right-side plate 184 of the conveying unit guide section 15B is rotatably inserted into the shaft insertion hole of the first right-side plate 182.

Thus in a state in which the conveying unit guide section 15B is introduced between the rear end portion of the first left-side plate 181 and the rear end portion of the first right-side plate 182, the conveying unit main body section 15A is supported by the rear-side opening and closing shaft 191 so as to be capable of swinging, through the pair of shaft insertion holes of the first left-side plate 181 and the first right-side plate 182.

In the upper frame 170, shaft fixing holes (also respectively referred to below as rear-side shaft fixing holes) are provided at specific mutually facing positions in the vicinity of the rear end of the left-side plate 170B and in the vicinity of the rear end of the right-side plate 170C.

In the upper frame 170, on the rear-side opening and closing shaft 191, the one end portion of that projects out to the left side from the shaft insertion hole of the first left-side plate 181 of the conveying unit main body section 15A is inserted into, and fixed to, the rear-side shaft fixing hole of the left-side plate 170B of the upper frame 170.

In the upper frame 170, on the rear-side opening and closing shaft 191, the other end portion that projects out to the right side from the shaft insertion hole of the first right-side plate 182 of the conveying unit main body section 15A is inserted into, and fixed to, the rear-side shaft fixing hole of the right-side plate 170C of the upper frame 170.

The upper frame 170 thereby supports the conveying unit main body section 15A and the conveying unit guide section 15B of the classification and conveying unit 15 so as to be individually capable of swinging in the one rotation direction and the other rotation direction about the rear-side opening and closing shaft 191.

Thus the classification and conveying unit 15 can also be opened or closed when the upper unit 10 has been pulled out from the device casing 2 by an operator.

Namely, in the upper unit 10, the conveying unit main body section 15A in the classification and conveying unit 15 can be opened and closed with respect to the conveying unit fixed section 15C.

Moreover, in the upper unit 10, the conveying unit guide section 15B in the classification and conveying unit 15 can be opened and closed with respect to the conveying unit main body section 15A.

In addition, the upper unit 10 also includes an opening angle limiting section (also referred to below as a conveying unit angle limiting section) 200 for limiting the opening angle, and for maintaining the conveying unit main body section 15A at an open state of a specific angle (also referred to below as a conveying unit opening angle) when the conveying unit main body section 15A has been opened in the classification and conveying unit 15.

Moreover, the upper unit 10 also includes an opening angle limiting section (also referred to below as a pay-in/pay-out unit opening angle limiting section) 201 for limiting the opening angle, and for maintaining the pay-in/pay-out conveying unit 16 at an open state of a specific angle (also referred to below as a pay-in/pay-out unit opening angle) when the pay-in/pay-out conveying unit 16 has been opened.

The upper unit 10 also includes an opening and closing control section 202 for controlling the opening and closing of the temporary holding section 13.

The conveying unit angle limiting section 200 includes a rod shaped stay (also referred to below as a conveying unit stay) 205 for limiting the opening angle of the conveying unit main body section 15A.

The conveying unit stay 205 has a shaft engagement hole formed in one end, and has an engagement projection provided so as to project straight out from the other end portion (not illustrated in the drawings).

A stay support shaft 206 is provided in the conveying unit main body section 15A, for example, projecting straight out from a specific position at a front end portion of the left face of the first left-side plate 181.

In the conveying unit main body section 15A, the conveying unit stay 205 is supported so as to be capable of swinging in the one rotation direction and the other rotation direction about the stay support shaft 206 by inserting the stay support shaft 206 into the shaft engagement hole of the conveying unit stay 205.

Moreover, in the upper frame 170, an engagement hole used by the conveying unit stay 205 is configured by an elongated hole with length direction along the front-rear direction (also referred to below as a conveying unit engagement hole) 170BX formed, for example, to a central portion of the left-side plate 170B.

In the upper frame 170, the engagement projection of the conveying unit stay 205 is inserted into the conveying unit engagement hole 170BX, such that the engagement projection of the conveying unit stay 205 is engaged in the conveying unit engagement hole 170BX so as not to detach, and so as to be capable of sliding toward the device front direction and toward the device rear direction.

In the upper frame 170, a front-side constriction portion and a rear-side constriction portion are formed respectively at a specific position toward the front end, and at a specific position toward the rear end, so as to be slightly narrower than the widths of the conveying unit engagement hole 170BX, for temporarily holding the engagement projection of the conveying unit stay 205 in the front end portion and the rear end portion of the conveying unit engagement hole 170BX.

The pay-in/pay-out unit opening angle limiting section 201 includes a rod shaped stay (also referred to below as a pay-in/pay-out unit stay) 207 for limiting the opening angle of the pay-in/pay-out conveying unit 16.

The pay-in/pay-out unit stay 207, similarly to the conveying unit stay 205, has a shaft engagement hole formed to one end portion, and an engagement projection provided so as to project straight out from the other end portion (not illustrated in the drawings).

A stay support shaft 208 is provided in the pay-in/pay-out conveying unit 16, for example projecting straight out from a specific position at a front lower end portion of the body portion 175B on the left face of the left-side plate 175.

In the pay-in/pay-out conveying unit 16, the stay support shaft 208 is inserted into the shaft engagement hole of the pay-in/pay-out unit stay 207, and the pay-in/pay-out unit stay 207 is supported so as to be capable of swinging in the one rotation direction and the other rotation direction about the stay support shaft 208.

Moreover, in the upper frame 170, an engagement hole 170BY used by the pay-in/pay-out unit stay 207 is configured by an elongated hole with length direction along the front-rear direction (also referred to below as a pay-in/pay-out unit engagement hole) formed, for example, to the left-side plate 170B further to the front side than the conveying unit engagement hole 170BX.

In the upper frame 170, the engagement projection of the pay-in/pay-out unit stay 207 is inserted into the pay-in/pay-out unit engagement hole 170BY, such that the engagement projection of the pay-in/pay-out unit stay 207 is engaged in the pay-in/pay-out unit engagement hole 170BY so as not to detach and so as to be capable of sliding toward the device front direction and toward the device rear direction.

In the upper frame 170, a front-side constriction portion and a rear-side constriction portion are formed at a specific position toward the front end, and at a specific position toward the rear end, respectively, so as to be slightly narrower than the widths of the pay-in/pay-out unit engagement hole 170BY, for temporarily holding the engagement projection of the pay-in/pay-out unit stay 207 in the front end portion and the rear end portion of the pay-in/pay-out unit engagement hole 170BY.

The opening and closing control section 202 includes a substantially long-thin rectangular shaped stay (also referred to below as an opening and closing control stay) 209 for controlling the opening and closing of the temporary holding section 13.

The opening and closing control stay 209 has a shaft engagement hole provided in a portion at one end, and an engagement hole (also referred to below as an opening and closing engagement hole) 209A that is formed in a portion at the other end and that is configured by an elongated hole that runs parallel to the length direction of the opening and closing control stay 209.

The pay-in/pay-out conveying unit 16 also has a circular column shaped stay support shaft 210 provided, for example, projecting straight out from a specific position at a base portion of the leg portion 175A on the left face of the left-side plate 175.

In the pay-in/pay-out conveying unit 16, the stay support shaft 210 is inserted into the shaft engagement hole of the opening and closing control stay 209, such that the opening and closing control stay 209 is supported so as to be capable of swinging about the stay support shaft 210 in the one rotation direction and the other rotation direction.

Moreover, in the temporary holding section 13, an engagement projection 211 is, for example, provided projecting straight out from a specific position at an upper end portion of the left face of the left-side plate 172.

In the temporary holding section 13, the engagement projection 211 is inserted into the opening and closing engagement hole 209A of the opening and closing control stay 209, such that the engagement projection 211 is engaged in the opening and closing engagement hole 209A of the opening and closing control stay 209 so as not to detach, and so as to be capable of sliding.

Figure 25:
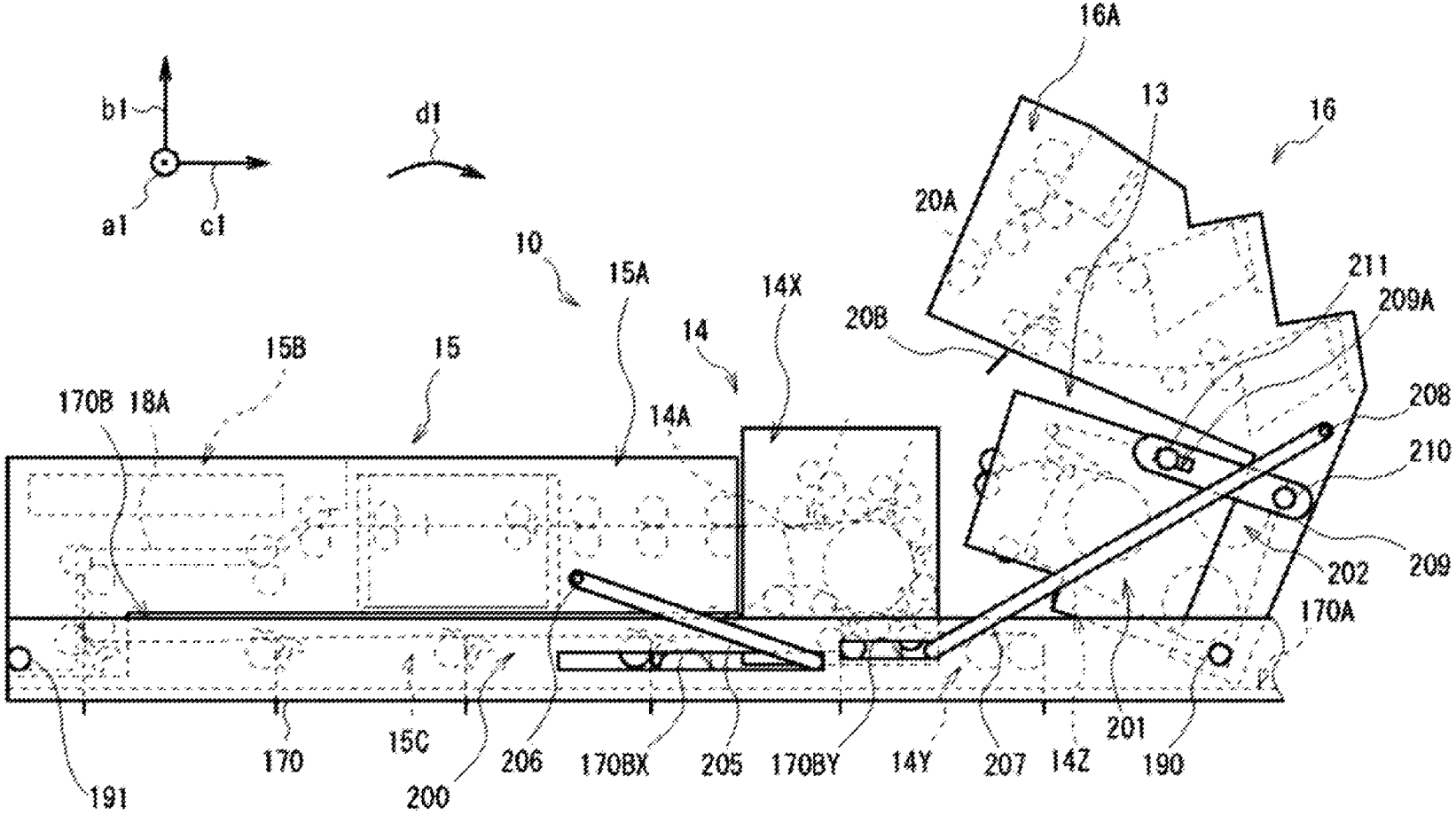
FIG. 25 is a schematic side view to accompany explanation of opening and closing of a pay-in/pay-out conveying unit and the temporary holding section in an upper unit.

As illustrated in FIG. 25, in the thus configured upper unit 10 in the pulled out state from the device casing 2, after the unit cover 4 has been opened by an operator, when the rear end portion of the pay-in/pay-out unit main body section 16A is furthermore lifted up diagonally toward the front and upper side, the pay-in/pay-out conveying unit 16 swings in the one rotation direction about the front-side opening and closing shaft 190.

When this occurs in the upper unit 10, accompanying swinging of the pay-in/pay-out conveying unit 16 in the one rotation direction, the pay-in/pay-out unit stay 207 is displaced by the pay-in/pay-out conveying unit 16 so as to be pulled out diagonally toward the front and upper side, and the opening and closing control stay 209 is displaced so as to be pulled out toward the front side.

In the upper unit 10, when the engagement projection of the pay-in/pay-out unit stay 207 is engaged with the pay-in/pay-out unit engagement hole 170BY as described above, the engagement projection 211 is engaged with the opening and closing engagement hole 209A of the opening and closing control stay 209.

Thus in the upper unit 10, the engagement projection of the pay-in/pay-out unit stay 207 slides (namely, moves) toward the front side in the pay-in/pay-out unit engagement hole 170BY while the pay-in/pay-out unit stay 207 is swung in the other rotation direction about the stay support shaft 208 according to displacement of the pay-in/pay-out unit stay 207 diagonally toward the front and upper side.

In the upper unit 10, the engagement projection 211 slides (namely, moves) relatively toward the rear side within the opening and closing engagement hole 209A of the opening and closing control stay 209 while the opening and closing control stay 209 is swung in the other rotation direction about the stay support shaft 210 according to displacement of the opening and closing control stay 209 toward the front.

Thus in the upper unit 10, only the pay-in/pay-out conveying unit 16 swings in the one rotation direction up to the point where the rear end of the opening and closing engagement hole 209A of the opening and closing control stay 209 makes contact with the engagement projection 211.

In the upper unit 10, when the pay-in/pay-out conveying unit 16 has swung to a certain extent in the one rotation direction, the rear end of the opening and closing engagement hole 209A of the opening and closing control stay 209 makes contact with the engagement projection 211.

In the upper unit 10, when the pay-in/pay-out conveying unit 16 swings further in the one rotation direction from this state, accompanying this swinging, the opening and closing control stay 209 is displaced so as to be pulled out toward the front side while the rear end of the opening and closing engagement hole 209A of the opening and closing control stay 209 remains in contact with the engagement projection 211.

Thus in the upper unit 10, the temporary holding section 13 is coupled to swinging of the pay-in/pay-out conveying unit 16 in the one rotation direction, so as to also be swung in the one rotation direction such that the rear end portion of the temporary holding section 13 is lifted up diagonally toward the front and upper side.

In the upper unit 10, when the pay-in/pay-out conveying unit 16 has swung as far as the pay-in/pay-out unit opening angle, the engagement projection of the pay-in/pay-out unit stay 207 makes contact with the front end of the pay-in/pay-out unit engagement hole 170BY.

Thus in the upper unit 10, swinging of the pay-in/pay-out conveying unit 16 in the one rotation direction is stopped, and swinging of the temporary holding section 13 in the one rotation direction is also stopped.

When this occurs in the upper unit 10, the pay-in/pay-out conveying unit 16 can be maintained in the state opened at the pay-in/pay-out unit opening angle by positioning the engagement projection of the pay-in/pay-out unit stay 207 at the front end portion of the pay-in/pay-out unit engagement hole 170BY to the front of the front-side constriction portion.

Thus according to opening operation of the pay-in/pay-out conveying unit 16 in the upper unit 10, it is possible to open the pay-in/pay-out conveying unit 16 as far as the pay-in/pay-out unit opening angle, and it is possible to open the temporary holding section 13 as far as a specific opening angle (also referred to below as the temporary holding section opening angle) between the pay-in/pay-out unit main body section 16A and the bottom plate 170A of the upper frame 170.

In the upper unit 10, when the pay-in/pay-out conveying unit 16 and the temporary holding section 13 have been opened in this manner, the upper-side feed-out conveying path 20A, the upper-side take-in conveying path 20B, and the banknote take-in and feed out portion of the temporary holding section 13 can be separated from the switching conveying path 14A.

In the upper unit 10, the reject branch portion of the switching conveying path 14A can be opened when the pay-in/pay-out conveying unit 16 and the temporary holding section 13 have been opened up in such a manner.

In the upper unit 10, when the rear end portion of the pay-in/pay-out unit main body section 16A is pushed down by an operator downward diagonally toward the rear and lower side from this opened state of the pay-in/pay-out conveying unit 16 and the temporary holding section 13, the pay-in/pay-out conveying unit 16 is swung in the other rotation direction about the front-side opening and closing shaft 190.

When this occurs in the upper unit 10, accompanying swinging of the pay-in/pay-out conveying unit 16 in the other rotation direction, the pay-in/pay-out unit stay 207 is displaced so as to be pressed diagonally toward the rear and lower side by the pay-in/pay-out conveying unit 16, and the opening and closing control stay 209 is also displaced toward the rear side.

Namely, in the upper unit 10, the engagement projection of the pay-in/pay-out unit stay 207 is slid (namely, moved) toward the rear side inside the pay-in/pay-out unit engagement hole 170BY while the pay-in/pay-out unit stay 207 swings in the one rotation direction about the stay support shaft 208 according to displacement of the pay-in/pay-out unit stay 207 diagonally toward the rear and lower side.

In the upper unit 10, the engagement projection 211 slides (namely, moves) relatively toward the front side inside the opening and closing engagement hole 209A of the opening and closing control stay 209 while the opening and closing control stay 209 swings in the one rotation direction about the stay support shaft 210 according to displacement of the opening and closing control stay 209 toward the rear side.

Thus in the upper unit 10, only the pay-in/pay-out conveying unit 16 is swung in the other rotation direction up to the point where the front end of the opening and closing engagement hole 209A of the opening and closing control stay 209 makes contact with the engagement projection 211.

In the upper unit 10, when the pay-in/pay-out conveying unit 16 has swung to a certain extent in the other rotation direction, the front end of the opening and closing engagement hole 209A of the opening and closing control stay 209 makes contact with the engagement projection 211.

In the upper unit 10, when the pay-in/pay-out conveying unit 16 swings further in the other rotation direction from this state, accompanying this swinging, the opening and closing control stay 209 is displaced so as to be pushed toward the rear side while the front end of the opening and closing engagement hole 209A of the opening and closing control stay 209 remains in contact with the engagement projection 211.

Thus in the upper unit 10, the temporary holding section 13 is coupled to the swinging of the pay-in/pay-out conveying unit 16 in the other rotation direction, and is also swung in the other rotation direction such that the rear end portion of the temporary holding section 13 is pressed diagonally toward the rear and lower side.

In the upper unit 10, when, for example, the engagement projection of the pay-in/pay-out unit stay 207 makes contact with, or approaches, the rear end of the pay-in/pay-out unit engagement hole 170BY, swinging of the pay-in/pay-out conveying unit 16 in the other rotation direction is stopped, and rotation of the temporary holding section 13 toward the other rotation direction is also stopped.

Thus in the upper unit 10, according to a closing operation on the pay-in/pay-out conveying unit 16, the pay-in/pay-out conveying unit 16 can be closed such that the pay-in/pay-out unit main body section 16A is substantially horizontal, and the temporary holding section 13 can also be closed so as to be substantially horizontal between the pay-in/pay-out unit main body section 16A and the bottom plate 170A of the upper frame 170.

When this is performed, in the upper unit 10, the pay-in/pay-out conveying unit 16 can be maintained in a closed state by changing the position of the pay-in/pay-out unit stay 207 to being positioned to the rear of the rear-side constriction portion at the rear end portion of the pay-in/pay-out unit engagement hole 170BY.

In the upper unit 10, when the pay-in/pay-out conveying unit 16 and the temporary holding section 13 have been closed in this manner, the upper-side feed-out conveying path 20A, the upper-side take-in conveying path 20B, and the banknote take-in/feed-out portion of the temporary holding section 13 can be connected to the switching conveying path 14A.

In the upper unit 10, when the pay-in/pay-out conveying unit 16 and the temporary holding section 13 have been closed in this manner, the reject branch portion of the switching conveying path 14A can be returned to a banknote (namely, reject banknote) conveyable state.

Figure 26:
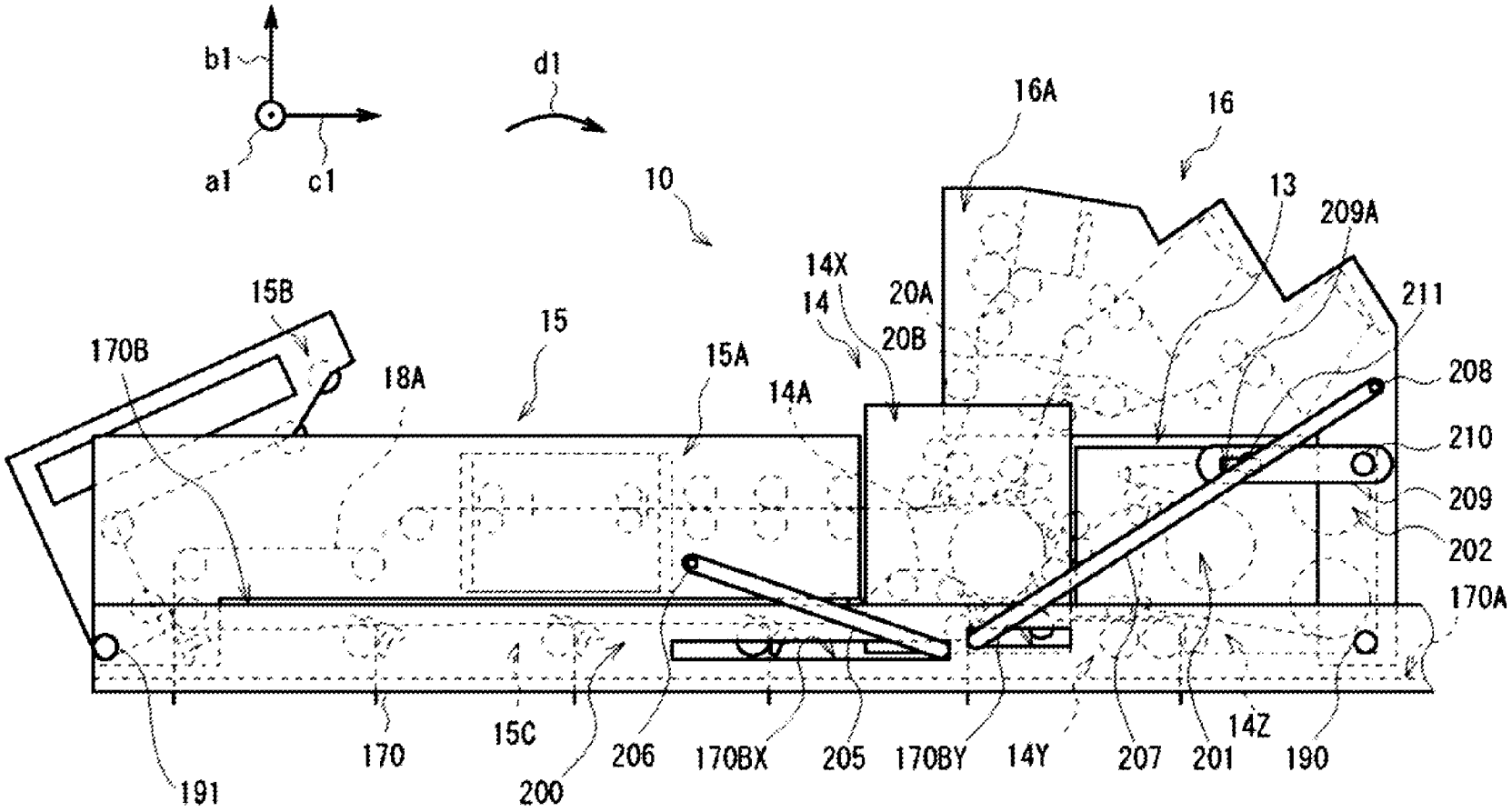
FIG. 26 is a schematic side view to accompany explanation of opening and closing of a conveying unit guide section in an upper unit.

As illustrated in FIG. 26, in a state in which the upper unit 10 has been pulled out from the device casing 2 (namely, in a state in which the classification and conveying unit 15 is closed), when the front end portion of the conveying unit guide section 15B is lifted up by an operator diagonally toward the rear and upper side, the conveying unit guide section 15B is swung in the other rotation direction about the rear-side opening and closing shaft 191.

Thus in the upper unit 10, the conveying unit guide section 15B can be opened alone at a specific opening angle (also referred to below as a guide opening angle), while the conveying unit main body section 15A remains closed.

In the upper unit 10, when the conveying unit guide section 15B has been opened with respect to the conveying unit main body section 15A in this manner, the rear side of the classification-side portion of the rear-side conveying path 18A, and the folding back portion of the rear-side conveying path 18A can be opened up.

In the upper unit 10, when the front end portion of the conveying unit guide section 15B is pushed downward diagonally in this manner toward the front and lower side by an operator, from such an opened state of the conveying unit guide section 15B with respect to the conveying unit main body section 15A, the conveying unit guide section 15B is swung in the one rotation direction about the rear-side opening and closing shaft 191.

In this manner, the upper unit 10 is capable of closing, and integrating, the conveying unit guide section 15B with respect to the conveying unit main body section 15A.

In the upper unit 10, when the conveying unit guide section 15B has been closed with respect to the conveying unit main body section 15A in this manner, the rear side of the classification-side portion of the rear-side conveying path 18A and the folding back portion of the rear-side conveying path 18A can each be returned to the banknote conveyable state.

Figure 27:
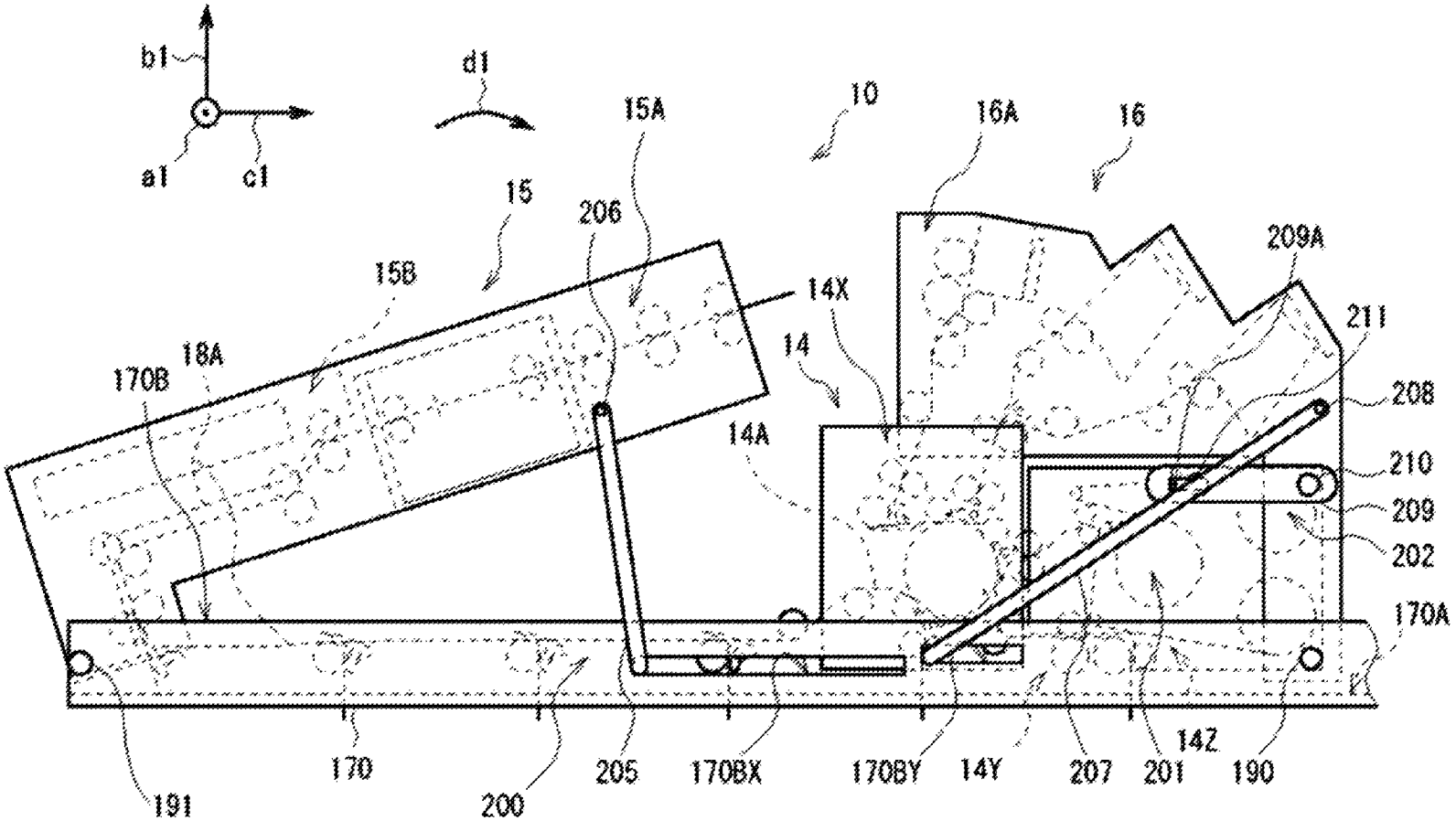
FIG. 27 is a schematic side view to accompany explanation of opening and closing of a conveying unit main body section in an upper unit.

Moreover, as illustrated in FIG. 27, when the front end portion of the conveying unit main body section 15A is lifted up diagonally to the rear and upper side by an operator from a state in which the upper unit 10 has been pulled out from the device casing 2 (namely, a state in which the classification and conveying unit 15 is closed), the conveying unit main body section 15A is swung in the other rotation direction about the rear-side opening and closing shaft 191, while remaining integrated to the conveying unit guide section 15B.

When this occurs in the upper unit 10, accompanying the swinging of the conveying unit main body section 15A in the other rotation direction, the conveying unit stay 205 is displaced by the conveying unit main body section 15A so as to be pulled out diagonally to the rear and upper side.

However, in the upper unit 10, the engagement projection of the conveying unit stay 205 is engaged with the conveying unit engagement hole 170BX as described above.

Thus in the upper unit 10, the engagement projection of the conveying unit stay 205 is slid (namely, moved) toward the rear side inside the conveying unit engagement hole 170BX, while the conveying unit stay 205 is swung in the one rotation direction about the stay support shaft 206 according to displacement of the conveying unit stay 205 diagonally toward the rear and upper side.

Thus in the upper unit 10, the conveying unit main body section 15A is swung in the other rotation direction while remaining integrated to the conveying unit guide section 15B, up until the point where the engagement projection of the conveying unit stay 205 makes contact with the rear end of the conveying unit engagement hole 170BX.

In the upper unit 10, when the conveying unit main body section 15A is swung as far as the conveying unit opening angle while remaining integrated to the conveying unit guide section 15B, the engagement projection of the conveying unit stay 205 makes contact with the rear end of the conveying unit engagement hole 170BX.

Thus in the upper unit 10, the rotation of the conveying unit main body section 15A in the other rotation direction is stopped. Thus in the upper unit 10, in response to an opening operation on the conveying unit main body section 15A, the conveying unit main body section 15A can be opened as far as the conveying unit opening angle, while remaining integrated to the conveying unit guide section 15B.

In the upper unit 10, when this occurs, the conveying unit main body section 15A can be maintained in an opened state at the conveying unit opening angle due to the engagement projection of the conveying unit stay 205 being positioned at the rear end portion of the conveying unit engagement hole 170BX.

In the upper unit 10, when the conveying unit main body section 15A has been opened while remaining integrated to the conveying unit guide section 15B in this manner, the rear-side conveying path 18A can be separated from the switching conveying path 14A.

In the upper unit 10, when the conveying unit main body section 15A has been opened while remaining integrated to the conveying unit guide section 15B in this manner, the classification lower portion of the rear-side conveying path 18A can be opened up.

In the upper unit 10, when the front end portion of the conveying unit main body section 15A is pushed downward diagonally toward the front and lower side by an operator from such an opened state of the conveying unit main body section 15A remaining integrated to the conveying unit guide section 15B, the conveying unit main body section 15A is swung in the one rotation direction about the rear-side opening and closing shaft 191 while remaining integrated to the conveying unit guide section 15B.

When this occurs, in the upper unit 10, accompanying swinging of the conveying unit main body section 15A in the one rotation direction, the conveying unit stay 205 is displaced so as to be pressed diagonally toward the front and lower side by the conveying unit main body section 15A.

Namely, in the upper unit 10, the engagement projection of the conveying unit stay 205 is slid (namely, moved) toward the front side inside the conveying unit engagement hole 170BX while the conveying unit stay 205 is swung in the other rotation direction about the stay support shaft 206 according to displacement of the conveying unit stay 205 diagonally toward the front and lower side.

In the upper unit 10, when, for example, the engagement projection of the conveying unit stay 205 makes contact with, or approaches, the front end of the conveying unit engagement hole 170BX, the swinging of the conveying unit main body section 15A toward the one rotation direction is stopped.

Thus in the upper unit 10, according the closing operation of the conveying unit main body section 15A, the conveying unit main body section 15A can be closed substantially horizontally while remaining integrated to the conveying unit guide section 15B.

When this occurs in the upper unit 10, the conveying unit main body section 15A can be maintained in the closed state due to the engagement projection of the conveying unit stay 205 being positioned to the front of the front-side constriction portion in the front end portion of the conveying unit engagement hole 170BX.

In the upper unit 10, when the conveying unit main body section 15A is closed while remaining integrated to the conveying unit guide section 15B in this manner, the rear-side conveying path 18A can be connected to the switching conveying path 14A.

In the upper unit 10, when the conveying unit main body section 15A has been closed while remaining integrated to the conveying unit guide section 15B in this manner, the classification lower portion of the rear-side conveying path 18A can be returned to the banknote conveyable state.

Figure 28:
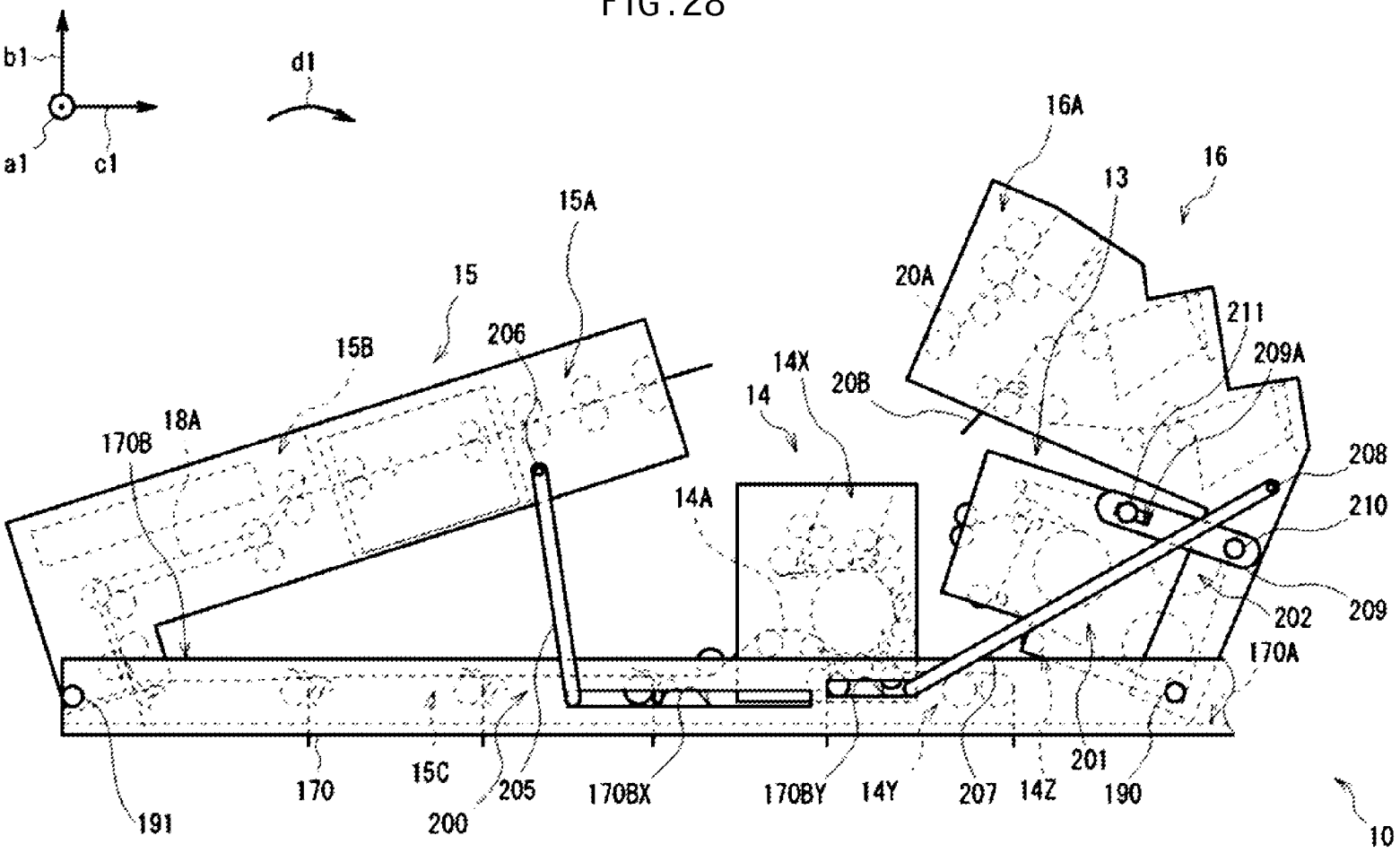
FIG. 28 is a schematic side view to accompany explanation of an opened state of a temporary holding section, a pay-in/pay-out conveying unit, and a conveying unit main body section in an upper unit.

When the upper unit 10 has been pulled out from the device casing 2, the pay-in/pay-out conveying unit 16 and the temporary holding section 13, and the classification and conveying unit 15 (namely the conveying unit main body section 15A) can be separately opened by an operator. However, as illustrated in FIG. 28, the pay-in/pay-out conveying unit 16 and the temporary holding section 13 can be opened together with the classification and conveying unit 15 (namely, the conveying unit main body section 15A).

In the upper unit 10, although not particularly illustrated, not only can the conveying unit main body section 15A be opened while remaining integrated to the conveying unit guide section 15B, but the conveying unit guide section 15B can also be opened in the opened state of the conveying unit main body section 15A.

In the upper unit 10, the conveying unit main body section 15A and the conveying unit guide section 15B can be opened by an operator in any sequence.

Namely, in the upper unit 10, the conveying unit main body section 15A can be opened after the conveying unit guide section 15B has been opened with respect to the conveying unit main body section 15A by an operator.

Moreover, in the upper unit 10, after the conveying unit main body section 15A has been opened while remaining integrated to the conveying unit guide section 15B, the conveying unit guide section 15B can be further opened with respect to the conveying unit main body section 15A by an operator.

When a jam has actually occurred in the upper unit 10 in any of the switching conveying path 14A, the rear-side conveying path 18A, the upper-side feed-out conveying path 20A, or the upper-side take-in conveying path 20B, the upper unit 10 is pulled out from the device casing 2 by an operator.

When a jam has occurred in the upper unit 10 in any of the switching conveying path 14A, the upper-side feed-out conveying path 20A, the upper-side take-in conveying path 20B or the temporary holding section 13, the pay-in/pay-out conveying unit 16 and the temporary holding section 13 are opened by an operator as described above.

In the upper unit 10, respective jammed banknote removal spaces, for removing jammed banknotes, are formed between the pay-in/pay-out conveying unit 16 and the temporary holding section 13, between the temporary holding-side switching conveying section 14Z and the frame-side switching conveying section 14Y, and between the switching conveying main body section 14X and both the pay-in/pay-out conveying unit 16 and the temporary holding section 13.

Thus in the upper unit 10, jammed banknotes can be removed by an operator inserting their hand into the jammed banknote removal space from the left side, the right side, the rear side or the like.

When a jam has occurred in the upper unit 10 in one or other of the switching conveying path 14A or the rear-side conveying path 18A, the conveying unit main body section 15A and the conveying unit guide section 15B are opened by an operator as described above.

Thus in the upper unit 10, when the conveying unit main body section 15A has been opened while remaining integrated to the conveying unit guide section 15B, respective jammed banknote removal spaces, for removing jammed banknotes, are formed between the conveying unit main body section 15A and the conveying unit fixed section 15C, and between the conveying unit main body section 15A and the switching conveying main body section 14X.

In the upper unit 10, when the conveying unit guide section 15B is opened with respect to the conveying unit main body section 15A, a jammed banknote removal space, for removing jammed banknotes, is formed between the conveying unit main body section 15A and the conveying unit guide section 15B.

Thus in the upper unit 10, the jammed banknotes can be removed by an operator inserting their hand into the jammed banknote removal space from the left side, the right side, the rear side or the like.

In the upper unit 10, the pay-in/pay-out conveying unit 16 and the temporary holding section 13, the conveying unit main body section 15A, and the conveying unit guide section 15B can be separately opened as described above.

Thus in the upper unit 10, when an operator is removing jammed banknotes, the pay-in/pay-out conveying unit 16 and the temporary holding section 13, the conveying unit main body section 15A, and the conveying unit guide section 15B can be opened or closed freely, without concern to the opening and closing sequence, enabling the operational efficiency to be improved when removing jammed banknotes.

Moreover, in the upper unit 10, the pay-in/pay-out conveying unit 16 and the temporary holding section 13, and the conveying unit main body section 15A and the conveying unit guide section 15B, can be opened with a saloon-door-like relationship to each other, with the switching conveying section 14 (namely, the switching conveying main body section 14X) acting as a boundary in between.

Namely, in the upper unit 10, the pay-in/pay-out conveying unit 16 and the temporary holding section 13 are opened to the front side, and the conveying unit main body section 15A and the conveying unit guide section 15B are opened to the rear side, with the switching conveying section 14 (namely, the switching conveying main body section 14X) acting as a boundary in between.

Thus in the upper unit 10, the movement range when an operator is removing jammed banknotes can be made extremely narrow, enabling the operational efficiency to be further improved.

In addition, in the upper unit 10, the space required for opening the pay-in/pay-out conveying unit 16 and the temporary holding section 13, the conveying unit main body section 15A, and the conveying unit guide section 15B, can be made extremely small, enabling the installation space for the banknote processing device 1 to be made extremely small, even when consideration is given to jammed banknote removal operation.

In the upper unit 10, operation knobs are provided for manually rotating the respective conveying rollers and conveyor belts in the temporary holding section 13, the switching conveying section 14, the classification and conveying unit 15, and the pay-in/pay-out conveying unit 16.

Thus in the upper unit 10, even in cases in which a jam occurs in a location where the jammed banknote cannot be easily removed simply by opening the pay-in/pay-out conveying unit 16 and the temporary holding section 13, the conveying unit main body section 15A, or the conveying unit guide section 15B, the jammed banknote can be conveyed manually to a location where removal is possible, such as a separated portion of the conveying path, and can be removed, by the operator operating the operation knobs.

1-5 Operation and Advantageous Effects of the First Exemplary Embodiment

In the banknote processing device 1 of the above configuration, a conveying section that forms a conveying path for conveying banknotes is not provided in the safe casing 26 housing the plural banknote storage boxes 29 to 33. In the banknote processing device 1 of the above configuration the switching conveying section 14 and the rear-side conveying section 18 that form the switching conveying path 14A and the rear-side conveying path 18A for conveying banknotes are provided in the upper unit 10 that is provided so as to be capable of being pulled out from, or stowed in, the device casing 2.

In the banknote processing device 1, the plural bidirectional handover paths 40A to 44A are provided to the safe top plate 26A of the safe casing 26 to handover banknotes between the take-in/feed-out conveying paths 29AX to 33AX of the banknote storage boxes 29 to 33, and the switching conveying path 14A and the rear-side conveying path 18A.

Moreover, the banknote processing device 1 is provided with the upper-side positioning section 116 for positioning to connect the upper end portions of the plural bidirectional handover paths 40A to 44A to the lower end portions of the corresponding connection branch portions of the switching conveying path 14A and the rear-side conveying path 18A when stowing the upper unit 10 in the device casing 2.

Thus in the banknote processing device 1, when stowing the upper unit 10 in the device casing 2, the upper end portions of the plural bidirectional handover paths 40A to 44A can be connected to the lower end portions of the corresponding connection branch portions of the switching conveying path 14A and the rear-side conveying path 18A so as to enable banknotes to be handed over without blocking.

Thus in the banknote processing device 1, even if a banknote becomes blocked on the conveying path during pay-in or pay-out and a jam occurs, the locations where jams occur can be limited to the switching conveying path 14A and the rear-side conveying path 18A of the upper unit 10.

As a result, in the banknote processing device 1, even if a banknote becomes blocked on the conveying path during pay-in or pay-out and a jam occurs, the jammed banknote can be removed from the switching conveying path 14A and the rear-side conveying path 18A simply by pulling the upper unit 10 out from the device casing 2.

In particular, depending on the operational practices of financial institutions, sometimes the person such as a cashier who is permitted to open the safe door 26B of the safe casing 26 (also referred to below as door opening and closing permitted person), and an operator who pulls out the upper unit 10 and removes jammed banknote, are different people, and so the banknote processing device 1 enables jammed banknotes to be removed by the operator when a jam has occurred, without having to specially call a door opening and closing permitted person.

Thus when a jam has occurred, the banknote processing device 1 enables jammed banknote removal from the switching conveying path 14A and the rear-side conveying path 18A of the upper unit 10 to be rapidly accomplished.

In the banknote processing device 1, there is no need to open the safe door 26B of the safe casing 26 during jammed banknote removal, enabling security to be raised since the safe door 26B remains closed, and no one touches the reject box 28 or the plural banknote storage boxes 29 to 33 in the safe casing 26.

According to the above configuration, the banknote processing device 1 is provided with: the switching conveying section 14 and the rear-side conveying section 18 in the upper unit 10 that form the switching conveying path 14A and the rear-side conveying path 18A for conveying banknotes; the plural bidirectional handover sections 40 to 44 in the safe top plate 26A of the safe casing 26 for forming the bidirectional handover paths 40A to 44A for handing over banknotes between the switching conveying path 14A and the rear-side conveying path 18A; and the take-in/feed-out conveying paths 29AX to 33AX of the plural banknote storage boxes 29 to 33 in the safe casing 26. The banknote processing device 1 is furthermore provided with the upper-side positioning section 116 for positioning during stowing the upper unit 10 in the device casing 2 for connecting the upper end portions of the plural bidirectional handover paths 40A to 44A to the lower end portions of the corresponding connection branch portions of the switching conveying path 14A and the rear-side conveying path 18A.

Thus in the banknote processing device 1, when stowing the upper unit 10 in the device casing 2, the upper end portions of the bidirectional handover paths 40A to 44A are connected to the lower end portions of the corresponding connection branch portions of the switching conveying path 14A and the rear-side conveying path 18A so as to enable handover of banknotes without jams occurring, and even if a banknote becomes blocked during conveying and a jam occurs, the location where this occurs can be limited to the switching conveying path 14A and the rear-side conveying path 18A of the upper unit 10.

Thus in the banknote processing device 1, even if a banknote becomes blocked during conveying and a jam occurs, pulling only the upper unit 10 out from the device casing 2 enables the jammed banknote to be removed from the switching conveying path 14A and the rear-side conveying path 18A of the upper unit 10, and enables the jammed banknote to be removed by a simple operation.

In the banknote processing device 1, the pay-in/pay-out conveying unit 16, including the upper-side conveying section 20 that forms the upper-side feed-out conveying path 20A and the upper-side take-in conveying path 20B, is provided to the upper unit 10 so as be capable of opening and closing, and the temporary holding section 13 is provided so as to open and close coupled to the opening and closing of the pay-in/pay-out conveying unit 16.

Thus in the banknote processing device 1, when a banknote becomes blocked and a jam occurs between the temporary holding section 13 and the switching conveying path 14A, or between the temporary holding section 13 and the upper-side feed-out conveying path 20A and the upper-side take-in conveying path 20B, the jammed banknote can be removed in a jammed banknote removal operation by an operator opening the temporary holding section 13 by merely following opening of the pay-in/pay-out conveying unit 16. After jammed banknote removal has been completed, the temporary holding section 13 can then be closed by merely following closing of the pay-in/pay-out conveying unit 16.

Thus in the banknote processing device 1, the jammed banknote removal operation can be simplified when a banknote becomes blocked and a jam occurs between the temporary holding section 13 and the switching conveying path 14A, the upper-side feed-out conveying path 20A, or the upper-side take-in conveying path 20B.

In the banknote processing device 1, the switching conveying path 14A and the rear-side conveying path 18A formed by the switching conveying section 14 and the rear-side conveying section 18 in the upper unit 10 are configured so as to form an overall conveying path that is a long loop shape along the device front-rear direction.

In the banknote processing device 1, the classification and conveying unit 15, provided to the rear-side conveying section 18 that forms the rear-side conveying path 18A configuring most of the loop shaped conveying path, is configured from the conveying unit main body section 15A, the smaller and lighter weight conveying unit guide section 15B, and the conveying unit fixed section 15C, and the classification and conveying unit 15 is configured so as to enable the conveying unit main body section 15A and the conveying unit guide section 15B to be individually opened or closed.

Thus in the banknote processing device 1, when a banknote becomes blocked and a jam has occurred in the switching conveying path 14A or the rear-side conveying path 18A, depending on the location where the jam has occurred, the banknote can be removed by opening only the conveying unit guide section 15B, without the operator going to the trouble of opening the conveying unit main body section 15A, enabling the burden on the operator to be reduced dramatically.

Moreover, in the banknote processing device 1, the pay-in/pay-out conveying unit 16 and the temporary holding section 13, the conveying unit main body section 15A, and the conveying unit guide section 15B are provided in the upper unit 10 so as to be capable of being opened or closed individually.

Thus in the banknote processing device 1, when a jam has occurred, the pay-in/pay-out conveying unit 16 and the temporary holding section 13, the conveying unit main body section 15A, and the conveying unit guide section 15B can be opened or closed freely by an operator, without concern to the opening and closing sequence, enabling the operational efficiency to be improved when removing jammed banknotes.

Moreover, in the upper unit 10 of the banknote processing device 1, the pay-in/pay-out conveying unit 16 and the temporary holding section 13, and the conveying unit main body section 15A and the conveying unit guide section 15B, are provided so as to have a saloon-door-like relationship to each other, and be capable of opening and closing about the switching conveying section (namely, the switching conveying main body section 14X) acting as a boundary in between.

Thus in the upper unit 10 of the banknote processing device 1, the movement range when an operator is removing jammed banknotes can be made extremely narrow, enabling the operational efficiency to be further improved.

In addition, due to the above configuration of the banknote processing device 1, the space required for opening the pay-in/pay-out conveying unit 16 and the temporary holding section 13, the conveying unit main body section 15A, and the conveying unit guide section 15B, can be made extremely small, enabling the installation space for the banknote processing device 1 to be made extremely small, even when consideration is given to jammed banknote removal operation.

Moreover, in the banknote processing device 1, the conveying unit angle limiting section 200 is provided in the upper unit 10 so as to limit the opening angle of the conveying unit main body section 15A, and to maintain the conveying unit main body section 15A in a state opened at the conveying unit opening angle.

Moreover, in the banknote processing device 1, the pay-in/pay-out unit opening angle limiting section 201 is also provided in the upper unit 10 so as to limit the opening angle of the pay-in/pay-out conveying unit 16, and to maintain the pay-in/pay-out conveying unit 16 in a state opened at the pay-in/pay-out unit opening angle.

Moreover, in the banknote processing device 1, the opening and closing control section 202 is also provided in the upper unit 10 for support, such that when the temporary holding section 13 is opened together with the pay-in/pay-out conveying unit 16, the temporary holding section 13 is supported by the pay-in/pay-out conveying unit 16 so as to maintain an opened state at the temporary holding section opening angle.

Thus in the banknote processing device 1, when jammed banknotes are being removed by an operator from the switching conveying path 14A, the rear-side conveying path 18A, the upper-side feed-out conveying path 20A, the upper-side take-in conveying path 20B, or the temporary holding section 13, open states can be maintained without manually supporting the pay-in/pay-out conveying unit 16 and the temporary holding section 13, or the conveying unit main body section 15A, thereby achieving a significant improvement in operational efficiency, and also enabling the burden on the operator to be reduced.

Moreover, in the banknote processing device 1, the front-side movable guide 72 and the rear-side movable guide 73 are provided to the plural bidirectional handover sections 40 to 44 such that base portions of the front-side movable guide 72 and the rear-side movable guide 73 face each other and are capable of swinging, and the front-side movable guide 72 and the rear-side movable guide 73 are coupled through the left-side coupling plate 81 and the right-side coupling plate 82 such that they are capable of swinging with one face of each other remaining parallel to each other.

In the banknote processing device 1, when the upper unit 10 is being stowed in the device casing 2, the front-side movable guide 72 and the rear-side movable guide 73 of the plural bidirectional handover sections 40 to 44 are positioned so as to swing according to the position of the corresponding connection portion front guide 120 and the connection portion rear guide 121 of the conveying path connection portions of the switching conveying section 14 and the rear-side conveying section 18, and then fitted together with the connection portion front guide 120 and the connection portion rear guide 121, such that the upper end portions of the plural bidirectional handover paths 40A to 44A and the lower end portions of the corresponding connection branch portions of the switching conveying path 14A and the rear-side conveying path 18A are connected together.

Thus in the banknote processing device 1, the upper end portions of the plural bidirectional handover paths 40A to 44A and the lower end portions of the corresponding connection branch portions of the switching conveying path 14A and the rear-side conveying path 18A can be connected together without changing the conveying path thickness-width, even in cases in which the connection portion front guide 120 and the connection portion rear guide 121 corresponding to the switching conveying section 14 and the rear-side conveying section 18 are fitted together with the front-side movable guide 72 and the rear-side movable guide 73 of the plural bidirectional handover sections 40 to 44 with the front-side movable guide 72 and the rear-side movable guide 73 in an orientation tilted toward the front side or back side.

Namely, in the banknote processing device 1, the leading end portions of the front-side movable guide 72 and the rear-side movable guide 73, and the lower end portions of the connection portion front guide 120 and the connection portion rear guide 121, can be inserted into the connection portions between the upper end portions of the plural bidirectional handover paths 40A to 44A and the lower end portions of the corresponding connection branch portions of the switching conveying path 14A and the rear-side conveying path 18A, irrespective of whether there is positional misalignment, thereby preventing an intruding step or indentation from being formed and enabling reliable connection.

Thereby in the banknote processing device 1, the banknotes becoming blocked and jams occurring in the connection portions between the upper end portions of the bidirectional handover paths 40A to 44A and the lower end portions of the corresponding connection branch portions of the switching conveying path 14A and the rear-side conveying path 18A can be prevented when banknotes are actually being handed over, through the plural bidirectional handover paths 40A to 44A, between the switching conveying path 14A and the rear-side conveying path 18A and the take-in/feed-out conveying paths 29AX to 33AX of the plural banknote storage boxes 29 to 33, and moreover enabling damage to banknotes to be nearly certainly prevented.

Moreover, in the banknote processing device 1, the swing control levers 85 serving as the upper-side positioning section 116 to the rear-side guide retaining portion 71 of the plural bidirectional handover sections 40 to 44, and the receiver portions of the swing control levers 85 are attached so as to be displaced by a specific separation more to the right side in sequence along the device rear direction.

Moreover, in the banknote processing device 1, the pressing arms 115 serving as the upper-side positioning section 116 are attached to the connection portion front guide 120 of respective plural conveying path connection portions of the switching conveying section 14 and the rear-side conveying section 18 so as to face the receiver projections of the swing control levers 85, such that the pressing portions of the pressing arms 115 are displaced by a specific separation more to the right side in sequence along the device rear direction.

Thus in the banknote processing device 1, simply by pushing the upper unit 10 into the device casing 2 when stowing the banknote processing device 1, the pressing portions of the pressing arms 115 of the plural conveying path connection portions of the switching conveying section 14 and the rear-side conveying section 18 are pressed against the receiving portions of the swing control levers 85 of the corresponding respective bidirectional handover sections 40 to 44 due to the switching conveying section 14 and the rear-side conveying section 18 being moved by the pushing in. This thereby enables the front-side movable guide 72 and the rear-side movable guide 73 to be swung all together at the same time to an angle corresponding to the position of the connection portion front guide 120 and the connection portion rear guide 121.

Thus in the banknote processing device 1, when the upper unit 10 is being stowed, the upper end portions of the corresponding bidirectional handover paths 40A to 44A can be easily positioned with good precision with respect to, and connected together with, the lower end portions of the plural connection branch portions of the switching conveying path 14A and the rear-side conveying path 18A.

In the banknote processing device 1, the respective pressing arms 115 are attached to the connection portion front guide 120 of the plural conveying path connection portions of the switching conveying section 14 and the rear-side conveying section 18, and the respective swing control levers 85 are attached to the rear-side guide retaining portion 71 of the plural bidirectional handover sections 40 to 44. Thus the upper end portions of the corresponding bidirectional handover paths 40A to 44A can be individually positioned with good precision with respect to, and connected to, the lower end portions of the plural connection branch portions of the switching conveying path 14A and the rear-side conveying path 18A, even in cases in which there is variation in the amount or direction of positional misalignment between the lower end portions of the plural connection branch portions of the switching conveying path 14A and the rear-side conveying path 18A and the respective upper end portions of the corresponding bidirectional handover paths 40A to 44A.

In the banknote processing device 1, due to being able to individually position with good precision, and connect, the upper end portions of the corresponding bidirectional handover paths 40A to 44A to the lower end portions of the plural connection branch portions of the switching conveying path 14A and the rear-side conveying path 18A, when the banknote processing device 1 is being assembled in a factory, and when the upper unit 10 is being replaced at the installation location, the precision required to adjust the position of the upper unit 10 in the device front-rear direction can be lowered to an amount that can be accommodated by the positioning by swinging the front-side movable guide 72 and the rear-side movable guide 73 utilizing the pressing arms 115 and the swing control levers 85.

In the banknote processing device 1, by lowering the precision required to adjust the position of the upper unit 10 in the device front-rear direction when the banknote processing device 1 is being assembled in a factory, and when the upper unit 10 is being replaced at the installation location, the operation to adjust the position of the upper unit 10 in the device front-rear direction can be simplified by a corresponding amount.

Moreover, in the banknote processing device 1, the left-side positioning pins 87 and the right-side positioning pins 88 are provided as respective lower-side positioning sections 145 to the plural bidirectional handover sections 40 to 44 so as to be capable of rising and lowering, and the left-side positioning holes 140C and the right-side positioning holes 140D are provided as the respective lower-side positioning sections 145 to the plural banknote storage boxes 29 to 33.

In the banknote processing device 1, the insertion and retraction section 125 is provided to: raise the left-side positioning pins 87 and the right-side positioning pins 88 of the plural bidirectional handover sections 40 to 44 according to opening and closing of the safe door 26B on the safe casing 26, so that they are withdrawn all at the same time from the left-side positioning holes 140C and the right-side positioning holes 140D of the corresponding banknote storage boxes 29 to 33; and to lower the left-side positioning pins 87 and the right-side positioning pins 88 all at the same time and insert them into the left-side positioning holes 140C and the right-side positioning holes 140D of the corresponding banknote storage boxes 29 to 33.

Thus in the banknote processing device 1, when storing the storage box loading case 27 in the safe casing 26, simply by closing the safe door 26B of the safe casing 26, the upper end portions of the take-in/feed-out conveying paths 29AX to 33AX of the corresponding banknote storage boxes 29 to 33 can be positioned with good precision, and connected, to the lower end portions of the bidirectional handover paths 40A to 44A of the plural bidirectional handover sections 40 to 44.

Moreover, in the banknote processing device 1, when the storage box loading case 27 is pulled out from inside the safe casing 26, simply by opening the safe door 26B of the safe casing 26, the left-side positioning pins 87 and the right-side positioning pins 88 of the corresponding bidirectional handover sections 40 to 44 can be pulled out all at once from the left-side positioning holes 140C and the right-side positioning holes 140D of the plural banknote storage boxes 29 to 33.

Thus in the banknote processing device 1, when the storage box loading case 27 is pulled out from inside the safe casing 26 and the safe door 26B of the safe casing 26 is opened, the storage box loading case 27 can be pulled out from inside the safe casing 26 without performing any special operation to remove the respective left-side positioning pins 87 and the right-side positioning pins 88 of the plural bidirectional handover sections 40 to 44 from the left-side positioning holes 140C and the right-side positioning holes 140D of the plural banknote storage boxes 29 to 33.

(2) Second Exemplary Embodiment (2-1) External Configuration of Banknote Processing Device Explanation next follows regarding a banknote processing device 250 according to a second exemplary embodiment (FIG. 1). Note that the banknote processing device 250 according to the second exemplary embodiment has an external configuration similar to that of the banknote processing device 1 according to the first exemplary embodiment (FIG. 1).

Thus regarding the external configuration of the banknote processing device 250 according to the second exemplary embodiment, reference should be made to the above explanation using FIG. 1, and explanation is omitted here.

(2-2) Internal Configuration of Banknote Processing Device

Figure 29:
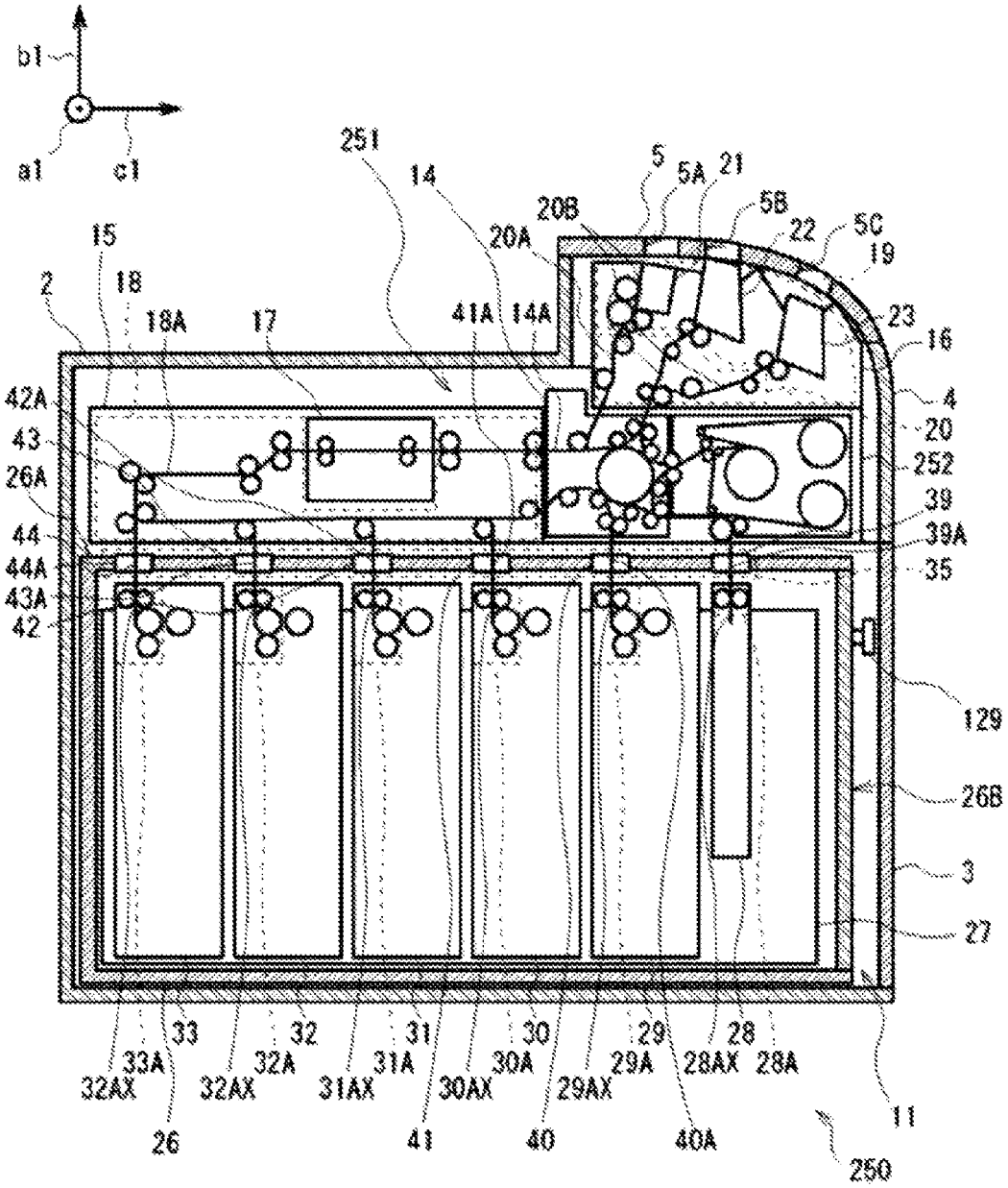
FIG. 29 is a schematic side view illustrating an internal configuration of a banknote processing device according to a second exemplary embodiment.

Explanation next follows regarding the internal configuration of the banknote processing device 250 according to the second exemplary embodiment, with reference to FIG. 29 in which the same reference numerals are appended to corresponding portions to FIG. 2.

As illustrated in FIG. 29, the banknote processing device 250 according to the second exemplary embodiment is configured similarly to the banknote processing device 1 according to the first exemplary embodiment, except in a part configuration of an upper unit 251.

More specifically, the upper unit 251 is configured similarly to the upper unit 10 according to the first exemplary embodiment except in the point that an opening angle limiting section (also referred to below as a temporary holding angle limiting section) is provided to limit the opening angle of a temporary holding section 252 as described below and to maintain the temporary holding section 252 in an opened state at a temporary holding section opening angle.

Thus explanation follows only regarding configuration of the upper unit 251 that differs from the configuration of the upper unit 10 according to the first exemplary embodiment, and for other similar portions reference should be made to the above explanation with reference to FIG. 23 and FIG. 24, and further explanation is omitted here.

(2-3) Configuration of Upper Unit

Figure 30:
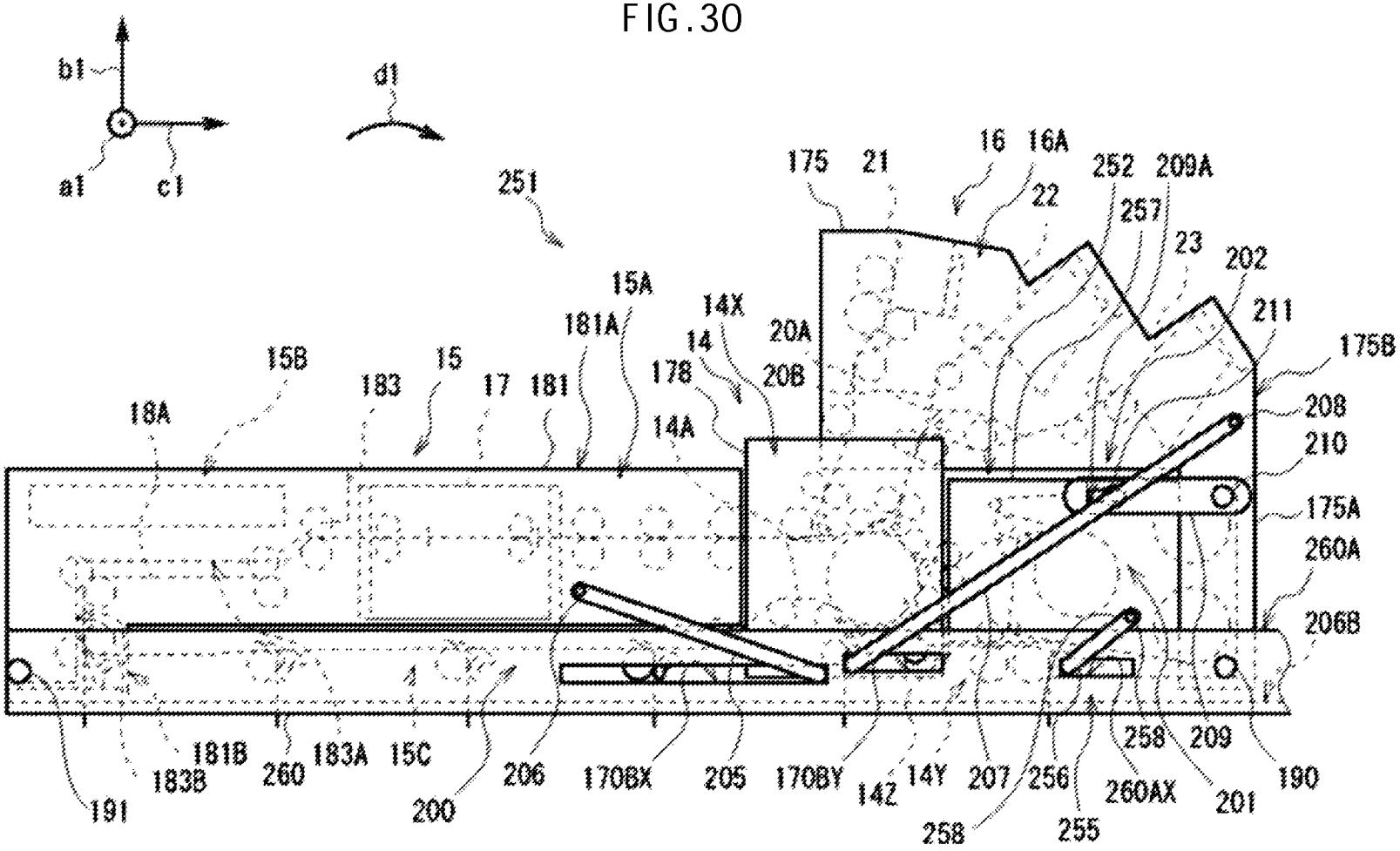
FIG. 30 is schematic side view illustrating a configuration of an upper unit.

As illustrated in FIG. 30 in which the same reference numerals are given to corresponding portions to those of FIG. 23 and FIG. 24, the upper unit 251 includes a temporary holding angle limiting section 255 mentioned above.

The temporary holding angle limiting section 255 includes a rod shaped stay (also referred to below as a temporary holding section stay) 256 for limiting the opening angle of the temporary holding section 252.

In the temporary holding section stay 256, a shaft engagement hole is provided at a portion at one end and an engagement projection (not illustrated in the drawings) provided projecting straight out from a portion at the other end.

In the temporary holding section 252, a stay support shaft 258 is, for example, provided so as to project out at a specific position towards the middle of the front end on the left face of a left-side plate 257.

In the temporary holding section 252, the stay support shaft 258 is inserted into the shaft engagement hole of the temporary holding section stay 256, and the temporary holding section stay 256 is supported so as to be capable of swinging in the one rotation direction and the other rotation direction about the stay support shaft 258.

Moreover, although an upper frame 260 is basically formed similarly to the upper frame 170 of the upper unit 10 according to the first exemplary embodiment, at a left-side plate 260A, for example, an engagement hole (also referred to below as a temporary holding engagement hole) 260AX for use by the temporary holding section stay 256 is formed as an elongated hole long in the front-rear direction, to the front side of a pay-in/pay-out unit engagement hole 170BY.

In the upper frame 260, the engagement projection of the temporary holding section stay 256 is inserted into the temporary holding engagement hole 260AX, such that the engagement projection of the temporary holding section stay 256 engaged and does not detach from the temporary holding engagement hole 260AX, and is capable of sliding in the device front direction and the device rear direction.

In the upper frame 260, a front-side constriction portion and a rear-side constriction portion are formed respectively at a specific position toward the front end, and at a specific position toward the rear end, so as to be slightly narrower than the width of the temporary holding engagement hole 260AX, for temporarily holding the engagement projection of the temporary holding section stay 256 in the front end portion and the rear end portion of the temporary holding engagement hole 260AX.

Figure 31:
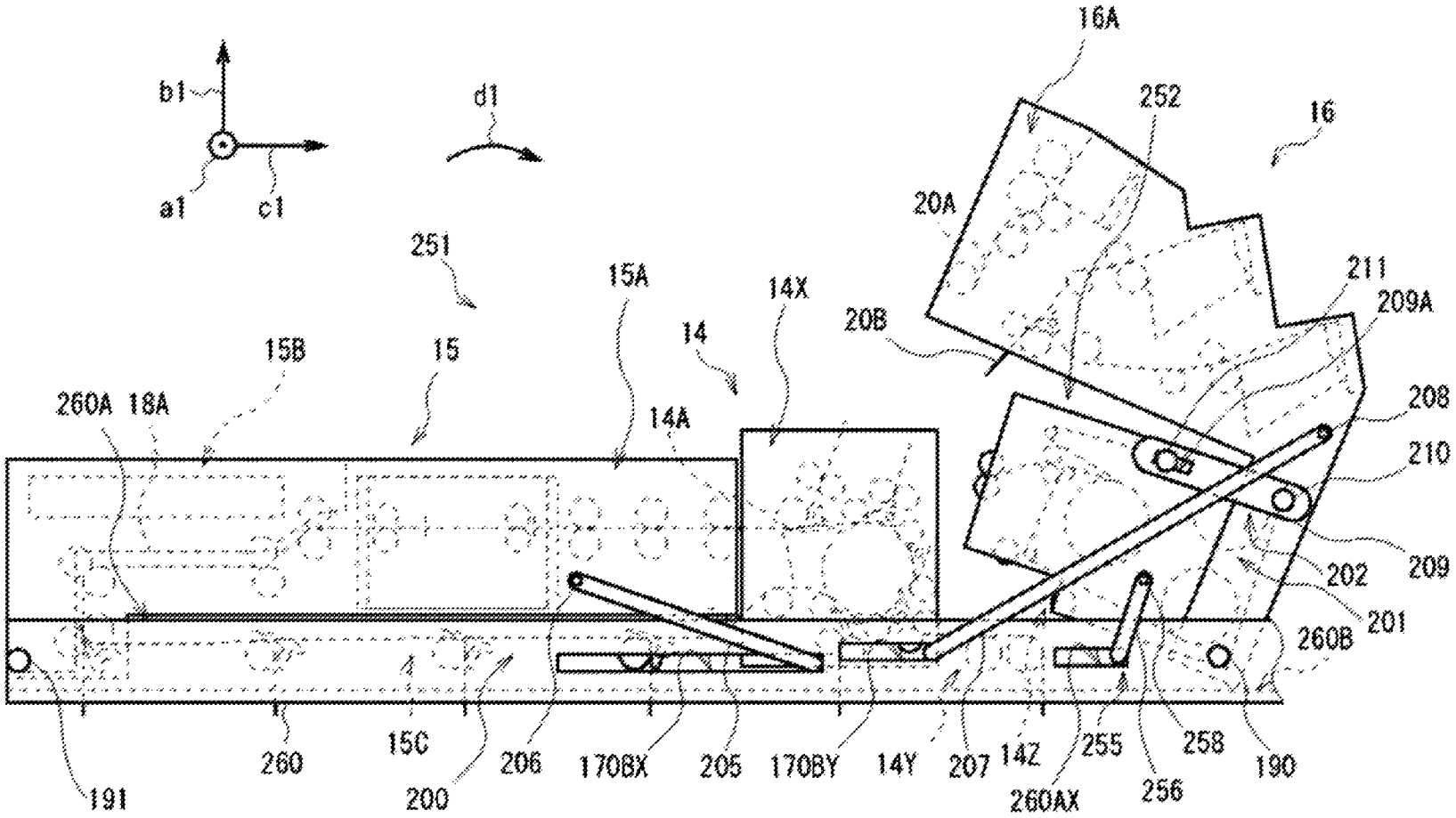
FIG. 31 is a schematic side view to accompany explanation of opening and closing of a pay-in/pay-out conveying unit and a temporary holding section in an upper unit.

As illustrated in FIG. 31 in which the same reference numerals are appended to corresponding portions to FIG. 25, due to such a configuration, in a pulled out state of the upper unit 251 from the device casing 2, after a unit cover 4 has been opened by an operator, the rear end portion of the pay-in/pay-out unit main body section 16A can be further lifted up diagonally toward the front and upper side, and the pay-in/pay-out conveying unit 16 swung in the one rotation direction about the front-side opening and closing shaft 190.

When this is performed, in the upper unit 251, accompanying swinging of the pay-in/pay-out conveying unit 16 in the one rotation direction, the pay-in/pay-out unit stay 207 is displaced by the pay-in/pay-out conveying unit 16 so as to be pulled out diagonally toward the front and upper side, and the opening and closing control stay 209 is displaced so as to be pulled out toward the front side.

Thus in the upper unit 251, while the pay-in/pay-out unit stay 207 is swung in the other rotation direction about the stay support shaft 208 according to displacement of the pay-in/pay-out unit stay 207 toward the front side, the engagement projection of the pay-in/pay-out unit stay 207 slides (namely, moves) toward the front side inside the pay-in/pay-out unit engagement hole 170BY.

Thus in the upper unit 251, while the closing control stay 209 is swung in the other rotation direction about the stay support shaft 210 according to displacement of the opening and closing control stay 209 toward the front side, the engagement projection 211 is slid (namely, moved) relatively toward the rear side inside the closing engagement hole 209A of the opening and closing control stay 209.

Thus in the upper unit 251, only the pay-in/pay-out conveying unit 16 is swung in the one rotation direction until the rear end of the opening and closing engagement hole 209A of the opening and closing control stay 209 makes contact with the engagement projection 211.

In the upper unit 251, when the pay-in/pay-out conveying unit 16 has swung by a certain amount in the one rotation direction, the rear end of the opening and closing engagement hole 209A of the opening and closing control stay 209 makes contact with the engagement projection 211.

Thus from such a state in the upper unit 251, when the pay-in/pay-out conveying unit 16 is further swung in the one rotation direction, accompanying such swinging, the opening and closing control stay 209 displaces to as to pulled out to the front side while the rear end of the opening and closing engagement hole 209A of the opening and closing control stay 209 remains in contact with the engagement projection 211.

Thus in the upper unit 251, coupled to the swinging of the pay-in/pay-out conveying unit 16 in the one rotation direction, the temporary holding section 252 is also swung in the one rotation direction such that its rear end portion is lifted up diagonally toward the front and upper side.

In the upper unit 251, when this is performed, accompanying swinging of the temporary holding section 252 in the one rotation direction, the temporary holding section stay 256 is displaced by the temporary holding section 252 so as to be pulled out diagonally toward the front and upper side.

Then in the upper unit 251, the engagement projection of the temporary holding section stay 256 engages in the temporary holding engagement hole 260AX as described above.

Thus in the upper unit 251, the engagement projection of the temporary holding section stay 256 is slid (namely, moved) toward the front side in the temporary holding engagement hole 260AX while the temporary holding section stay 256 swings in the other rotation direction about the stay support shaft 258 according to displacement of the temporary holding section stay 256 diagonally toward the front and upper side.

In the upper unit 251, when the pay-in/pay-out conveying unit 16 has swung as far as the pay-in/pay-out unit opening angle, and the temporary holding section 252 has swung as far as the temporary holding section opening angle, the engagement projection of the pay-in/pay-out unit stay 207 makes contact with the front end of the pay-in/pay-out unit engagement hole 170BY, and the engagement projection of the temporary holding section stay 256 makes contact with the front end of the temporary holding engagement hole 260AX.

Thus in the upper unit 251, swinging of the pay-in/pay-out conveying unit 16 in the one rotation direction is stopped, together with swinging of the temporary holding section 252 in the one rotation direction stopping.

In the upper unit 251, when this occurs, the pay-in/pay-out conveying unit 16 can be maintained in the opened state at the pay-in/pay-out unit opening angle by positioning the engagement projection of the pay-in/pay-out unit stay 207 in the front end portion of the pay-in/pay-out unit engagement hole 170BY to the front of the front-side constriction portion.

Moreover, in the upper unit 251, when this occurs, the temporary holding section 252 can be maintained in an opened state at the temporary holding section opening angle by positioning the engagement projection of the temporary holding section stay 256 at the front end portion of the temporary holding engagement hole 260AX, to the front of the front-side constriction portion.

Thus in the upper unit 251, together with opening the pay-in/pay-out conveying unit 16 as far as the pay-in/pay-out unit opening angle according to opening operation on the pay-in/pay-out conveying unit 16, the temporary holding section 252 can also be opened at the temporary holding section opening angle between the pay-in/pay-out unit main body section 16A and a bottom plate 260B of the upper frame 260.

In the upper unit 251, when the pay-in/pay-out conveying unit 16 and the temporary holding section 252 have been opened in this manner, the upper-side feed-out conveying path 20A, the upper-side take-in conveying path 20B, and the banknote take-in/feed-out portion of the temporary holding section 252 can be separated from the switching conveying path 14A.

In the upper unit 251, when the pay-in/pay-out conveying unit 16 and the temporary holding section 252 have been opened in this manner, the reject branch portion of the switching conveying path 14A can be opened up.

In the upper unit 251, from an opened state of the pay-in/pay-out conveying unit 16 and the temporary holding section 252, when the rear end portion of the pay-in/pay-out unit main body section 16A is pushed downward by an operator diagonally toward the rear and lower side, the pay-in/pay-out conveying unit 16 is swung in the other rotation direction about the front-side opening and closing shaft 190.

When this is performed, in the upper unit 251, accompanying swinging of the pay-in/pay-out conveying unit 16 in the other rotation direction, the pay-in/pay-out unit stay 207 is displaced by the pay-in/pay-out conveying unit 16 so as to be pressed diagonally toward the rear and lower side, and the opening and closing control stay 209 is also displaced so as to be pressed toward the rear side.

Namely, in the upper unit 251, the engagement projection of the pay-in/pay-out unit stay 207 is slid (namely, is moved) toward the rear side in the pay-in/pay-out unit engagement hole 170BY while the pay-in/pay-out unit stay 207 swings in the one rotation direction about the stay support shaft 208 according to displacement of the pay-in/pay-out unit stay 207 diagonally toward the rear and lower side.

In the upper unit 251, the engagement projection 211 is slid (namely, is moved) relatively toward the front side in the opening and closing engagement hole 209A of the opening and closing control stay 209 while the opening and closing control stay 209 is being swung in the one rotation direction about the stay support shaft 210 according to displacement of the opening and closing control stay 209 toward the rear side.

Thus in the upper unit 251, only the pay-in/pay-out conveying unit 16 swings in the other rotation direction up to the point where the front end of the opening and closing engagement hole 209A of the opening and closing control stay 209 makes contact with the engagement projection 211.

Thus in the upper unit 251, when the pay-in/pay-out conveying unit 16 has swung to a certain extent in the other rotation direction, the front end of the opening and closing engagement hole 209A of the opening and closing control stay 209 makes contact with the engagement projection 211.

In the upper unit 251, when the pay-in/pay-out conveying unit 16 has swung from this state further in the other rotation direction, accompanying the swinging, the opening and closing control stay 209 is displaced so as to be pressed toward the rear side while the front end of the opening and closing engagement hole 209A of the opening and closing control stay 209 remains in contact with the engagement projection 211.

Thus in the upper unit 251, the temporary holding section 252 is also coupled to swinging of the pay-in/pay-out conveying unit 16 in the other rotation direction, and is swung in the other rotation direction such that the rear end portion of the temporary holding section 252 is pressed diagonally toward the rear and lower side.

In the upper unit 251, when this is performed, accompanying swinging of the temporary holding section 252 in the other rotation direction, the temporary holding section stay 256 is displaced by the temporary holding section 252 so as to be pressed diagonally toward the rear and lower side.

Thus in the upper unit 251, the engagement projection of the temporary holding section stay 256 is slid (namely, is moved) toward the rear side in the temporary holding engagement hole 260AX while the temporary holding section stay 256 is swung in the one rotation direction about the stay support shaft 258 according to displacement of the temporary holding section stay 256 diagonally toward the rear and lower side.

In the upper unit 251, swinging of the pay-in/pay-out conveying unit 16 in the other rotation direction is stopped together with swinging of the temporary holding section stay 256 in the other rotation direction also being stopped when, for example, the engagement projection of the pay-in/pay-out unit stay 207 makes contact with, or approaches, the rear end of the pay-in/pay-out unit engagement hole 170BY, and the engagement projection of the temporary holding section stay 256 makes contact with, or approaches the rear end of the temporary holding engagement hole 260AX.

Thus in the upper unit 251, accompanying closing operation on the pay-in/pay-out conveying unit 16, the pay-in/pay-out unit main body section 16A in the pay-in/pay-out conveying unit 16 can be closed substantially horizontally, and also the temporary holding section 252 can be closed substantially horizontally between the pay-in/pay-out unit main body section 16A and the bottom plate 260B of the upper frame 260.

In the upper unit 251, when this is performed, the pay-in/pay-out conveying unit 16 can be maintained in a closed state by positioning the engagement projection of the pay-in/pay-out unit stay 207 to the rear of the rear-side constriction portion at the rear end portion of the pay-in/pay-out unit engagement hole 170BY.

In the upper unit 251, when this occurs, the temporary holding section 252 can be maintained in the closed state by positioning the engagement projection of the temporary holding section stay 256 to the rear of the rear-side constriction portion at the rear end portion of the temporary holding engagement hole 260AX.

In the upper unit 251, the upper-side feed-out conveying path 20A, the upper-side take-in conveying path 20B, and the banknote take-in/feed-out portion of the temporary holding section 252 can be connected to the switching conveying path 14A when the pay-in/pay-out conveying unit 16 and the temporary holding section 252 have been closed.

Moreover, in the upper unit 251, the reject branch portion of the switching conveying path 14A can be returned to a banknote (namely, reject banknote) conveyable state when the pay-in/pay-out conveying unit 16 and the temporary holding section 252 have been closed in this manner.

(2-4) Operation and Advantageous Effects of the Second Exemplary Embodiment

In the above configuration, in addition to the configuration of the banknote processing device 1 according to the first exemplary embodiment (FIG. 1 to FIG. 28), in the banknote processing device 250 the temporary holding angle limiting section 255 is also provided to limit the opening angle of the temporary holding section 252 in the upper unit 251, and to maintain the temporary holding section 252 in the opened state at the temporary holding section opening angle.

Thus in the banknote processing device 250, when a jammed banknote is removed by an operator from the switching conveying path 14A, the upper-side feed-out conveying path 20A, the upper-side take-in conveying path 20B, or the temporary holding section 13, the opened state can be more reliably maintained without manually supporting the pay-in/pay-out conveying unit 16 and the temporary holding section 13.

According to the above configuration, in addition to the configuration of the banknote processing device 1 according to the first exemplary embodiment, in the banknote processing device 250 the temporary holding angle limiting section 255 for use by the temporary holding section 252 is also provided to the upper unit 251.

Thus as well as being able to obtain similar advantageous effects to those of the advantageous effect obtained by the first exemplary embodiment described above, the banknote processing device 250 can more reliably maintain the opened state when a jammed banknote is being removed by an operator from the switching conveying path 14A, the upper-side feed-out conveying path 20A, the upper-side take-in conveying path 20B, or the temporary holding section 13, without manually supporting the pay-in/pay-out conveying unit 16 and the temporary holding section 13.

Thus the banknote processing device 250 enables safer jammed banknote removal by an operator from the switching conveying path 14A, the upper-side feed-out conveying path 20A, the upper-side take-in conveying path 20B, and the temporary holding section 13.

(3) Other Embodiments (3-1) Other Embodiment 1

Explanation has been given in the first and second exemplary embodiments described above of cases in which the pair of front-side movable guide 72 and the rear-side movable guide 73 are respectively provided to the plural bidirectional handover sections 40 to 44 so as to be capable of swinging, and in which the front-side movable guide 72 and the rear-side movable guide 73 are coupled together through the left-side coupling plates 81 and the right-side coupling plates 82 so as to swing while the one respective faces of the front-side movable guide 72 and the rear-side movable guide 73 remain parallel to each other.

Figure 32A:
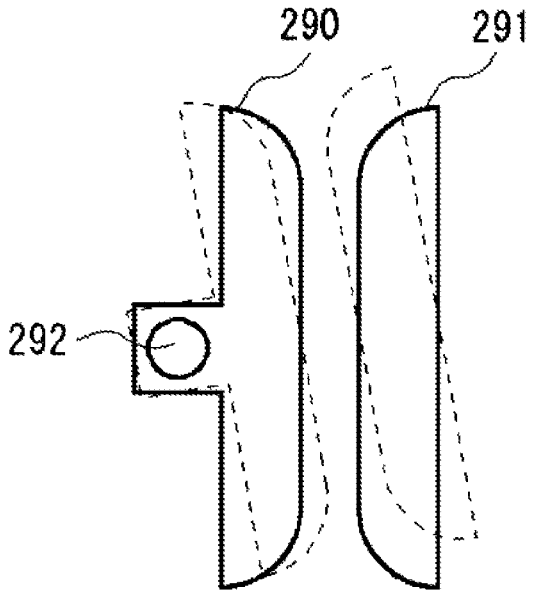
FIG. 32A is a schematic side view illustrating a configuration of a pair of handover guides in another exemplary embodiment.
Figure 32B:
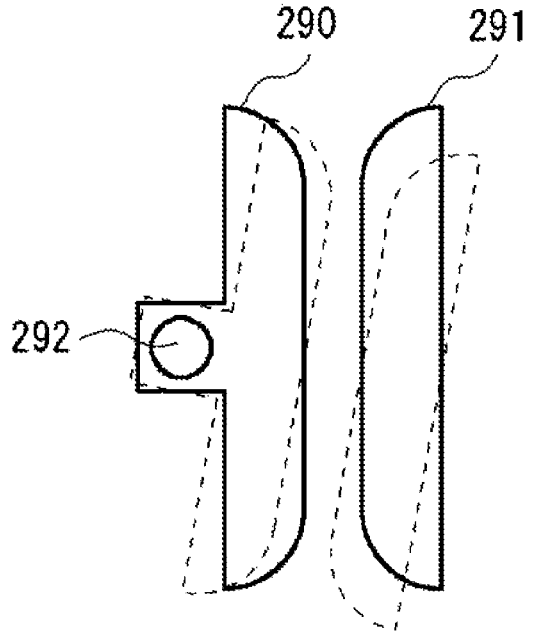
FIG. 32B is a schematic side view illustrating a configuration of a pair of handover guides in another exemplary embodiment.

However, the present invention is not limited thereto, and, for example, as illustrated in FIG. 32A and FIG. 32B, one out of a pair of handover guides 290, 291 may be fixed so that the one face of each remain parallel, and the pair of handover guides 290, 291 may be provided so as to be capable of swinging about a single rotation shaft 292.

Thus in the present invention, such a configuration can simplify the configuration for swinging the pair of handover guides 290, 291 in the bidirectional handover sections.

(3-2) Other Embodiment 2

Explanation has been given in the first and second exemplary embodiments described above of cases in which the left-side positioning pins 87 and the right-side positioning pins 88 and the left-side positioning hole 140C and the right-side positioning hole 140D are employed for positioning for connecting the plural bidirectional handover paths 40A to 44A together with the take-in/feed-out conveying paths 29AX to 33AX of the plural banknote storage boxes 29 to 33.

However, the present invention is not limited thereto, and pairs of handover guides of similar configuration to the front-side movable guide 72 and the rear-side movable guide 73 may also be provided in the plural bidirectional handover sections 40 to 44 at the lower side of the front-side movable guide 72 and the rear-side movable guide 73.

Thus in the present invention, positioning for connecting the plural bidirectional handover paths 40A to 44A and the take-in/feed-out conveying paths 29AX to 33AX of the plural banknote storage boxes 29 to 33 together may be performed in a similar manner to positioning for connecting the plural bidirectional handover paths 40A to 44A and the corresponding connection branch portions of the switching conveying path 14A and the rear-side conveying path 18A together.

Adopting such a configuration in the present invention also enables the plural bidirectional handover paths 40A to 44A to be positioned with respect to, and connected to, the plural take-in/feed-out conveying paths 29AX to 33AX with high precision.

(3-3) Other Embodiment 3

Moreover, explanation has been given in the first and second exemplary embodiments described above of cases in which a respective pair of connection portion front guide 120 and the connection portion rear guide 121 are fixed to the plural conveying path connection portions of the switching conveying section 14 and the rear-side conveying section 18, and the front-side movable guide 72 and the rear-side movable guide 73 are provided to the plural bidirectional handover sections 40 to 44.

However, the present invention is not limited thereto, and respective pairs of conveying guides may be provided to the plural conveying path connection portions of the switching conveying section 14 and the rear-side conveying section 18 so as to be capable of swinging while the one faces of each of the conveying guides remain parallel to each other, and a pair of handover guides may be fixed to the plural bidirectional handover sections 40 to 44, instead of the front-side movable guide 72 and the rear-side movable guide 73.

Namely, in the present invention, when the upper unit 10, 215 is being stowed in the device casing 2, respective pairs of conveying guides of the plural conveying path connection portions of the switching conveying section 14 and the rear-side conveying section 18 may be appropriately swung and positioned with respect to the pairs of handover guides of the plural bidirectional handover sections 40 to 44 before being fitted together.

Adopting such a configuration in the present invention also enables high precision positioning, and connecting of, the plural bidirectional handover paths 40A to 44A to the plural connection branch portions of the switching conveying path 14A and the rear-side conveying path 18A.

(3-4) Other Embodiment 4

Moreover, explanation has been given in the first and second exemplary embodiments described above of cases in which the conveying unit guide section 15B in the upper unit 10, 215 is provided so as simply to be capable of swinging.

However, the present invention is not limited thereto, and an opening angle limiting section may be provided to limit the opening angle of the conveying unit guide section 15B, and to maintain an opened state of the conveying unit guide section 15B at the specific opening angle.

Adopting such a configuration in the present invention enables the conveying unit guide section 15B to be maintained in an opened state without manually supporting the conveying unit guide section 15B when jammed banknotes are being removed from the rear-side conveying path 18A by an operator, enabling a further improvement in operational efficiency to be achieved, and enabling the burden on the operator to be further reduced.

(3-5) Other Embodiment 5

Moreover, explanation has been given in the first and second exemplary embodiments described above of cases in which the upper frame 170, 260 is provided to the upper unit 10, 251.

However, the present invention is not limited thereto, and a unit mounting section 50 may be employed in the upper unit 10, 251 as an upper frame.

Namely, in the present invention, in the upper unit 10, 251, a switching conveying section 14, a classification and conveying unit 15, etc. may be directly provided to the unit mounting section 50, and a conveying unit angle limiting section 200 and a pay-in/pay-out unit opening angle limiting section 201 may also be directly provided to the unit mounting section 50.

In the present invention, adopting such a configuration enables the configuration of the upper unit 10, 251 to be simplified in comparison to those of the first and second exemplary embodiments described above.

(3-6) Other Embodiment 6

Moreover, explanation has been given in the first and second exemplary embodiments described above of cases in which banknotes are conveyed in the banknote processing device 1, 250 with one of their long sides facing toward the conveying direction.

However, the present invention is not limited thereto, and banknotes may be conveyed in the banknote processing device 1, 250 with one of their short sides facing toward the conveying direction.

(3-7) Other Embodiment 7

Moreover, explanation has been given in the first and second exemplary embodiments described above of cases in which the reject box 28 is housed in the safe casing 26.

However, the present invention is not limited thereto, and the reject box 28 may, for example, be provided in the upper unit 10, 251 so as to be external to the safe casing 26.

(3-8) Other Embodiment 8

Moreover, explanation has been given in the first and second exemplary embodiments described above of cases in which the paper sheet handling device according to the present invention is applied to the banknote processing device 1, 250 as explained with reference to FIG. 1 to FIGS. 32A, 32B.

However, the present invention is not limited thereto, and is widely applicable to automatic teller machines (ATM), cash dispensers (CD), pay-out only machines, pay-in only machines, and exchange machines that handle banknotes, and paper sheet handling devices that handle various other types of paper sheets, such as, ticket machines that sell train tickets and theater tickets etc., fare adjustment machines, automatic vending machines, amusement machines such as pachinko machines and slot machines, valuable security handling devices that handle valuable securities, and the like.

(3-9) Other Embodiment 9

Moreover, explanation has been given in the first and second exemplary embodiments described above of cases in which the safe casing 26 as described above with reference to FIG. 1 to FIGS. 32A, 32B has been applied as a safe casing that is internally provided with a paper sheet storage box.

However, the present invention is not limited thereto, and is widely applicable to safe casings of various configurations, such as safe casings with a safe door provided on the back face side of the banknote processing device 1, 250, and safe casings that are not provided with a reject box 28 and that are provided with 1 or plural banknote storage boxes for storing banknotes for pay-in/pay-out, or the like.

(3-10) Other Embodiment 10

Moreover, explanation has been given in the first and second exemplary embodiments described above of cases in which the banknote storage boxes 29 to 33 described above with reference to FIG. 1 to FIGS. 32A, 32B have been applied as paper sheet storage boxes internally provided to the safe casing.

However, the present invention is not limited thereto, and is widely applicable to paper sheet storage boxes of various configurations, such as banknote storage boxes employed to replenish or collect banknotes, to valuable security storage boxes that store valuable securities, paper sheet storage boxes dedicated to storing paper sheets, paper sheet storage boxes dedicated to feeding out paper sheets, and the like.

(3-11) Other Embodiment 11

Moreover, explanation has been given in the first and second exemplary embodiments described above of cases in which the upper unit 10, 251 described above with reference to FIG. 1 to FIGS. 32A, 32B has been applied as a processing unit that processes paper sheets and is provided so as to be capable of being pulled out from, or stowed in, the main device.

However, the present invention is not limited thereto, and is widely applicable to processing units of various other configurations, such as upper units that execute only one of banknote pay-in processing or pay-out processing, upper units provided with a reject box, and the like.

(3-12) Other Embodiment 12

Moreover, explanation has been given in the first and second exemplary embodiments described above of cases in which the banknote processing device 1, 250 described above with reference to FIG. 1 to FIGS. 32A, 32B has been applied as a device with a processing unit that processes paper sheets and is provided so as to be capable of being pulled out, or stowed, with respect thereto.

However, the present invention is not limited thereto, and may be widely applied to devices of various other configurations, such as automated teller machines and cash dispensers, valuable security handling devices, and other devices in which an upper unit is provided so as to be capable of being pulled out, and stowed, from the device rear face side.

(3-13) Other Embodiment 13

Moreover, explanation has been given in the first and second exemplary embodiments described above of cases in which the banknotes described above with reference to FIG. 1 to FIGS. 32A, 32B have been applied as paper sheets that the processing unit processes.

However, the present invention is not limited thereto, and various other configurations of paper sheets may be widely applied, such as valuable securities.

(3-14) Other Embodiment 14

Moreover, explanation has been given in the first and second exemplary embodiments described above of cases in which the switching conveying section 14 and the rear-side conveying section 18 described above with reference to FIG. 1 to FIGS. 32A, 32B have been applied as conveying sections that are provided to the processing unit, and that form conveying paths for conveying the paper sheets.

However, the present invention is not limited thereto, and various other configurations of conveying sections may be widely applied, such as those including only one out of the switching conveying section 14 and the rear-side conveying section 18, a conveying section provided separately from the classification section 17, a conveying section that conveys banknotes only in one conveying direction, a switching conveying section that does not include the frame-side switching conveying section 14Y and the temporary holding-side switching conveying section 14Z forming the reject branch portion, and the like.

(3-15) Other Embodiment 15

Moreover, explanation has been given in the first and second exemplary embodiments described above of cases in which the bidirectional handover sections 40 to 44 described above with reference to FIG. 1 to FIGS. 32A, 32B have been applied as handover sections provided to a top plate of the safe casing in order to hand over the paper sheets between the paper sheet storage box and the conveying path.

However, the present invention is not limited thereto, and various other configurations of handover sections may be widely applied, such as handover sections that only hand over banknotes from the conveying section to the paper sheet storage boxes, or only from the paper sheet storage boxes to the conveying section.

(3-16) Other Embodiment 16

Moreover, explanation has been given in the first and second exemplary embodiments described above of cases in which the upper-side positioning section 116 configured from the swing control levers 85 and the pressing arms 115 described above with reference to FIG. 1 to FIGS. 32A, 32B have been applied as the positioning section that positions for connecting the handover section and the conveying path together when the processing unit is being stowed in the main device.

However, the present invention is not limited thereto, and various other configurations of positioning sections may be widely applied, such as positioning sections configured from positioning pins and positioning holes.

(3-17) Other Embodiment 17

Moreover, explanation has been given in the first and second exemplary embodiments described above of cases in which the switching conveying section 14 described above with reference to FIG. 1 to FIGS. 32A, 32B has been applied as the fixed conveying section that is fixed to the processing unit.

However, the present invention is not limited thereto, and various other configurations of fixed conveying sections may be widely applied, such as the switching conveying section 14 and the conveying unit fixed section 15C, a switching conveying section not provided with the frame-side switching conveying section 14Y and the temporary holding-side switching conveying section 14Z that form the reject branch portion, a switching conveying section directly connected to a reject box, a switching conveying section that is not provided with a conveying roller with a comparatively large external diameter, and the like.

(3-18) Other Embodiment 18

Moreover, explanation has been given in the first and second exemplary embodiments described above of cases in which the rear-side conveying section 18 described above with reference to FIG. 1 to FIGS. 32A, 32B has been applied as the opening and closing conveying section that is provided to the processing unit so as to be capable of opening and closing.

However, the present invention is not limited thereto, and various other configurations of opening and closing conveying sections may be widely applied, such as opening and closing conveying sections separately provided from the classification section 17, conveying unit main body sections to which the conveying unit guide section is fixed, and the like.

(3-19) Other Embodiment 19

Moreover, explanation has been given in the first and second exemplary embodiments described above of cases in which application has been made to the conveying unit angle limiting section 200 described above with reference to FIG. 1 to FIGS. 32A, 32B as the opening angle limiting section employed for the opening and closing conveying section in order to limit the opening angle of the opening and closing conveying section, and to maintain an opened state of the opening and closing conveying section at a specific opening angle.

However, the present invention is not limited thereto, and various other configurations of opening angle limiting sections may be widely applied, such as opening angle limiting sections provided with a foldable stay, opening angle limiting sections provided with a hydraulic damper instead of a stay, and the like.

(3-20) Other Embodiment 20

Moreover, explanation has been given in the first and second exemplary embodiments described above of cases in which the temporary holding section 13 described above with reference to FIG. 1 to FIGS. 32A, 32B has been applied as the temporary holding section that is provided to the processing unit at the opposite side of a boundary of the fixed conveying section to the side on which the opening and closing conveying section is provided, that is connected to the switching conveying path, and that temporarily holds the paper sheets conveyed by the switching conveying path.

However, the present invention is not limited thereto, and various other configurations of temporary holding sections may be widely applied, such as temporary holding sections provided to the upper units so as to be capable of being pulled out and stowed, a storage box provided with a take-in/feed-out conveying section and temporarily store banknotes such as a banknote storage box, and the like.

(3-21) Other Embodiment 21

Moreover, explanation has been given in the first and second exemplary embodiments described above of cases in which the upper-side conveying section 20 provided to the pay-in/pay-out conveying unit 16 described above with reference to FIG. 1 to FIGS. 32A, 32B has been applied as the upper-side conveying section that is provided to the processing unit at the upper side of the temporary holding section and the fixed conveying section, that forms an upper-side conveying path for conveying the paper sheets, with the upper-side conveying path connected to the switching conveying path.

However, the present invention is not limited thereto, and various other configurations of upper-side conveying sections may be widely applied, such as an upper-side conveying section provided separately from the pay-in/pay-out section 19, an upper-side conveying section that forms a conveying path only for 1 system from out of banknote pay-in or pay-out systems, and the like.

(3-22) Other Embodiment 22

Moreover, explanation has been given in the first and second exemplary embodiments described above of cases in which the opening and closing control section 202 described above with reference to FIG. 1 to FIGS. 32A, 32B has been applied as the opening and closing control section that is coupled to the opening and closing of the upper-side conveying section and opens and closes the temporary holding section.

However, the present invention is not limited thereto, and various other configurations of opening and closing control sections may be widely applied, such as opening and closing control sections that open and close the temporary holding section using gears that rotate coupled to the opening and closing of the pay-in/pay-out conveying unit 16.

(3-23) Other Embodiment 23

Moreover, explanation has been given in the first and second exemplary embodiments described above of cases in which the pay-in/pay-out unit opening angle limiting section 201 described above with reference to FIG. 1 to FIGS. 32A, 32B has been applied as the opening angle limiting section for the upper-side conveying section in order to limit the opening angle of the upper-side conveying section, and to maintain an opened state of the upper-side conveying section at a specific opening angle.

However, the present invention is not limited thereto and various other configurations of opening angle limiting sections may be widely applied, such as opening angle limiting sections provided with a foldable stay, opening angle limiting sections provided with a hydraulic damper instead of a stay, and the like.

(3-24) Other Embodiment 24

Moreover, explanation has been given in the first and second exemplary embodiments described above of cases in which the temporary holding angle limiting section 255 described above with reference to FIG. 1 to FIGS. 32A, 32B has been applied as the opening angle limiting section for the temporary holding section in order to limit the opening angle of the temporary holding section, and to maintain an opened state of the temporary holding section at a specific opening angle.

However, the present invention is not limited thereto, and various other configurations of opening angle limiting sections may be widely applied, such as opening angle limiting sections provided with a foldable stay, opening angle limiting sections provided with a hydraulic damper instead of a stay, and the like.

(3-25) Other Embodiment 25

Moreover, explanation has been given in the first and second exemplary embodiments described above of cases in which the connection portion front guide 120 and the connection portion rear guide 121 provided to the switching conveying section 14 and the rear-side conveying section 18 described above with reference to FIG. 1 to FIGS. 32A, 32B have been applied as the pairs of conveying guides that are disposed parallel to each other at a specific separation so as to form a connection branch portion to the handover section of the conveying path between each other, and that have an end portion of a specific shape at the handover section side.

However, the present invention is not limited thereto, and various other configurations of pairs of conveying guides may be widely applied, such as pairs of conveying guides that are capable of swinging while remaining parallel to each other, conveying guides that are provided only on the rear-side conveying section 18, and the like.

(3-26) Other Embodiment 26

Moreover, explanation has been given in the first and second exemplary embodiments described above of cases in which the front-side movable guide 72 and the rear-side movable guide 73 that are substantially J-shaped in cross-section and provided to the bidirectional handover sections 40 to 44 described above with reference to FIG. 1 to FIGS. 32A, 32B have been applied as the pairs of handover guides that are parallel to each other and disposed at the separation of the pair of conveying guides, and that have end portions on the connection branch portion side of the conveying path of a specific shape that is capable of fitting together with the end portions of the pair of conveying guides.

However, the present invention is not limited thereto, and various other configurations of pairs of handover guides may be widely applied, such as the pair of handover guides 290, 291 described above with respect to FIGS. 32A, 32B, and pairs of handover guides that are flat plate shaped.

(3-27) Other Embodiment 27

Moreover, explanation has been given in the first and second exemplary embodiments described above of cases in which application has been made to the handover section case 60, the front-side roller shaft 63 and the rear-side roller shaft 64 of the bidirectional handover sections 40 to 44 described above with reference to FIG. 1 to FIGS. 32A, 32B as the support section that supports the pair of handover guides so as to be capable of swinging according to the position of the pair of conveying guides while remaining parallel to each other.

However, the present invention is not limited thereto, and various other configurations of support sections may be widely applied, such as a casing including a rotatable shaft that is provided to the handover guide specifically for rotation, and separate from the roller shaft.

(3-28) Other Embodiment 28

Moreover, explanation has been given in the first and second exemplary embodiments described above of cases in which the swing control lever 85 of the bidirectional handover sections 40 to 44 described above with reference to FIG. 1 to FIGS. 32A, 32B has been applied as the swing control lever to control swinging of the pair of handover guides.

However the present invention is not limited thereto, and various other configurations of swing control levers may be widely applied, such as swing control levers that are attached to the front-side movable guide 72 so as to catch and be pulled toward the rear side according to movement of the switching conveying section 14 and the rear-side conveying section 18.

(3-29) Other Embodiment 29

Moreover, explanation has been given in the first and second exemplary embodiments described above of cases in which the pressing arm 115 described above with reference to FIG. 1 to FIGS. 32A, 32B has been applied as the arm that swings the pair of handover guides through the swing control lever according to the position of the pair of conveying guides when the processing unit is being stowed in the main device.

However the present invention is not limited thereto, and various other configurations of arms may be widely applied, such as arms that catch on the swing control levers according to movement of the switching conveying section 14 and the rear-side conveying section 18 and pull the swing control lever toward the rear side.

The entire disclosure of Japanese Patent Application No. 2012-278449 is incorporated by reference in the present specification.

All publications, patent applications and technical standards mentioned in the present specification are incorporated by reference in the present specification to the same extent as if the individual publication, patent application, or technical standard was specifically and individually indicated to be incorporated by reference.

INDUSTRIAL APPLICABILITY

The present invention may be employed on paper sheet handling devices such as cash dispensers and valuable security handling devices that handle paper sheets such as banknotes, valuable securities, and the like.

The invention claimed is:

1. A paper sheet handling device comprising:

a safe casing that is internally provided with a paper sheet storage box;

a processing unit that processes paper sheets and is provided so as to be capable of being pulled out from, or stowed in, the paper sheet handling device;

a conveying section that is provided to the processing unit, and that forms a conveying path for conveying the paper sheets, the conveying section including a fixed conveying section that is fixed to the processing unit, an opening and closing conveying section that is provided to the processing unit so as to be capable of opening and closing, and an opening angle limiting section configured to limit an opening angle of the opening and closing conveying section, and to maintain an opened state of the opening and closing conveying section at a specific opening angle;

a handover section that is provided to a top plate of the safe casing in order to hand over the paper sheets between the paper sheet storage box and the conveying path; and a positioning section that positions for connecting the handover section and the conveying path together when the processing unit is being stowed in the paper sheet handling device.

2. The paper sheet handling device of claim 1, wherein:

the opening and closing conveying section, together with the fixed conveying section, forms the conveying path in a loop shape when the opening and closing conveying section has been closed with respect to the fixed conveying section, and the opening and closing conveying section separates a specific portion of the loop shaped conveying path from another portion when opened with respect to the fixed conveying section; and the fixed conveying section forms a switching conveying path as the other portion of the loop shaped conveying path in order to switch the conveying destination of the paper sheets.

3. The paper sheet handling device of claim 2, further comprising:

a temporary holding section that is provided to the processing unit at the opposite side of a boundary of the fixed conveying section to the side on which the opening and closing conveying section is provided, that is connected to the switching conveying path, and that temporarily holds the paper sheets conveyed by the switching conveying path; and an upper-side conveying section that is provided to the processing unit at the upper side of the temporary holding section and the fixed conveying section, that forms an upper-side conveying path for conveying the paper sheets, with the upper-side conveying path connected to the switching conveying path.

4. The paper sheet handling device of claim 3, wherein:

the temporary holding section is provided to the processing unit such that with the fixed conveying section acting as a boundary in between, the temporary holding section and the opening and closing conveying section are respectively capable of opening and closing about the fixed conveying section; and the upper-side conveying section is provided to the processing unit so as to be capable of opening and closing in the same opening and closing direction to the opening and closing direction of the temporary holding section.

5. The paper sheet handling device of claim 4, further comprising an opening and closing control section that is coupled to the opening and closing of the upper-side conveying section and opens and closes the temporary holding section.

6. The paper sheet handling device of claim 5, further comprising an opening angle limiting section for the upper-side conveying section in order to limit the opening angle of the upper-side conveying section, and to maintain an opened state of the upper-side conveying section at a specific opening angle.

7. The paper sheet handling device of claim 6, further comprising an opening angle limiting section for the temporary holding section in order to limit the opening angle of the temporary holding section, and to maintain an opened state of the temporary holding section at a specific opening angle.

8. The paper sheet handling device of claim 1, wherein:

the fixed conveying section includes a pair of conveying guides that are disposed parallel to each other at a specific separation so as to form a connection branch portion to the handover section of the conveying path between each other, and that have an end portion of a specific shape at the handover section side;

the handover section includes a pair of handover guides that are parallel to each other and disposed at the separation of the pair of conveying guides, and that have end portions on the connection branch portion side of the conveying path of a specific shape that is capable of fitting together with the end portions of the pair of conveying guides, and a support section that supports the pair of handover guides so as to be capable of swinging according to the position of the pair of conveying guides while remaining parallel to each other; and a positioning section that swings the pair of handover guides according to the position of the pair of conveying guides when the processing unit is being stowed in the paper sheet handling device to position the handover section for connection of the handover section to the connection branch portion of the conveying path.

9. The paper sheet handling device of claim 8, wherein the positioning section includes:

a swing control lever in order to control swinging of the pair of handover guides; and an arm that swings the pair of handover guides through the swing control lever according to the position of the pair of conveying guides when the processing unit is being stowed in the paper sheet handling device.

10. The paper sheet handling device of claim 9, wherein:

the processing unit is provided so as to be pulled out by moving in one specific direction with respect to the paper sheet handling device, and so as to be stowed by moving in another direction that is the opposite direction to the one specific direction;

the safe casing houses a plurality of the paper sheet storage boxes such that the paper sheet storage boxes are lined up in sequence along the other direction;

a number, which is the same number as the plurality of paper sheet storage boxes, of the handover sections are provided to the top plate of the safe casing so as to correspond to housing positions of the paper sheet storage boxes;

in the conveying section the pairs of conveying guides that form the connection branch portion of the conveying path respectively are disposed positioned so as to correspond to the plurality of handover sections in the fixed conveying section; and the positioning section is provided to one of the pairs of handover guides of the plurality of the handover sections such that leading end portions of respective swing control levers are positioned respectively displaced more toward an orthogonal direction that is orthogonal to the other direction in sequence along the other direction, and is provided to one of the pairs of the pairs of conveying guides that form a plurality of connection branch portions of the conveying path in the fixed conveying section such that leading end portions of the respective arms are positioned respectively displaced more toward the orthogonal direction that is orthogonal to the other direction in sequence along the other direction.

* * * * *